United States Patent [19]

Morokawa et al.

[11] 4,262,351

[45] Apr. 14, 1981

[54] ELECTRONIC TIMEPIECE

[75] Inventors: Shigeru Morokawa, Higashiyamato; Fukuo Sekiya, Tokorozawa; Yukio Hashimoto, Ishigami-Niiza; Yasushi Nomura; Keiichiro Koga, both of Tokorozawa, all of Japan

[73] Assignee: Citizen Watch Company Limited, Tokyo, Japan

[21] Appl. No.: 943,263

[22] Filed: Sep. 15, 1978

Related U.S. Application Data

[62] Division of Ser. No. 626,791, Oct. 29, 1975, Pat. No. 4,150,535.

[30] Foreign Application Priority Data

Oct. 31, 1974 [JP] Japan ..... 49/125801

[51] Int. Cl.[3] ..... G04B 23/02; G04C 21/16

[52] U.S. Cl. ..... 368/73; 368/251

[58] Field of Search ..... 58/4 A, 19 R, 23 C, 58/38 K, 39.5, 50 R, 57.5, 152 R, 152 B; 364/705, 710; 368/72–74, 251

[56] References Cited

U.S. PATENT DOCUMENTS

| | | | |
|---|---|---|---|
| 3,813,533 | 5/1974 | Cone et al. | 235/156 |
| 3,834,153 | 9/1974 | Yoda et al. | 58/38 R |
| 3,852,952 | 12/1974 | Vittoz et al. | 58/23 R |
| 3,889,458 | 6/1975 | Kashio | 58/4 A |
| 3,922,847 | 12/1975 | Cullet et al. | 58/50 R |
| 3,928,959 | 12/1975 | Naito | 58/23 R |
| 3,973,110 | 8/1976 | Rode et al. | 58/25 R X |
| 4,093,992 | 6/1978 | Kanamura et al. | 364/705 |
| 4,101,963 | 7/1978 | Reese et al. | 364/705 |

*Primary Examiner*—Vit. W. Miska

*Attorney, Agent, or Firm*—Jordan and Hamburg

[57] ABSTRACT

An electronic timepiece includes a frequency supply for providing a relatively high frequency time base signal, a frequency converter responsive to the time base signal to provide a relatively low frequency time unit signal, timing signals, and a plurality of word pulses indicative of a plurality of data words representing time data concerning the current time, and a set of additional data other than the time data. A primary register is arranged to store the time data and the additional data, and display means displays the time data and the additional data. An external control member is adapted to provide an input signal when actuated, and an indexing signal is generated in response to the input signal. A secondary register is arranged to store a plurality of sets of additional data and is operable to transfer each set of additional data to the primary register in a sequential manner as the first mentioned set of additional data in response to the indexing signal, whereupon each of the sets of additional data is sequentially displayed by the display means.

16 Claims, 69 Drawing Figures

BIT SERIAL-PARALLEL CONVERTED 42
TO Fig. 22B
502
504
506
DATA IN FROM DATA MODULATING UNIT 36
VDD
(GND)
Vss①
Vss②
P8
P4
P2
FROM DATA MODULATING UNIT 36
532
534
530
536
538
540
40
LEVEL SHIFTER
SDE
ΦLC
TO Fig. 22B

MULTI ALRM SECTION
1400
FROM Fig.27A
TO Fig.27C
1410
1411
QOHER
QHAT
1492
1493
1490
14-BIT -SRG
4-BIT -SRG
SA
1403
DATA-IN CONTROL SA-c
1402
DATA-OUT CONTROL SB-c
SB①
SB②
SB③
1404
1405
1407
ALD②
ALI②
ALD①
ALI①
WATI
QA
STD
WATO
MS②
ERDT
SRG441 OUT
1406
DIN③
SRG3
W KT
QA
AT-DET -b
QERAT
DETAT
1425
KT-DISP -DET -b
1429
SRG441 OUT
SRG111 OUT
DIN③
DT-DET -b
ERDT
1424
Q KT
OHAT
φ-GEN -b
1428
SRG-STOP -c
Q STP
1426
AT-DISP -DET -b
DD
1427
WKT
WDT
WATI
WATO
WIDTH -a
1451
D1
E2
ZIN
Z0
FROM Fig.27A
TO Fig.27C
C1
C2
0.1μF
0.1μF

ELECTRONIC TIMEPIECE

This is a divisional of application Ser. No. 626,791 filed Oct. 29, 1975, now U.S. Pat. No. 4,150,535 issued Apr. 24, 1979.

This invention relates in general to timepiece systems and, more particularly, to a solid state electronic timepiece.

In recent years, considerable efforts have been directed toward the development of solid state electronic timepieces which utilize no moving parts for performing the timing function. In many instances, these have utilized a crystal controlled oscillator as a frequency standard and a display device for displaying the current time in digital mode. In view of this display mode, various attempts have heretofore been made to have the electronic timepiece provided with multiple functions, such as indication of date or alarm time data. Since, however, the additional information is usually displayed on the same display surface on which the hours, minutes and seconds are displayed, it is inconvenient for the wearer of the watch to identify the necessary information. Further, in order that the electronic timepiece provide multiple functions, it must be provided with additional components and associated parts, which can cause mulfunctions and increased size.

Another problem encountered is that the power consumption is necessarily increased because of the need of additional components.

It is, therefore, an object of the present invention to provide a novel solid state electronic timepiece which provides multiple functions in addition to indication of hours, minutes and seconds.

It is another object of the present invention to provide a solid state electronic timepiece in which stored data may be displayed such that the same display elements may be used for indicating hours, minutes and seconds and various other information.

It is another object of the present invention to provide a solid state electronic timepiece to which an option system may be connected, to give additional functions such as a multi-alarm capability, an automatic gain/loss adjusting facility, an electronic calculator facility, etc., in addition to the normal timekeeping function.

It is a further object of the present invention to provide a solid state electronic timepiece which is sufficiently small in size to be of practical use, yet provide accurate time indication as well as ease of operation.

These and other objedts, features and advantages of the present invention will become more apparent from the following description when taken the accompanying drawings, in which.

Figure 1:
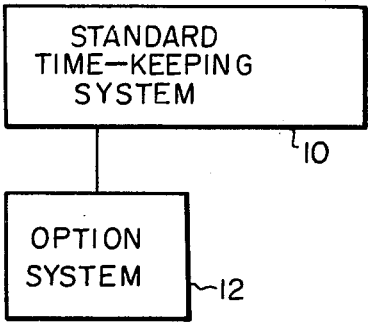
FIG. 1 is a schematic block diagram of a solid state electronic timepiece according to the present invention.

FIG. 1 shows a basic block diagram for a timepiece system in accordance with the present invention. It consists of a standard timekeeping system 10 and, an option system 12, which may or may not be included. The standard timekeeping system 10 provides various functions such as timekeeping and display of data, and is designed to be readily interconnected with the option system, enabling it to perform additional functions.

Figure 2:
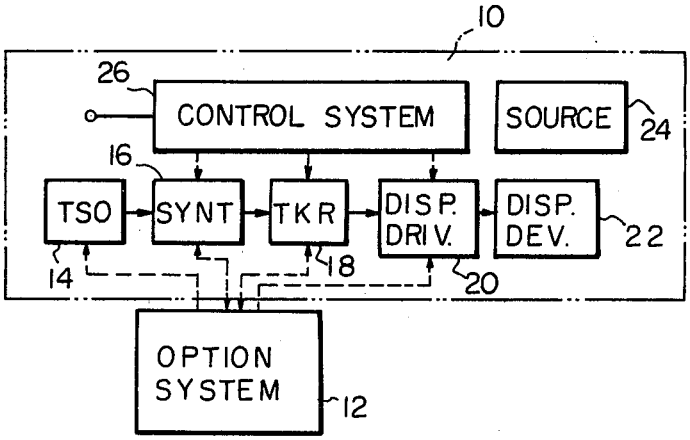
FIG. 2 is a view illustrating the general constitution of the electronic timepiece shown in FIG. 1.

As shown in FIG. 2, the standard timekeeping system 10 comprises a frequency standard crystal oscillator, which provides an accurate stable frequency. This is applied to a frequency synthesizer 16, which divides the oscillator output down to give a time unit signal. The frequency synthesizer also produces various timing signals, which serve to control the operation of the basic timekeeping system. The time unit signal is input to a timekeeping register 18, where it is added into the register contents, to perform the timekeeping function. Time data stored in this register is transferred via a display driver 20 to the display 22. This display can be of liquid crystal type, etc. The various components of the standard timekeeping system are supplied from an electrical power source, such as a silver oxide battery. If an option system 12 is interconnected with the standard timekeeping system 10, the power source may also supply the components of the option system. The standard timekeeping system also includes a control system 26, whose function is to control the timekeeping register, and which may further control the operation of the frequency converter and display driver 20 in various ways which will be described subsequently in detail.

The option system 12 is designed to store data, for example, various different times and dates for the initiation of alarm signal to the user of the timepiece. This alarm data can be written into the option system via the timekeeping register of the standard timekeeping system, so that when the alarm time option system is utilized, it is not necessary to connect additional external control devices. Option system 12 also serves to generate various control signals, as will be described in detail subsequently, and can be set to produce a gain/loss adjusting signal. The gain/loss adjusting signal is applied to an input of the standard timing oscillator, as shwon by the broken line in FIG. 2. In the illustrated embodiment, however, the gain/loss adjusting signal is applied to the frequency synthesizer 16. In addition, various types of data stored in option system 12 are supplied via the timekeeping register to the display driver and hence the display. Since this data is stored in a separate storage register (in the option unit), it has no effect upon the normal timekeeping function. Although in the illustrated embodiment the data is transferred indirectly from the option system 12 to the display driver 20, it is possible to transfer the data directly, if so required.

Figure 3:
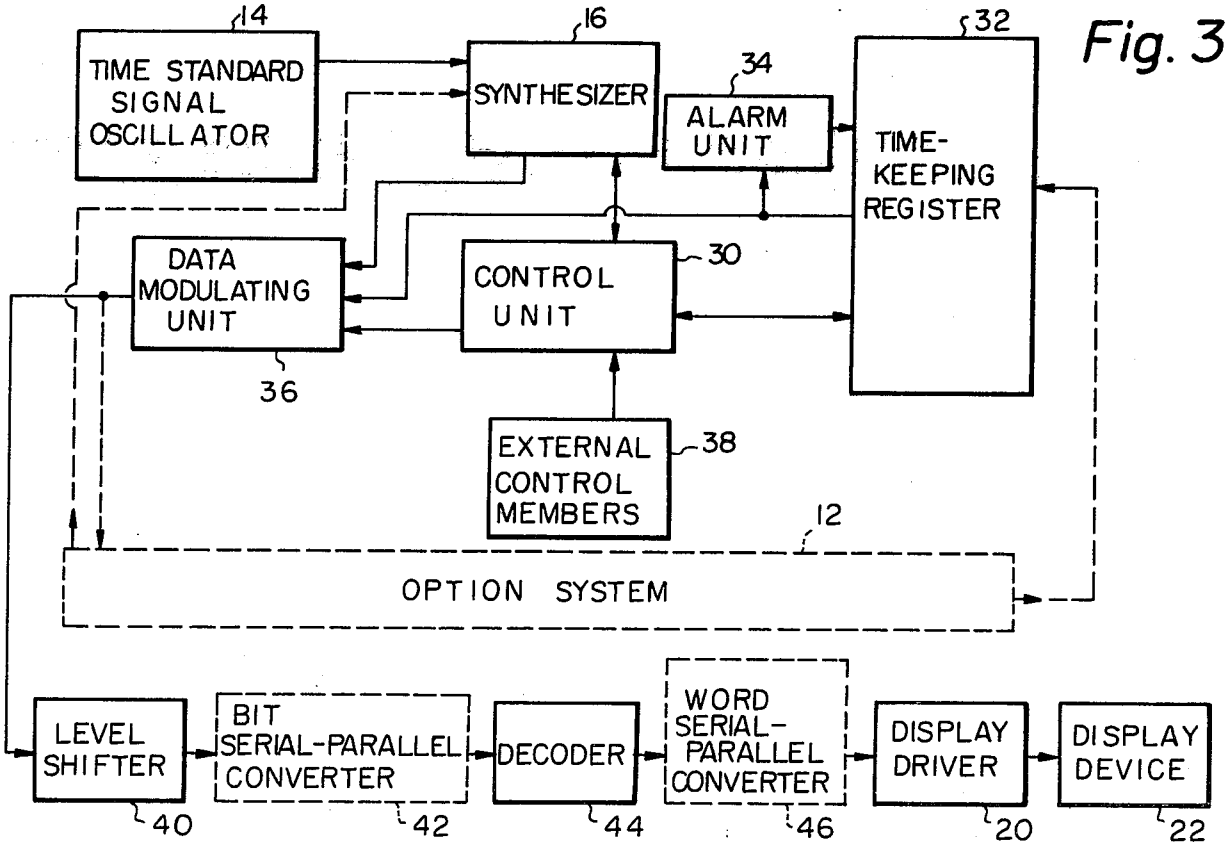
FIG. 3 is a simplified block diagram of electric circuitry for the timepiece shown in FIG. 2.

FIG. 3 is an example of a simplified block diagram of the circuitry of the standard timekeeping system 10 shown in FIG. 1. The circuitry comprises a standard frequency oscillator 14, a frequency synthesizer 16, a control unit 30, a timekeeping register 32, an alarm unit 34, a data modulating unit 36, external control devices 38, level shifter circuits 40, a bit serial-to-parallel converter 42, a decoder 44, a word serial-to-parallel converter 46, a display driver 20 and a display 22.

The standard frequency oscillator circuit 14 is crystal controlled, and generates a frequency of 32,768 Hz. This is applied to frequency converter 16, which generates the 256 Hz timekeeping input frequency and various timing signals for the standard timekeeping system. This 256 Hz signal is input to an adder circuit in the timekeeping register 32, so as to regularly update the current time data stored in this register.

The timekeeping register 32 is basically a storage register into which data can be added serially and into which initial values of time data can be readily set.

The control unit 30 permits initial values of data, from external control devices 38 to be set into the storage register in the timekeeping register 32.

The output data from the timekeeping register 32 is transferred to a data modulation unit 36, which varies the input to the display in accordance with the data stored in the timekeeping register 32 and data which is input from the external control devices 38. The data modulater unit also serves to peridically interrupt the flow of data to the display driving circuits for saving current consumption.The latter consists of level shifter circuits 40, bit serial-parallel coverter 42, decoder 44, word serial-parallel converter 46 and display driver 20. The function of the level shifter 40 is to increase the voltage level of the signals from the logic circuits. The bit serial-parallel converter 42 comprises a 3-bit register, which converts the output data bits from serial-to-parallel mode. The output data thus converted is applied to the decoder 44, which decodes the data for application to the display driver 20. The decoded display segment data is transmitted by the display driver output circuits to the display 22.

As shown in FIG. 3, the output data from the standard timekeeping system can be supplied to the option system 12 as shown by dotted line. The latter is designed such that it delivers various signals to the frequency synthesizer 16 and the timekeeping register 32 of the standard timekeeping system.

Figure 4A:
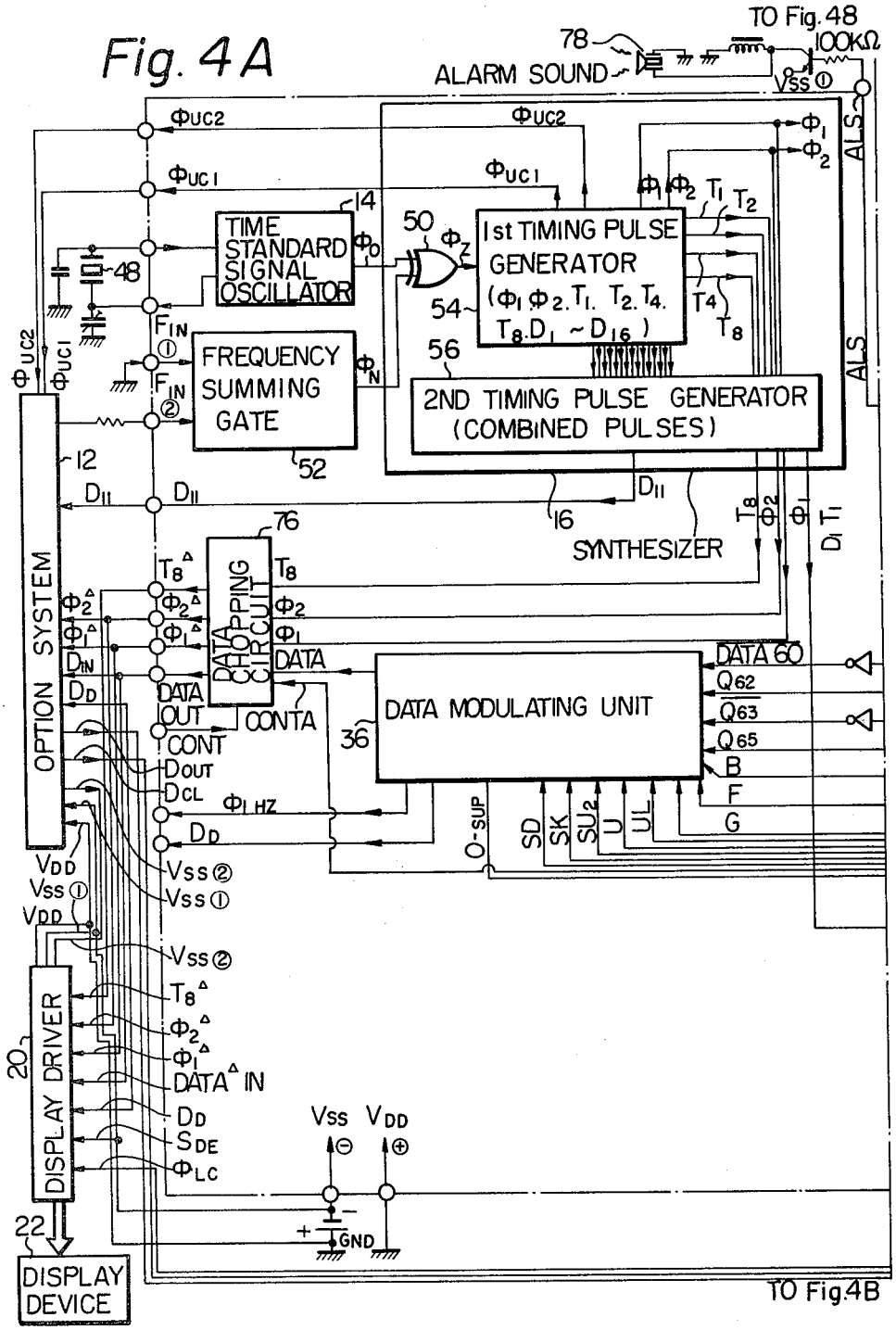
FIGS. 4A, 4B and 4C are detail block diagrams of electric circuitry for the timepiece shown in FIG. 3.
Figure 4B:
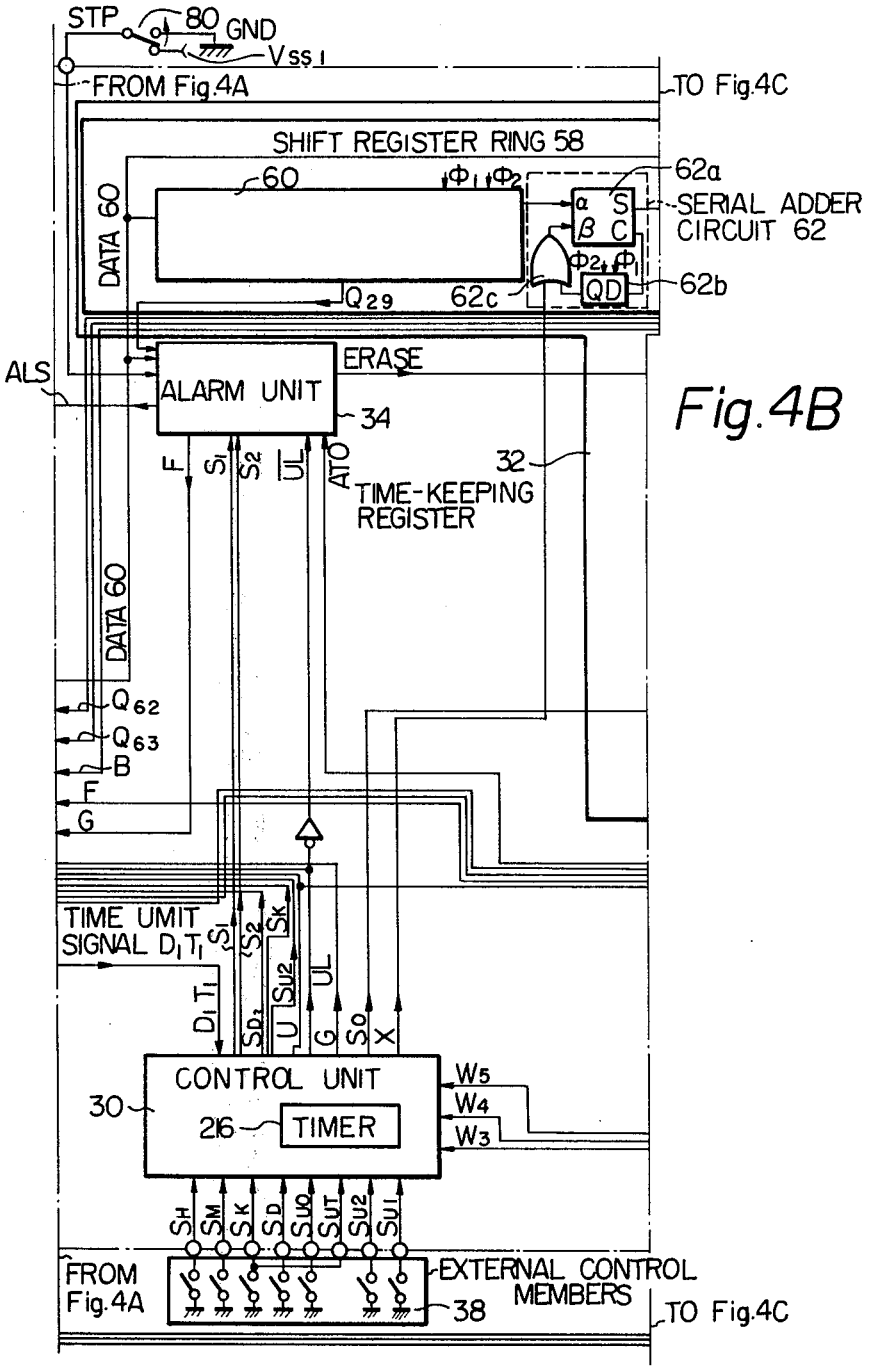
Figure 4C:
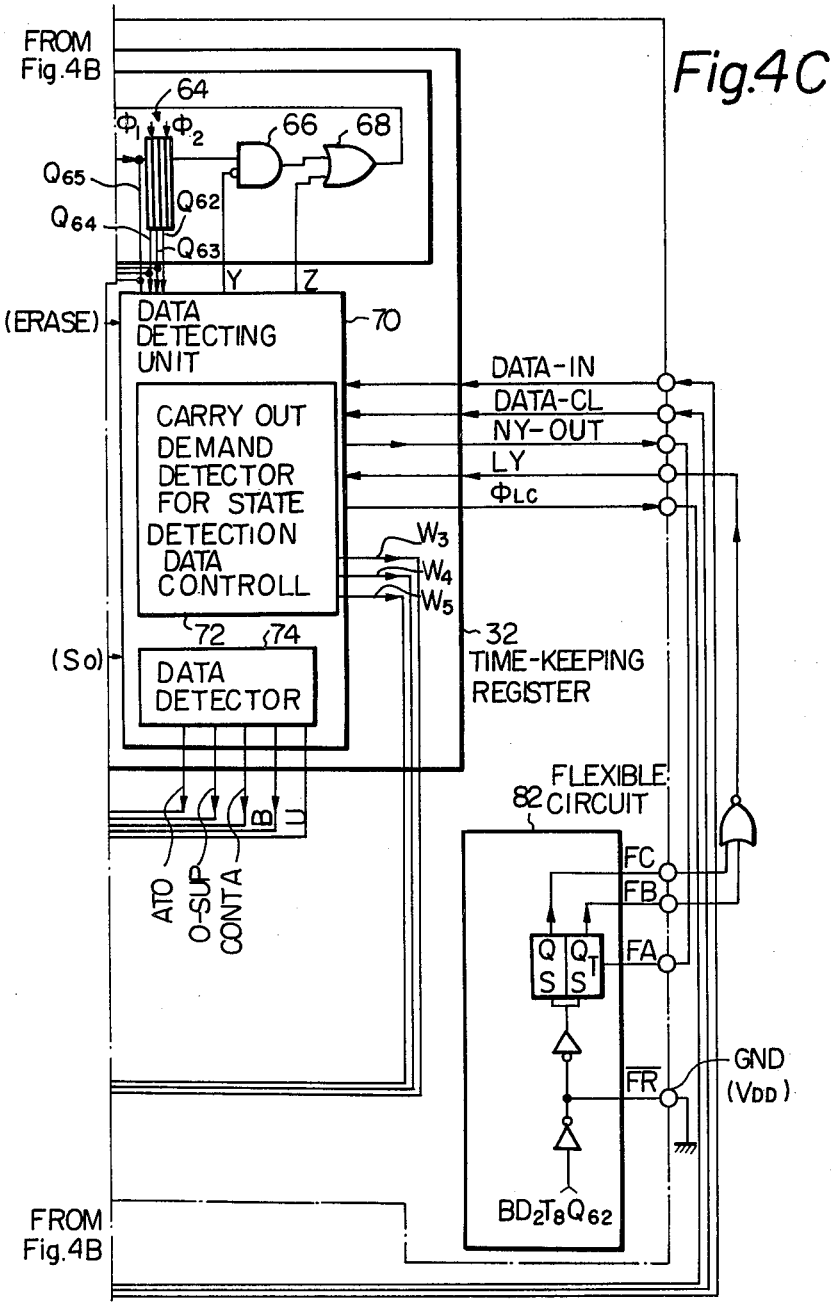

A detailed block diagram of the circuitry of the standard timekeeping system is shown in FIGS. 4A, 4B and 4C, in which like or corresponding parts are designated by the same reference numerals as those used in FIG. 3. As shown, the standard timing oscillator 14 is connected to and controlled by a quartz crystal 48, to produce an output signal $\Phi_o$, i.e., a pulse train with a repetition frequency of 32,768 Hz and a very high degree of frequency stability. This is applied to one input of a frequency summing gate 50 in the frequency converter 16. Frequency summing gate 50 has another input, to which a gain/loss adjusting signal can be applied via frequency summing gate 52. One input of gate 52 is usually grounded, the other input being connected to the option system 12 to receive the gain/loss adjusting signal. This is at a relatively low frequency. The output signal $\Phi_z$ from frequency summing gate 50 is applied to the first timing pulse generator 54 in the frequency cynthesizer 16.

The first timing pulse generator 54 generates varous timing signals, including clock pulses $\Phi_1$ and $\Phi_2$, bit timing pulses $T_1$ to $T_8$ and, word timing pulses $D_1$ to $D_{16}$ as well as the signals $\Phi_{UC1}$ and $\Phi_{UC2}$ which are utilized in timing pulse regeneration, and also may be used in a voltage booster circuit in the option system 12. A second timing pulse generator 56 in the frequency converter 16 receives timing signals from the first timing pulse generator 54 and generates various combined timing pulses. These include the timekeeping input signal $D_1T_1$, of 256 Hz, which is applied to the timekeeping register 32 as signal X. Timekeeping register 32 contains a shift register 58, in which the various types of data are stored. Shift register 58 has its output data fed back to its input, to form a ring configuration. It comprises a first shift register 60, a serial adder circuit 62, a second shift register 64, an inhibitting gate 66, and an OR gate 68, all of which are connected in series, with the output of the OR gate connected to the input of shift register 60 to complete the ring. Shift registers 60 and 64 have 60 and 4 bits respectively, to store timekeeping and other data. The serial adder 62 consists of an adder circuit 62*a*, a delay stage 62*b* and an OR gate 62*c*.

Outputs Q62, Q63, Q64 and Q65 of the shift register ring 58 are connected in parallel to data detecting unit 70, consisting of carry-out demand detector 72 and data detector 74. The carry-out demand detector 72 serves to detect those data conditions under which a carry operation must be performed, and generates carry-out demand signals W3, W4 and W5, which are supplied to control unit 30, and gated through a carry inhibit gate to produce output X. This is input to the OR gate of the serial adder 62 to perform the carry function.

Data detector 74 monitors the data stored in shift register ring 58, and generates output signals ATO, O-sup, CONTA, and B, depending on the data contents. Output signal O-sup indicates whether the tens digit of the date stored in the shift register ring is zero, and is supplied to the data modulation unit 36. Output signal CONTA indicates that the current time data of 1/16 seconds, stored in the shift register ring 58 has been incremented, and is supplied to the data modulation unit 36, to time the output of bursts of data and clock pulses from this unit. Output B is produced by the changing of the current time data stored in the shift register ring 58, and is supplied to the data modulating unit 36 to actuate display flashing at a frequency of 1 Hz.

Control unit 30 receives input signals SH, SM, SK, SD, SUO, SUT, SU1 and SU2 from external control devices 38, and generates output signal $S_1$, $S_2$, U, UL, G, So and X. Output signals $S_1$ and $S_2$, and the inverted signal $\overline{UL}$ are supplied to the alarm unit 34. Output signal X is supplied to the timekeeping register 58 as described above. Output signals U, UL and G are supplied to the data modulating unit 36. Signals SD, SK and SU2 which generate various signals within the control unit, also pass from the control unit 30 to be applied to the data modulating unit 36. The output signal So from control unit 30 is supplied to the carry out demand detector 72.

The data modulation unit 36 has several data switching functions. One is to modify selected portions of the serial data transferred to the display device.

Another function is to chop the flow of data and timing pulses to the display driver unit and option unit, so as to reduce power dissipation in these circuits. To be more specific, a data chopping circuit 76 in the data modulation unit sends out the data to be displayed, as a serial burst designated $DATAOUT^{\Delta}$, for a fixed time period following the start of each cycle of the timekeeping input clock, i.e. every 1/256 seconds. In synchronism with each burst of data, the data chopping circuit 76 also transmits bursts of timing pulses for the same period, designated as $T_8\Delta$, $\Phi_2\Delta$, and $\Phi_1\Delta$, to the display driver circuits and the option unit. This serves to significantly reduce power consumption.

As stated above, the data modulation unit also serves to select certain parts of the output data pulse train and modulates it so as to cause flashing of this data when it is displayed. In the application of this invention described herein, a linear scale type of analog, rather than digital, display is shown to indicate either seconds time data or days of the week. This analog type display, which consists of a number of segments arranged in line, may be modulated such that the indicating segment (showing, for example the day of the week) is switched "ON" and all other segments switched "OFF". The modulation mode may also, however, be such that the indicating segment is switched "OFF" and all other segments "ON". Changing the display mode in this way permits clear indication of which of more than two alternative kinds of data is being shown by the analog display. Variation of this display mode is performed by the data modulation unit 36.

As has been stated, the technique of chopping the flow of data and clock pulses out of the data modulation unit results in a marked reduction in power consumption. This chopping is performed at a repetition rate of 16 Hz, and results in the power consumption of the display and driver circuits being only 10% of that of the conventional standard dynamic timekeeping system. The functions performed by the present invention have, in the prior art, been only possible by using large scale integrated circuits consuming relatively high power. The present invention, therefore, makes possible the construction of wristwatches having a similar multiplicity of functions to previous designs but consuming less power, thereby enabling a battery of lower capacity and smaller size to be used. It should be noted that with the present invention it is possible to arrange that data be transferred to the display driver only when the contents of the data change, or to arrange that the data only be displayed when required by the user. These expedients can enable even greater reductions in power consumption to be achieved.

Outputs Q62, Q63 and Q65 of the shift register 64 are supplied to the data modulation unit 36. Signals Q62 and Q63 are used in the data modulating unit 36 to generate a 1 Hz signal $\Phi_{1Hz}$ which actuates flashing of parts of the display when required. Q65 is used in generating a signal which causes the daily alarm symbol to be displayed. The daily alarm is an alarm mode which, once set in, will cause an audible or visual signal to be generated each day at the same time, until erased by the user. Signals B and O-SUP are also applied to the data modulation unit 36. B is a multiplexed timing signal, also used in generating the flashing signal at 1 Hz. Signal O-SUP serves to suppress leading zeros of the date numeral. Signal F, delivered from the alarm unit 34, serves to initiate display flashing to indicate that alarm time coincidence has taken place. Signals SD, SK, and UL are also applied to the data modulation unit 36, and from these signals a signal $D_D$ is produced, which causes display of alarm time, date or current time, depending on how the external control members have been set by the wearer.

Signals SU1 and SU2 serve to input data to the standard timekeeping system, the components to which the data is supplied being selected by combinations of input signals SH, SM, SK, SD and SUO or SUT provided by external control devices 38, which will be described later. Signals SUO and SUT permit the unlocking of input terminals to allow data to be input. SUO is applied continuously while data is being inset, while SUT enables access to, i.e. "unlocking" of, data input circuits for a fixed time duration after setting in of new time data begins. In the specific application of the present invention described hereafter, input SUO is not utilized, and SUT is connected directly to SK.

Signals SH, SM, SK, SD, SUO and SUT, accordingly have the following functions when applied to the control unit:

a. Selection of addresses to be unlocked. This is done by combinations of input signals SH, SM, SD and SK.

b. Unlocking of the selected addresses, by SUO and/or SUT.

c. Allowing the input data, from SU1 and/or SU2 into the unlocked addresses, to permit the stored current time, alarm time or date to be changed.

It should be noted that there is a case in which when the seconds display is set to zero by an external control device, the unlocking signals by SUO and/or SUT are not utilized. The circuit is also arranged so that none of the displayed numerals will be changed to a higher order numeral by a carry generated while setting in of data is being carried out, for example the hours data is not affected when the minutes data is set by the wearer.

Referring now to the alarm unit 34, the alarm time data is stored in the shift register ring 58, having been set in dependence on the signals SH, SM, SK, SD, SUO, SUT, SU2 and SU1. Two different types of alarm time data may be stored, namely temporary alarm times and daily alarm times. In the case of temporary alarm times, the alarm time data is automatically erased from the storage register after an alarm warning signal has been generated, by means of a signal designated "erase". Access to alarm unit 34 is initiated by the inverted signal $\overline{UL}$. The circuit is arranged such that during the setting of the alarm time, alarm unit 34 is inhibited from delivering an erase signal to the timekeeping register 32. The alarm unit 34 is also arranged such that if the current time coincides with the alarm time during the setting of the current time or setting of alarm time, no erase signal is generated and no alarm signals are actuated.

Coincidence between the current time data stored in the shift register ring 58 and the alarm time data is detected by comparing during a predetermined time interval between timings $D_6$ and $D_9T_4$ a data output designated DATA 60, which is the DATA input to the 60th stage of the shift register ring 58, and a data output Q29 which is the output of the 29th stage of the shift register ring, and is also designated as DATA 28. Upon detection of a coincidence, the alarm unit 34 sends an alarm signal ALS to an alarm sound generating device 78, which remains energized for a predetermined time interval, i.e., one minute. During this time interval, the alarm unit 34 sends a signal F to the data modulating unit 36, whereupon unit 36 generates an output signal which causes almost all of the display elements to flash. When the wearer acknowledges the alarm and depresses a switch connected to the input signals SU1 and SU2, the flashing of the display and the alarm sound are caused to be stopped. Switch 80 is for inhibiting the alarm operation.

As stated previously, shift register ring 58 is so arranged as to store either temporary alarm data or daily alarm data. If temporary alarm data is stored alarm indication is initiated only once, then the alarm unit 34 delivers a signal designated "erase" to the shift register ring 58. This causes erasure of the stored alarm data. If daily alarm data is stored in the shift register ring 58, the erase signal is not generated by alarm unit 34. The alarm time data stored in the shift register ring 58 may also be erased by the wearer setting the hours digit of the alarm time to zero, using external control members 38. The "0" state of the alarm time is detected by the data detector 74, which consequently generates a signal ATO. This indicates that the alarm time is in the "0" state. This signal is applied to the alarming unit 34, causing an erase signal to be generated. When the "alarm time zero" condition is displayed, a zero appears in the hours digit and the minutes digits are blanked out.

Indicated as 82 is a circuit which can be used to provide additional functions in the electronic timepieces and is referred to herein as a flexible circuit. In this example, a bistable circuit in the flexible circuit is arranged to provide frequency division and thereby generate a signal LY, indicating a leap year, which is supplied to the data detecting unit 70.

Figure 5:
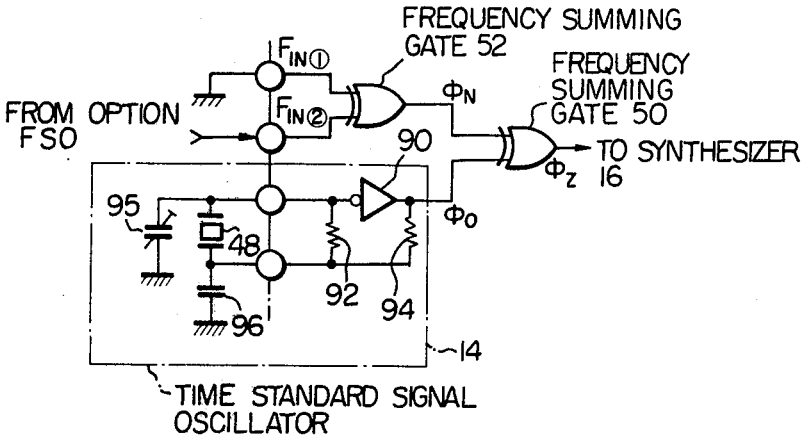
FIG. 5 is a preferred example of the time standard oscillator shown in FIGS. 4A, 4B and 4C.

FIG. 5 shows an example of the time standard signal oscillator 14 and circuit elements associated therewith. As shown, the standard timing oscillator 14 comprises a quartz crystal vibrator 48, operating at a frequency of 32,768 Hz, a CMOS inverter 90, a resistor 92 having a resistance of about 30 Megohms, and a resistor 94 having a resistance of approximately 500 Kohms. The latter serves to maintain the output impedance of the inverter 90 at a substantially constant level, thereby ensuring low distortion of the waveform from the inverter 90 to the vibrator 48. The oscillator circuit also contains a capacitor 96 having a capacitance of about 25 pF and a trimming capacitor 95 having a capacitance of about 20 pF. The quartz crystal 48 has a resonance frequency of, for example, 32,768 Hz. The exclusive OR gate 50 serves to produce a signal $\Phi_2$ having a frequency equal to the sum of the frequencies of two signals $\Phi_N$ and $\Phi_O$ applied to its inputs. Since the output frequency will not be varied by the logical negation of the output from exclusive OR gate 50, an identity gate may also be used to accomplish the same purpose.

Figure 6:
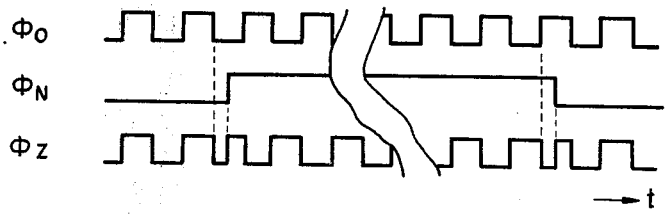
FIG. 6 is an example of waveforms obtained by the circuit shown in FIG. 5.

FIG. 6 shows the waveforms of the input signals $\Phi_N$ and $\Phi_O$ and the output signal $\Phi_Z$. It will be seen that the output signal $\Phi_Z$ is obtained when the signals $\Phi_O$ and $\Phi_N$ are applied to the input terminals of the exclusive OR gate circuit 50 and has a frequency equal to the sum of the frequencies of the signals $\Phi_O$ and $\Phi_N$.

Figure 7A:
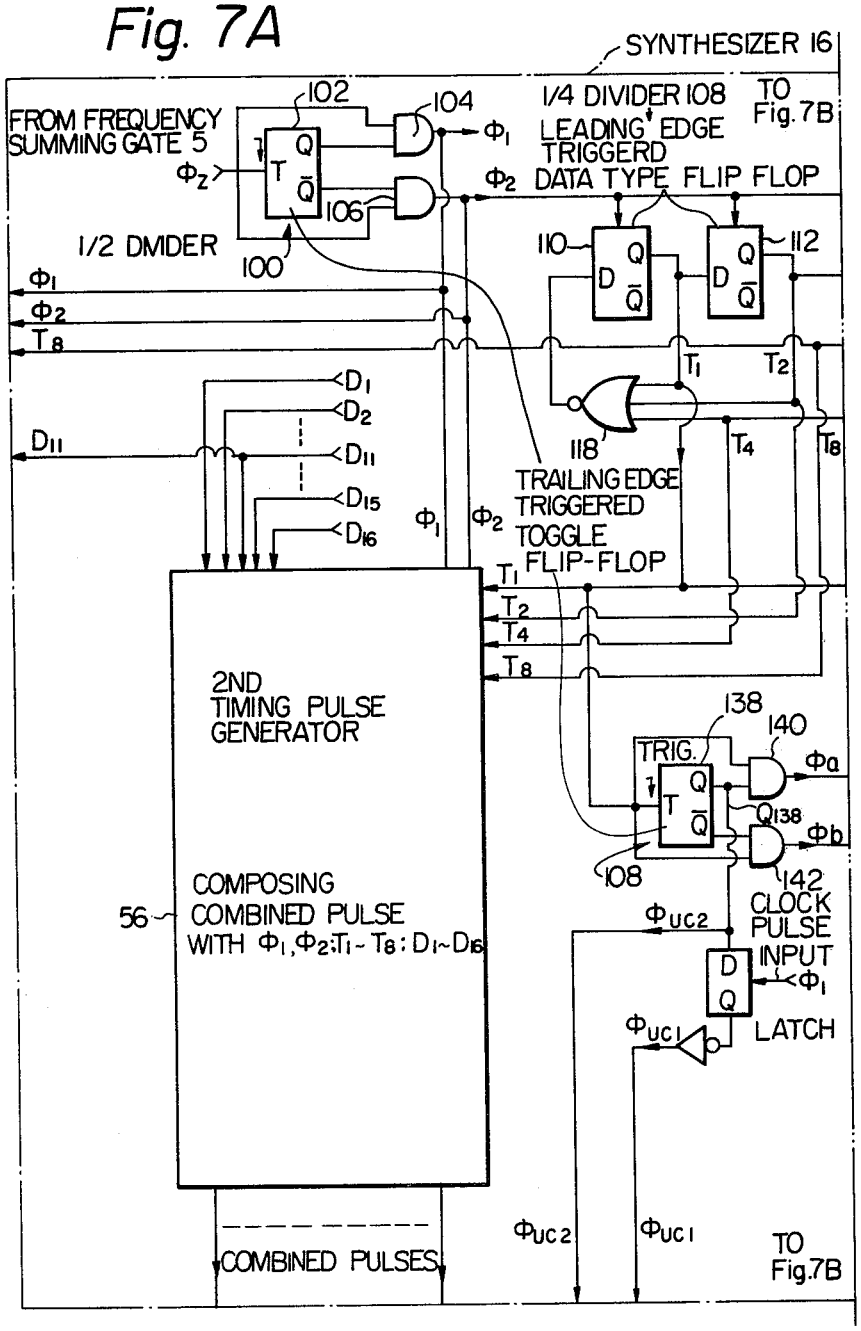
FIGS. 7A and 7B show a preferred example of the frequency synthesizer shown in FIGS. 4A, 4B and 4C.
Figure 7B:
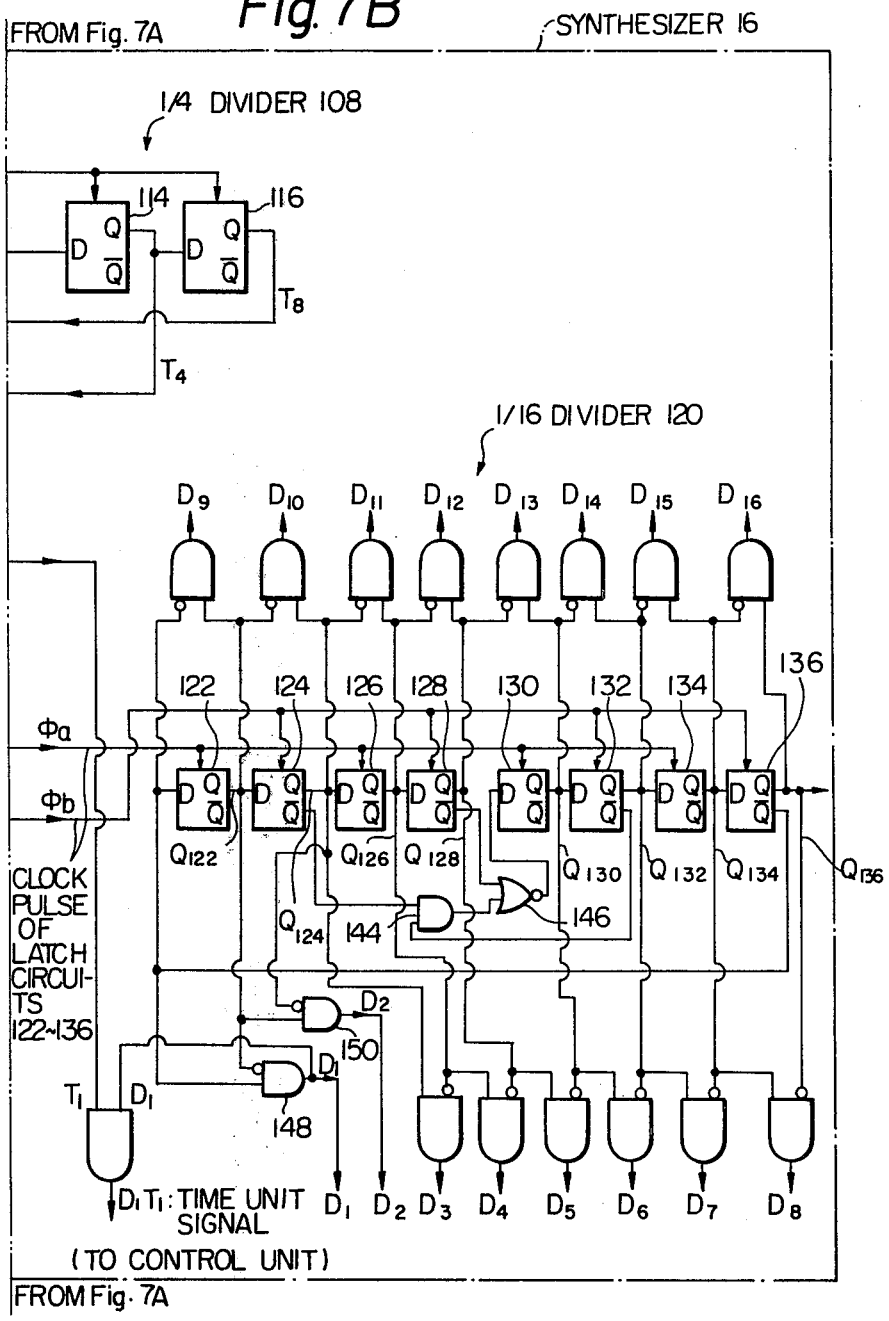
Figure 8:
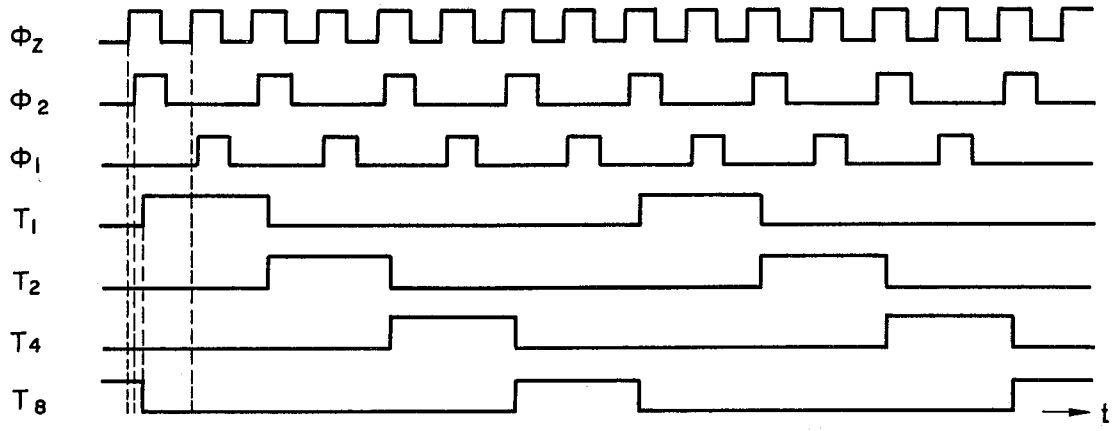
FIG. 8 is a view showing the relationship between clock pulses and timing pulses obtained by the frequency synthesizer shown in FIGS. 7A and 7B.
Figure 9:
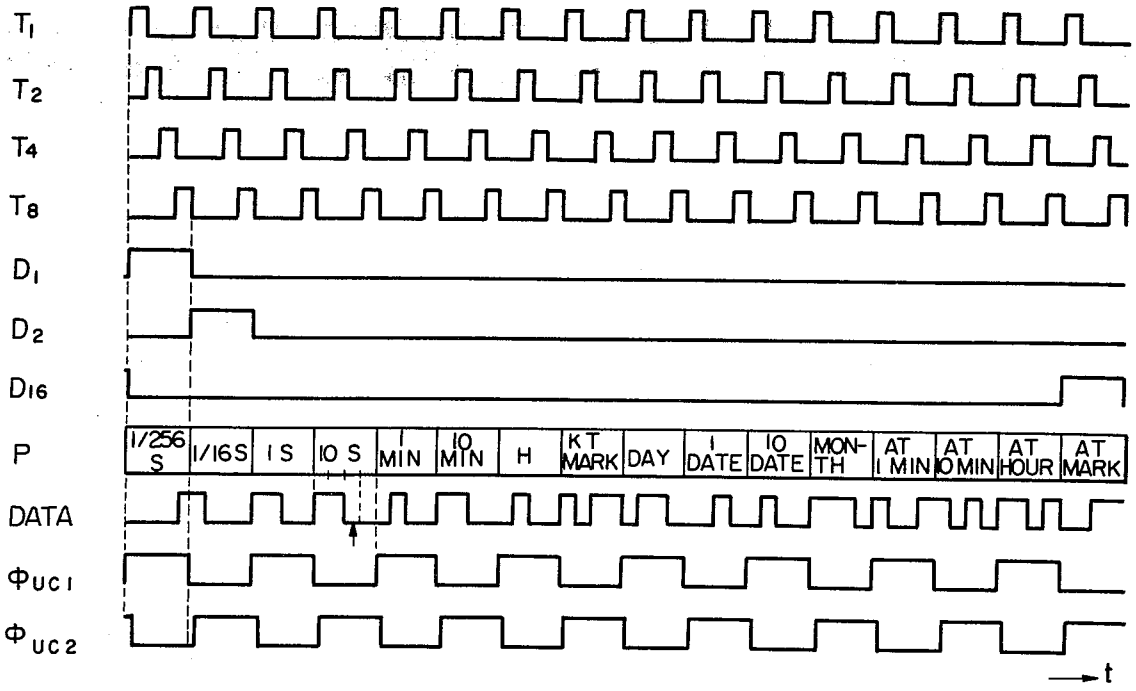
FIGS. 9 and 10 illustrate waveforms generated by the frequency synthesizer of FIGS. 7A and 7B.
Figure 10:
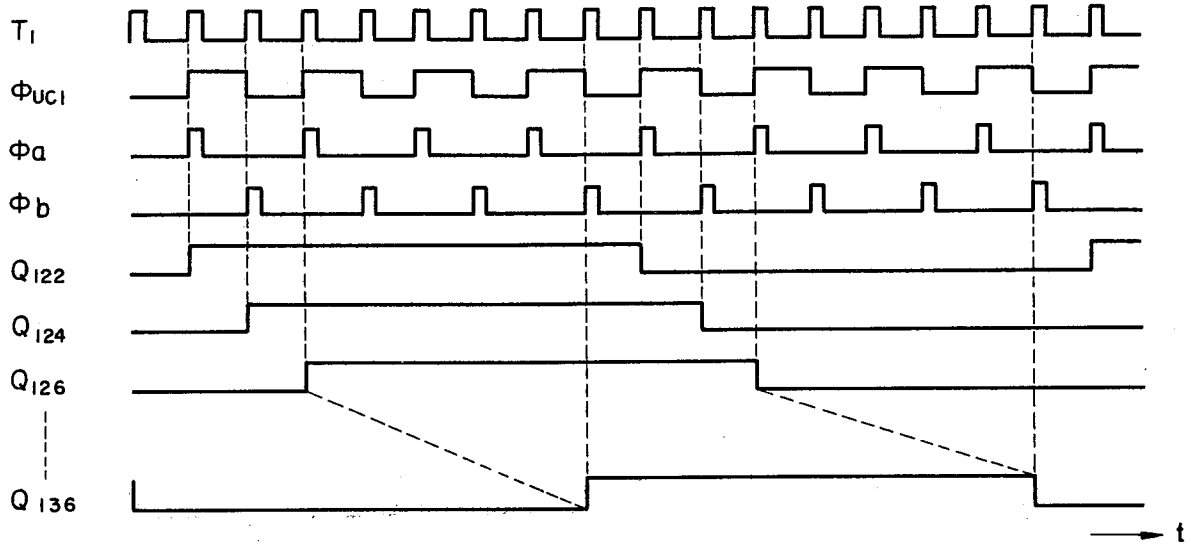

FIGS. 7A and 7B show circuitry details of an example of the synthesizer 16 shown in FIG. 3 and FIG. 4A. As shown, the output signal $\Phi_Z$ from the frequency summing gate 50 is applied to a 2:1 frequency divider 100 forming part of the first timing pulse generator 54, comprising a bistable circuit 102 and AND gates 104 and 106. The ½ frequency divider 100 thus constituted generates clock pulses $\Phi_1$ and $\Phi_2$ which are applied to the timekeeping register 32, data modulating unit 36, display driver 20, etc. for purposes to be described later in detail. The clock pulses $\Phi_2$ are also applied to a 4:1 frequency divider 108, comprising four cascade-connected shift register stages 110, 112, 114 and 116 which are connected in a loop through a logic gate 118. The ¼ frequency divider 108 generates bit timing pulses $T_1$, $T_2$, $T_4$ and $T_8$ which are shown in FIG. 8. Each of these bit timing pulses has a repetition frequency of one quarter the frequency of the clock pulses $\Phi_2$ and a pulse width equal to the period of clock pulses $\Phi_2$. The rising edges of these bit timing pulses are synchronized with the rising edges of the clock pulses $\Phi_2$, and they differ in phase by an amount equal to the period of the clock pulses $\Phi_2$. These timing pulses are delivered to the second timing pulse generator 56, which generates various combined timing signals. Timing pulse $T_8$ is also delivered to the data modulating unit 36, for a purpose to be described later in detail. Timing pulse $T_1$ is delivered by a 1/16 frequency divider 120, comprising eight latch circuits 122 through 136 and a bistable circuit 138. The latter circuit is of the toggle type and its output Q138 rises and falls in synchronism with the timing pulse $T_1$, and has a period twice that of the timing pulse $T_1$. The output of bistable circuit 138 has the same waveform as that of clock pulses $\Phi_{UC1}$. The relationship between signals Q138 and $\Phi_{UC1}$ will be clearly seen by referring to the waveform thereof shown in FIG. 9, which shows the waveforms of the various timing signals. AND gates 140 and 142 connected to bistable circuit 138 generate clock pulses $\Phi_a$ in response to the rising edge of clock pulses $\Phi_{UC1}$ and clock pulses $\Phi_b$ in response to the falling edge of clock pulses $\Phi_{UC1}$, as shown in FIG. 10.

The signal $\Phi_a$, $\Phi_b$ and $T_1$ are related as follows:

$$\Phi_a+\Phi_b=T_1$$

$$\Phi_a\cdot\Phi_b=0 \text{ (corresponding to the low level "L")}$$

$$\Phi_a\cdot T_1=\Phi_a$$

$$\Phi_b\cdot \overset{\tau}{T_1}=\Phi_b$$

Clock pulses $\Phi_a$ and $\Phi_b$ are generated in order to minimize the divider 120 which generates 16 word timing pulses $D_1$ through $D_{16}$. In FIGS. 7A and 7B, the 4:1 divider 108 is comprised of the four data type bistable circuits 110, 112, 114 and 116, triggered by clock pulses $\Phi_2$. If the 16:1 divider 120 were designed using components similar to those used in 4:1 divider 108, it would be necessary to provide 16 master-slave data type bistables in oder to generate the 16 word timing pulses. In the illustrated example of FIGS. 7A and 7B, however, the 16:1 divider 120 is comprised of only eight latch circuits, functioning as four master-slave type bistables.

A data input signal is read into the latch circuit 122 by the rising edge of clock pulse $\Phi_a$, generating output Q122. Circuit 122 remains latched after the clock pulse $\Phi_a$ returns to the low level. Before the clock pulse $\Phi_a$ again goes high output Q122 is latched into circuit 124 by clock pulse $\Phi_b$. In this manner, the data passes through successive latch circuits and each time the data passes through one latch circuit it is delayed by one period of timing pulse $T_1$. The outputs $\overline{Q124}$ and $\overline{Q132}$ are gated through a mode lock gate 144, the output of which is connected to a NOR gate 146 together with the output $\overline{Q128}$. In this manner, the latch circuits 122 to 136 generate signals Q122 to 136, each with a period 16 times that of $T_1$ and 50% duty cycle. The digit pulses $D_1$ to $D_{16}$ are generated using the output signals of latch circuits 122 to $\overline{136}$ respectively. For example, digit pulse $D_1$ is generated by gate 148 from the inverted signals Q122 and $\overline{Q136}$. Likewise, digit pulse $D_2$ is generated by gate 150 from inverted signals Q124 and signal Q122. The other digit pulses $D_3$ to $D_{16}$ are generated in a similar manner and, therefore, a detail description is herein omited.

FIG. 8 shows the relationship between the clock pulses $\Phi_Z$, $\Phi_2$ and $\Phi_1$ and the timing pulses $T_1T_2T_4$ and $T_8$ generated by the 4:1 divider 108 of FIG. 6A. FIG. 9 illustrates the waveforms of the bit timing pulses $T_1$ to $T_8$, word timing pulses $D_1$ to $D_{16}$, data signal DATA and pulses $\Phi_{UC1}$ and $\Phi_{UC2}$. Indicated as P in FIG. 9 is the data appearing at output Q1 of the shift register ring 58 at word times $D_1$ to $D_{16}$. The relationship between the word timing pulses and the data is as follows:

| | | | |
|---|---|---|---|
| $D_1$: | 1/256 | second | word |
| $D_2$: | 1/16 | second | word |
| $D_3$: | 1 | second | word |
| . | . | . | . |
| . | . | . | . |
| . | . | . | . |
| . | . | . | . |
| . | . | . | . |
| $D_{16}$: alarm time symbol word | | | |

The value of the data corresponding to each word time is given by the waveform appearing at output Q1 of shift register ring 58 for each of the bit times $T_1$, $T_2$, $T_4$ and $T_8$ of that particular word. The data is weighted at these four bit times as follows. Bit $T_1$ corresponds to the least significant weight, a high level of data at $T_1$ corresponding to "1" and a low level to "0". High levels of data at times $T_2$, $T_4$ and $T_8$ represent the weights 2, 4 and 8, respectively. From this it can be seen that the waveform of the data signal appearing at the shift register 58 outputs represents the content thereof. The data waveforms shown in FIG. 9 indicate that the standard timekeeping system is registering a current time of 2:32 PM, 33 and 1/16 seconds plus 8/256 seconds, on July 24 and that a daily alarm time of 11:59 AM has been set in.

The clock pulses $\Phi_1$, $\Phi_2$, bit timing pulses $T_1$, $T_2$, $T_4$ and $T_8$ and word timing pulses $D_1$ are also supplied to the second timing pulse generator 56, by which various combined timing signals are generated. To simplify the illustrations, a detail circuit arrangement of the second timing pulse generator 56 is herein omitted.

Figure 11A:
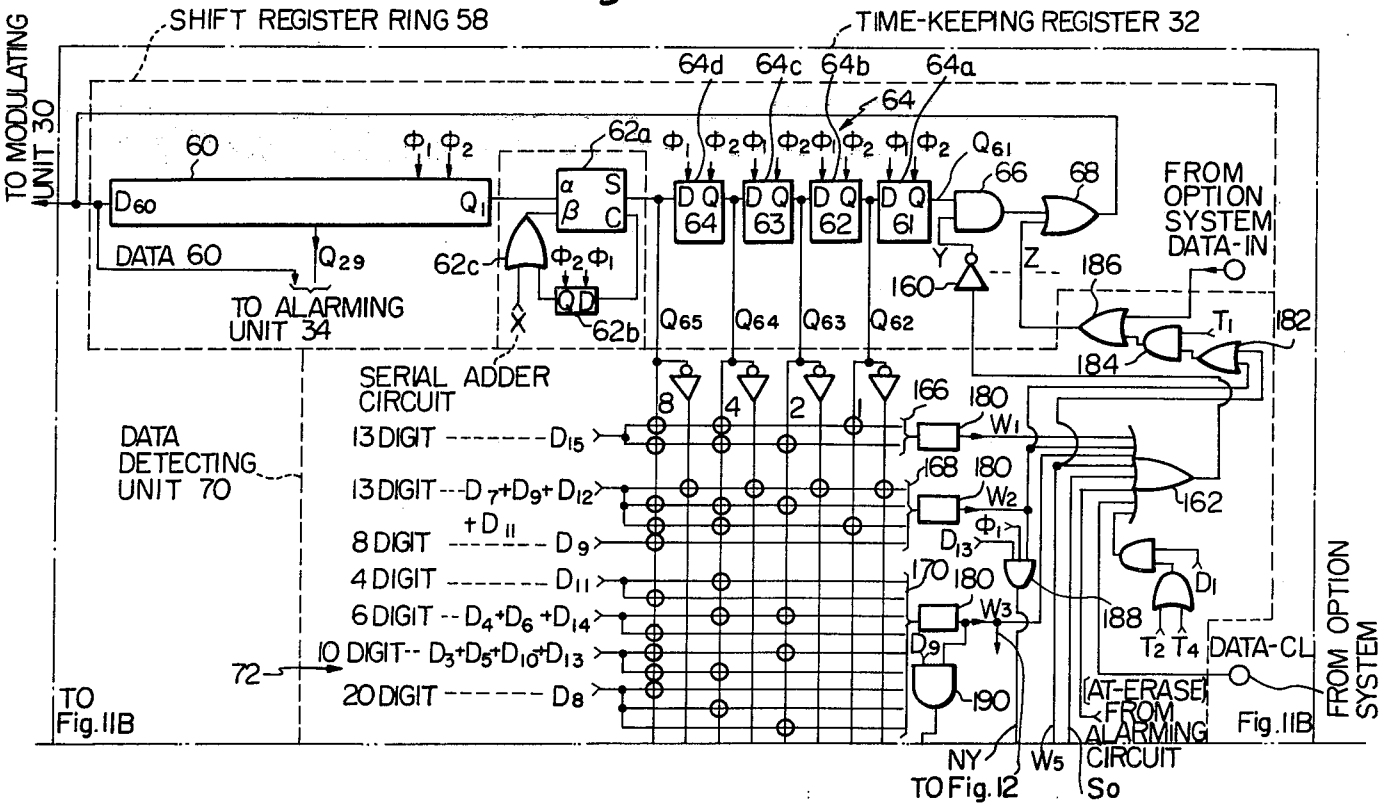
FIGS. 11A and 11B show details of circuitry for the timekeeping register of FIGS. 4A, 4B and 4C.
Figure 11B:
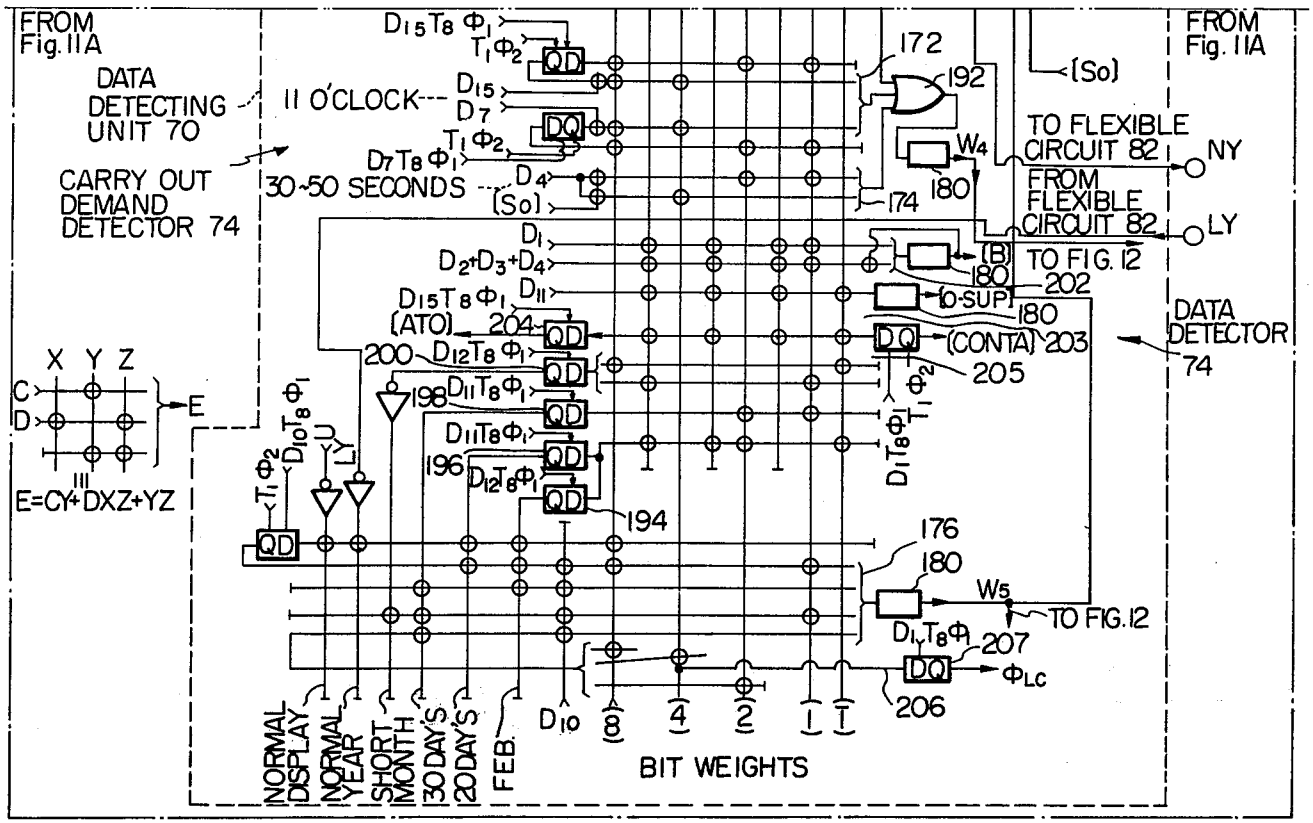

FIGS. 11A and 11B show a circuit diagram of an example of the timekeeping register 32. As described above, the timekeeping register comprises a shift register ring 58 and a data detecting unit 70, which includes a carry out demand detector 72 and a data detector 74.

The shift register ring 58 includes a 60-bit shift register 60, the output Q1 thereof being coupled to a four bit shift register 64 via a serial adder circuit 62. The output Q61 from shift register 58 is connected to one input of an AND gate 66 and the output of this gate circuit is connected to one input of an OR gate 68. The other input of AND gate 66 is connected to the output of an OR gate 162 through an inverter 160. As a consequence, the output from AND gate 166 will be at the "L" level whenever the output of OR gate 162 is "H". The output from OR gate 68 is fed back to the input of shift register 60 as data D60, and also sent to the data modulating unit 36 and to the alarm unit 34 for various purposes to be described later.

The shift registers 60 and 64 are arranged such that data is latched into each shift register stage when clock pulse $\Phi_1$ goes to the "H" level, and appear at the output of the stage when the clock pulse $\Phi_2$ goes "H".

The clock pulses $\Phi_1$ and $\Phi_2$ have a frequency of $2^{14}$ Hz so that writing in and reading out of data is performed 16,384 times per second, i.e. the data is shifted through the registers at this frequency.

As already described, a serial adder 62 is included in the shift register ring 58 so that data stored therein may be incremented. The serial adder 62 comprises a half-added 62*a*, a bistable delay stage 62*b*, an OR gate 63*c*, and has a $\alpha$ input to which the data from shift register 60 is applied, and a $\beta$ input which receives the output of gate 62*c*. The "sum" output of the adder, designated S, is connected to the D input of bistable 64*d*, and a "bit carry" output, designated C connected to the input of shift register 62*b*.

The signal X applied to gate 62*c* of the adder 62 is used to add in various kinds of data to the shift register contents, including word carry inputs, a time setting input and a time unit input $D_1T_1$. Since the 64 bit shift register ring 58 successively transfers the data in response to clock pulses at a frequency of $256\times16\times4=16{,}384$ Hz, a data input of "1", after being initially input at time $D_1T_1$ will thereafter appear at input $\alpha$ of the adder 62*a* at a timing of $D_1T_1$ every 1/256 seconds. The carry bit signal C is delayed in stage 62*b* by one bit time. Thus it is applied to input $\beta$ of the adder 62*a*, at timing $D_2T_2$. Signals appearing on outputs S and C are expressed by the following equations:

$$S=\alpha\cdot\beta,$$

$$C=\alpha\bar{\beta}+\bar{\alpha}\beta$$

The avoid confusion and aid better understanding of the invention, the following definitions and descriptions of the terms used herein will now given.

i. Write-in and Readout:

As described above, when data is latched into the master stage of a master-slave type bistable, this is termed "write-in". When this same data appears at the slave stage of the output of the bistable, this is termed "readout".

ii. Shift Register:

The term "shift register" is used herein to mean an array of data type master-slave bistables connected in cascades. The terms "register" alone is not limited to a shift register but applies to any system capable of registering data.

iii. Timing:

Signals appearing on the output terminals of the shift register stages differ in timing by a factor depending on the clock pulse frequency. Since the clock pulses have a constant frequency, it is possible to consider the output signals of the shift registers as a functions of time. The output of any one stage of shift register 60 can be represented by the symbol "DATA" (x, t), which is a function of the position x of the output in the shift register configuration, and the time t. The time t is herein referred to as a "timing". According to this invention, the output data from the shift register ring 58 is periodically transmitted in bursts before being delivered to the display driver and the option system. For these bursts of data, it is not strictly correct to define the data as a function of time, since it is really a function of the periodic bursts of clock pulses. But in this specification, the term "timing" is used according to the customs of the art. Accordingly, for example the signal $D_1T_8\Phi_1$ generated in the option unit is also referred to by the term "timing".

iv. Data:

Where data which has been stored in the shift register ring 58 in response to the clock pulses is read out from any output terminal of the shift register, it is herein termed "data". The number 60 of the output designation DATA 60 indicates the number of the shift register stage to whose input this data signal is applied. I.e. data 60 comes from the output of shift register stage 61, in FIG. 11A. Sometimes DATA (x.t) is abbreviated to "DATA x" or "DATA" in which x following the term DATA means that the data is connected to the x-th data inout of the shift register. Further, the designation $D_{16}$ DATA 60 means the DATA 60 output at word timing $D_{16}$ and, especially, X-DATA-64 is simply represented as X data. The x-th output of the shift registers is expressed as Qx, thus DATA 60 corresponds to Q59. In other words, the 59th output of the shift register is connected to the 60th data input terminal of the shift register.

The way in which data in the shift register ring 58 is incremented so that counting is performed will now be described, reference to the 1/256 second word time data as an example.

As previously stated, the 1/256 second word is incremented once per circulation of the shift register ring 58. This is done by adding in the time unit signal of $D_1T_1$, i.e. by applying an "H" logic level to the x input of NOR gate 62*c* of the adder circuit at timing $D_1T_1$. Consider a shift register circulation, when the 1/256 second word has the value zero, so that at timings $D_1T_1$, $D_1T_2$, $D_1T_4$ and $D_1T_8$ only low logic levels will be applied to the input $\alpha$ of the adder. Since an "H" logic level is applied to the $\beta$ input of the adder at $D_1T_1$ by the time unit signal, then during the following circulation the 1/256 second word will have the value "one". So that at the next timing $D_1T_1$, an "H" level will be applied to both the $\alpha$ and $\beta$ inputs of the adder. This will cause an "L" at the S output and an "H" at the C output of the adder, and after a one bit delay, i.e. at digit time $D_1T_2$, this will appear at the input of NOR gate 62*c* and hence at the $\beta$ input of the adder. Thus one bit is added into the shift register at timing $D_1T_2$, and since that has a weight of 2, the 1/256 second word now has the value 2. At the next timings $D_1T_1$, $D_1T_2$, $D_1T_4$ and $D_1T_8$, the output from shift register stage Q1 to the adder will be the sequence "0", "1", "0 ", "0". And when these timings next occur, the sequence will be "1", "1", "0", ""0", corresponding to data value 3. This corresponds to a time of $1/256+2/256=3/256$ seconds. This will continue until the sequence "1", "1", "1", "1" appear during word timing $D_1$. When this is applied to the adder, together with the time unit signal, carries are generated resulting in the sequence "0", "0", "0", "0", "1" at timings $D_1T_1$, $D_1T_2$, $D_1T_4$, $D_1T_8$ and $D_2T_1$ being output from the S terminal of the adder. The 1/256 word now has the value 0 and the 1/16 second word the value 1. The 1/16 second word will then be subsequently incremented in the same way as the 1/256 second data, but only every 1/16 seonds.

The four bits of $D_2$ data are thereby varied at 1/16 sec., 2/16 sec., 4/16 sec. and 8/16 sec. respectively.

In this manner, the shifts register ring 58 serves both to store 16 words of 4 bit data and also to increment 12 words so as to continually update tbe current time stored therein. For example, the data 64 designated by the timing $D_3T_1$ to $D_3T_8$ is incremented once every second, and $D_3$ represents one seconds' word.

The arrangements for performing the carry function between the different time units used in a timepiece are dictated by the maximum values of the "units" and "tens" digit words corresponding to minutes, hours, etc.

For seconds and minutes, the "units" digits of the corresponding data are in the range 0 to 9, and the "tens" digits from 0 to 6.

For hours and months, the "units" digit ranges from 1 to 2, for days of the week there is only a "units" digit, from 1 to 7. Means must therefore be provided for detecting when a word carry or digit carry is necessary, dependent on these "units" and "tens" values, i.e. after the "tens" of the minutes data reaches 6, a word carry must be generated to increment the hours data, when the next minutes data increment occurs.

For example, the four bits of $D_3$ data, respectively, represent the 1/1 sec., 2/1 sec., 4/1 sec. and 8/1 sec. weights of the one second "units" data, so that when the $D_3$ data goes to the binary state "0" "1" "0" "1", 10 seconds is represented. In this case, it is necessary to reset the four bits of $D_3$ data to "0" "0" "0" "0" and carry to the 10 second bit of the $D_4$ data, which represents the "tens" of the seconds data. Thus if the four bits of $D_4$ data are "0" "0" "1" "0", the carry will change them to "1" "0" "1" "0". In other words, the carry out operation is performed by: (a) simultaneously examining the count stages of the four bits of a data word, (b) detecting whether a carry must be generated, (c) converting the count of the word to an initial count of the word, and (d) adding "1" to the succeeding word in the following bit time.

In the embodiment of this invention shown in FIGS. 11A and 11B the data from outputs Q62, Q63, Q64 and Q65 of shift register ring 58 are monitored by a data detecting unit 70 and carries are generated in dependence on the contents of these outputs.

It should be noted that, at the bit time of $T_8$ of the data word being monitored, the outputs Q62, Q63, Q64 and Q65 (=DATA 64) will, respectively, represent the bit weights "1", "2", "4" and "8" of the data, respectively.

As previously mentioned, the data detecting unit 70 comprises a carry out demand detector 72 and a data detector 74, which generate various output signals required by the control unit of this invention and monitor the data circulating in the shift register ring 58.

The carry out demand detector 72 comprises matrix gate circuits 166, 168, 170, 172 and 174, which are connected to the output of bistables 64*a*, 64*b*, 64*c* and 64*d* of shift register 64, respectively. The logic relationships for inputs and outputs of these matrix gate circuits are shown in the diagram on the left hand side of FIG. 11B as E. Referring now to matrix gate circuit 166, and noting that inverted signals $\overline{Q65}$, $\overline{Q64}$, $\overline{Q63}$ and $\overline{Q62}$ are also provided (although all of the signals are not used in gate circuit 166), it will be seen that a gate output will be generated under the logic condition D15.Q65.Q64.Q62+D15.Q65.Q64.Q63. Since pulse D15 goes high as the alarm time hours word data bits begin to shift through registeer stages 64, 63, 62 and 61, it will be seen that a gate output will be generated for alarm time hours counts of 13, 14 or 15 at the timing of $D_{15}T_8$.

Figure 14:
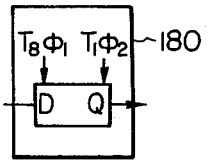
FIG. 14 is a schematic diagram of a shift register shown in FIGS. 11 and 12.

The output is passed through a delay circuit 180 (see FIG. 14 for details of this circit) where it is delayed by one bit time and persisted one word time. The resultant output, as time $D_{16}$ is signal W1, and because of the delay circuit 180 this signal has a duration of one word time.

Note that a word carry signal is not generated when the alarm time hours data is in the "13"~"15" state and "0" hour state is settable. This is for the wearer to be able to set hours data to zero, for reasons explained later. W1 is applied through OR gate 162 and inverter 160 to the input of AND gate 66 thereby inhibits gate 66 while the alarm time hours data is applied to it. This sets the alarm time hours data to zero, i.e. erases the data.

Matrix circuit 168 generates an output "H" for counts of the days of week data of zero, eight or more than eight. This is output at the end of word time D9. Gate 168 also generates an output "H" for counts of zero, 13, 14 or 15 of the current time hours data and the months data, at times T8 of word pulses D7 and D12 respectively. As for gate 168 described above, the output is delayed and extended in circuit 180, to become output $W_2$. $W_2$ is applied through OR gate 162 and inverter 160 to the input of AND gate 66. Having been inverted to logic "L" state, it inhibits gate 66 while the data which has caused generation of $W_2$ is entering, thereby erasing this data. $W_2$ is also applied to OR gate 182, whose output is "ANDED" with bit timing signal $T_1$. The output of gate 184 is sent through OR gates 186 and 68 into the timekeeping register, so that a data count "one" has been set in. The word carry output for months data, which of course normally occurs once per year, is gated through AND gate 188 by pulse $D_{13}$, and is then available for connection to a leap year counter circuit if this is incorporated.

The matrix gate circuit 170 serves to detect the count "4" of the "tens" of days data and the count "6" of the "tens" of minutes data, "tens" of second data of current time, also "tens" of minutes data of the alarm time, actuated by word pulses $D_{11}$, $D_4$, $D_6$ and $D_{14}$ respectively. Gate circuit 170 also detects the count "10" of the "units" of seconds data, "units" of minutes data, "units" of days data for current time and "units" of minutes data of the alarm time, in response to the word pulses $D_3$, $D_5$, $D_{10}$ and $D_{13}$ respectively. This gate circuit also detects the count "2" of the AM/PM symbol data actuated by the word pulse $D_8$. An output signal $W_3$ is generated thereby which is used to erase the data producing it, and to generate a carry into the next word. The output signal $W_3$ is applied through OR gate 162 and inverter 160 to effect erasing. At the same time, signal $W_3$ is applied to the control unit, thereby generating an output x, which is applied to adding circuit 62 of the shift register ring 58 thus effecting a carry into the succeeding word time data.

Signal $W_3$ is also applied to one input of AND gate 190, to whose other input the word pulsed $D_9$ is applied. The output of gate 190 is applied to OR gate 192, whose output is delayed by one word time by delay bistable 180. Output signal $W_4$ from this delay unit causes a carry into the days data each time the "PM" symbol changes to "AM" at midnight.

The matrix gate circuit 172 stores the information that count "11" of the hours data of alarm time has been set, by writing an output into a storage latch at word time $D_{15}T_8\Phi_1$. The output of this latch is connected back into matrix gate circuit 172 so that a transition from count "11" to count "12", ocurring during a subsequent memory cycle, generates an output signal. This is applied to OR gate 192 to produce output signal $W_4$, used to carry into the AM/PM data word.

If a scconds zeroing signal So is applied to matrix gate circuit 174 when the "tens" of the seconds data has the count "3", "4" or "5", then a carry ($W_4$) is generated into the succeeding minutes data. At the same time signal So is input to OR gate 162, thereby setting the seconds data from 1/256 seconds digit to 10 seconds digit.

The matrix gate circuit 176 detects long and short months producing an output signal $W_5$ which controls the "units" of days data, "tens" of days data and "tens" of months data. Matrix gate circuit 176 is also connected to latch circuits 194, 196, 198 and 200, which detect and store the data regarding February, 20 days, 30 days and inverted signals of the short months (February, April, June, September, and November). The conditions which are detected to generate a word carry to change the display to the 1st of the succeeding month are:

(i) February 29th, in a normal (not leap) year.
(ii) February 30th, or counts higher than 30.
(iii) The 31st day count of the short months.
(iv) The 32nd day count and more of both the long and short months.

The results of the above items i, ii, iii and iv are OR'd to produce an output signal $W_5$.

Signal $W_5$ is used as a carry signal to effect carrying to the next digit after the data producing it has been reset to zero. If, for some reason, a count of 31 occurs for February, the signal $W_5$ applies a carry to the "tens" of the days data, so that Feb. 31 converted to Feb. 41. The "tens" of days data is thereby, in effect, reset to zero (since a count of more than 3 has no significance) and a carry signal is applied to the month data. thus, March 1st is displayed.

In the case of months of 30 days, "short months", the following sequence occurs:

a. The status of "not short month" is detected and stored in latch 200, by pulse $D_{12}T_8\Phi$hd 1.

b. This latch output is inverted and applied to matrix gate 176 as an input labelled "short month".

c. The count of 30 date days is detected and stored in latch circuit 198. The output of this latch is applied to matrix gate 176 labelled as "30 days".

d. The transition from 30 days to 31 days is detected by the matrix gate, and generates an output $W_5$. This is applied to the carry input NOR gate of the control unit in FIG. 12, causing an increment of the "tens" digit of date days to 4.

As explained above, as well as causing a "months" carry, this is equivalent to setting this date days data to zero. $W_5$ is also applied to gates 162 and 82 of timekeeping register 32 in register 58, causing the "units" of date days to be set to a count of one. The result of the above sequence is that the date data at midnight at the end of a "short month" is changed to the 1st day of the following month. Whenever a count of 32 to 39, inclusive, is detected (by the OR gate output at the bottom of FIG. 11B in the matrix gate), a $W_5$ output is generated and the date data is thereby set to the 1st of the following month, in the same way as described above for the "short" months. This covers the case of months of 31 days, as well as any spurious states due to noise pickup or when power is first applied to the timepiece.

In the case of February, the two inverting buffers shown on the left of FIG. 11B with inputs U and LY enable adjustment to be made for leap years. Normally, the inputs to both these inverters are low. In this case, the state of "February 28" is detected and stored in the latch circuit on the left of these inverters. Then when the transition to February 29 occurs, a $W_5$ output is generated to produce a date of March 1, as described above. However, in the event of a leap year, then the input to the latch circuit can be inhibited, either by the output of a counter which generates an output LY when a leap year occurs, or by the wearer manually setting the date to February 29. The latter procedure is possible since the action of setting a date causes signal U to be generated.

Data detector 74 comprises a matrix gate circuit 202, which detects the count "0" in the 1/16 sec. data, "units" of seconds data, "tens" of seconds data and "units" of minutes data, during word pulses $D_1$, $D_2$, $D_3$ and $D_4$ respectively. This output signal of the detector is delayed by one bit time by delay circuit 180, thus producing a signal [B], which is used as a composite synchronizing signal. [B] is also used in generating reset signals for a timer circuit in the control unit, and various logic level setting circuits. These control the logic levels of all input terminals connected to external switches. Signal [B] is also used to produce 1 Hz switching signals in the data modulation unit, which serve to cause flashing of all or parts of the displayed data. The logical product $B \cdot D_5$ of signal [B] and the word pulse $D_5$ gives a signal of one minute period, and the logical product $B \cdot D_4$ gives a signal of 10 seconds period.

Actuated by word pulse $D_{11}$, the matrix gate circuit 203 detects the count "0" of the "tens" of days data, and generates an output signal [O-SUP] to suppress display of this "0". Display of leading zeroes in the seconds and minutes display is acceptable, but it is desirable to suppress them in the case of the days display. Unsuppressed display of leading zeroes for the seconds and minutes data seems natural, and helps to present misreading of the display. However, it should be noted that modifications may be made to the circuit arrangement to suppress display of the count "0" in any desired digit. The signal [O-SUP] is delivered to the data modulating unit to actuate suppression of the "0" display of the "tens" of days data.

The matrix gate circuit 205 detects count "0" of the 1/256 second data, its output signal being delayed by one bit time in delay bistable 205 to generate an output signal [CONTA].

Matrix gate circuit 205 is also connected to a latch circuit 204, which detects the count "0" of the hours digit of the alarm time in response to timing pulse $D_{15}T_8\Phi$hd 1, producing an output signal [ATO] which indicates that the alarm time hours data is zero, i.e. that no alarm time is set in.

The matrix gate circuit 206 detects the bit with weight $2^2$ of the 1/256 second digit, i.e., output Q64 of bistable 64. Output Q64 is read out by latch circuit 207 at following timing pulse $D_1T_8\Phi_1$. This output is a 32 Hz signal, used for driving display elements.

An AT-ERASE signal is applied to the OR gate 162 from the alarm unit when the current time and the alarm time coincide, if a temporary alarm has been set in. The AT-ERASE signal causes an inhibit to be applied to gate 66, thereby setting the stored alarm time data to zero.

Table I shows the relationship between the word pulses $D_1$ through $D_{16}$ and the outputs $W_1$ through $W_5$ from the data detecting unit 72. In Table I, the symbol * means that a carry is made from the "units" of days data to the "tens" of days data, and a carry is made from the days data to the month data at the end day of the month. In this case, the data which has generated a carry is set to "1" after the carry is performed. The symbol  means that a carry is effected into the week-day data. The symbol * means that the transition from count "11" to "12" of the hours data is detected and a carry is made into the next data word, which is the AM/PM symbol data. A symbol "-" means that no W output signal is generated.

TABLE I

| Date | Data monitored | Count Min. | Count Max. | Data word to which carry is made | Output Y;setting previous date to zero | Output Z;setting "1" into data after preset to zero | Word Output X; carry to next word | Output |
|---|---|---|---|---|---|---|---|---|
| 1/256 sec. | $D_1$ | 0 | 15 | $D_2$ | not necessary | not necessary | not necessary | — |
| 1/16 sec. | $D_2$ | 0 | 15 | $D_3$ | " | " | " | — |
| 1 sec. | $D_3$ | 0 | 9 | $D_4$ | necessary | " | necessary | $W_3$ |
| 10 sec. | $D_4$ | 0 | 5 | $D_5$ | " | " | " | " |
| 1 min. | $D_5$ | 0 | 9 | $D_6$ | " | " | " | " |
| 10 min. | $D_6$ | 0 | 5 | $D_7$ | " | " | " | " |
| hour | $D_7$ | 1 | 12 | $D_8$ | " | necessary | ***necessary | $W_2$***,$W_4$ |
| PM | $D_8$ | 0 | 1 | $D_9$,$D_{10}$ | " | not necessary | **necessary | $W_3$ |
| week day | $D_9$ | 1 | 7 | none | " | necessary | not necessary | $W_2$ |
| 1 day | $D_{10}$ | 0 | 9 | $D_{11}$ | " | not necessary | necessary | $W_3$ |
| 10 days | $D_{11}$ | 0 | 3 | $D_{12}$ | " | not necessary | necessary | $W_3$ |
| month | $D_{12}$ | 1 | 12 | (NY) | " | necessary | not necessary | $W_2$ |
| AT-1 min. | $D_{13}$ | 0 | 9 | $D_{14}$ | " | not necessary | necessary | $W_3$ |
| AT-10 min. | $D_{14}$ | 0 | 5 | no | " | " | not necessary | $W_3$ |
| AT-hour | $D_{15}$ | 0 | 12 | $D_{16}$ | " | " | necessary | $W_1$ |
| AT-PM | $D_{16}$ | 0 | 1 | " | " | not necessary | — | |
| Date data | $D_{10}$,$D_{11}$,$D_{12}$ | 1 | 28~31 | $D_{12}$ | " | *necessary | *necessary | $W_5$ |

The conditions for generating signals Y, Z, and X can be summarized as follows:

1. Erasure of previous data: $Y=W_3+W_2+W_1+W_5+S_0+D_1(T_2+T_4)+$AT-ERASE+DATACL
2. "1" set into data after reset to zero: $Z=(W_2+W_5)T_1+$DATA IN
3. Carry to next data word:

$$X=\{(D_{15}W_3+W_4+W_5)\cdot(\text{Carry inhibit})+\cdot D_1+S_1\cdot U\}\cdot T_1+\{S_2'\}$$

Figure 13:
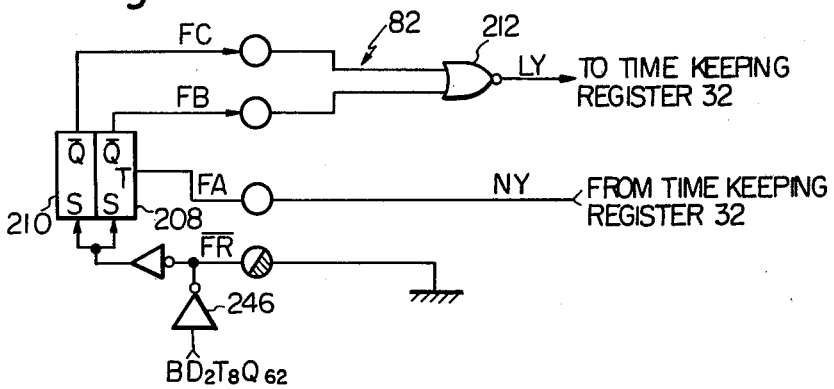
FIG. 13 is an example of the flexible circuit shown in FIGS. 4A, 4B and 4C.

FIG. 13 shows an example of the "flexible" circuit 82. This is based on a bistable counter, and can be used to increase the versatility of the standard timekeeping system of the invention. The output of gate 246 is normally maintained at a high logic level, but is changed to a low level for a very short time period at a rate of 8 times per second by pulse $B\cdot D_2\cdot T_8\cdot Q62$. During these low level intervals, bistables 208 and 210 are preferentially set, so that both outputs go to "L" logic level. If input $\overline{FR}$ is set to "H" level by grounding it gate 206 will present a relatively low resistance for the interval of pulse $B\cdot D_2\cdot T_8\cdot Q62$. However, since this time period is short, the average current drawn when the output of 246 is grounded is less than 100nA. If the output of inverter 246 is left grounded, i.e., $\overline{FR}$="H", bistables 208 and 210 can be used for counting. Assuming that $F_A$="L" and $F_B$="L" at the count "0", the following relations hold:

| | | |
|---|---|---|
| at count 0 | $F_B$ = "L" | $F_C$ = "L" |
| at count 1 | $F_B$ = "H" | $F_C$ = "L" |
| at count 2 | $F_B$ = "L" | $F_C$ = "H" |
| at count 3 | $F_B$ = "H" | $F_C$ = "H" |

Note that if terminal $\overline{FR}$ is not kept grounded, it may be used as the source of an 8 Hz signal. If, however, the terminal $\overline{FR}$ is grounded, bistables 208 and 210 operate as binary counter. This "flexible" circuit may be used to count leap years, since only a 4-bit counter is required. Although the setting of the counter to register leap years is somewhat time-consuming, it is quite simple. The wearer can set the "leap-year" condition by incrementing the months data manually, thereby causing an input to the counter once every 12 months, and noting when the "days of month" data for February advances to 29. The counter contents now indicate a leap year.

Figure 12:
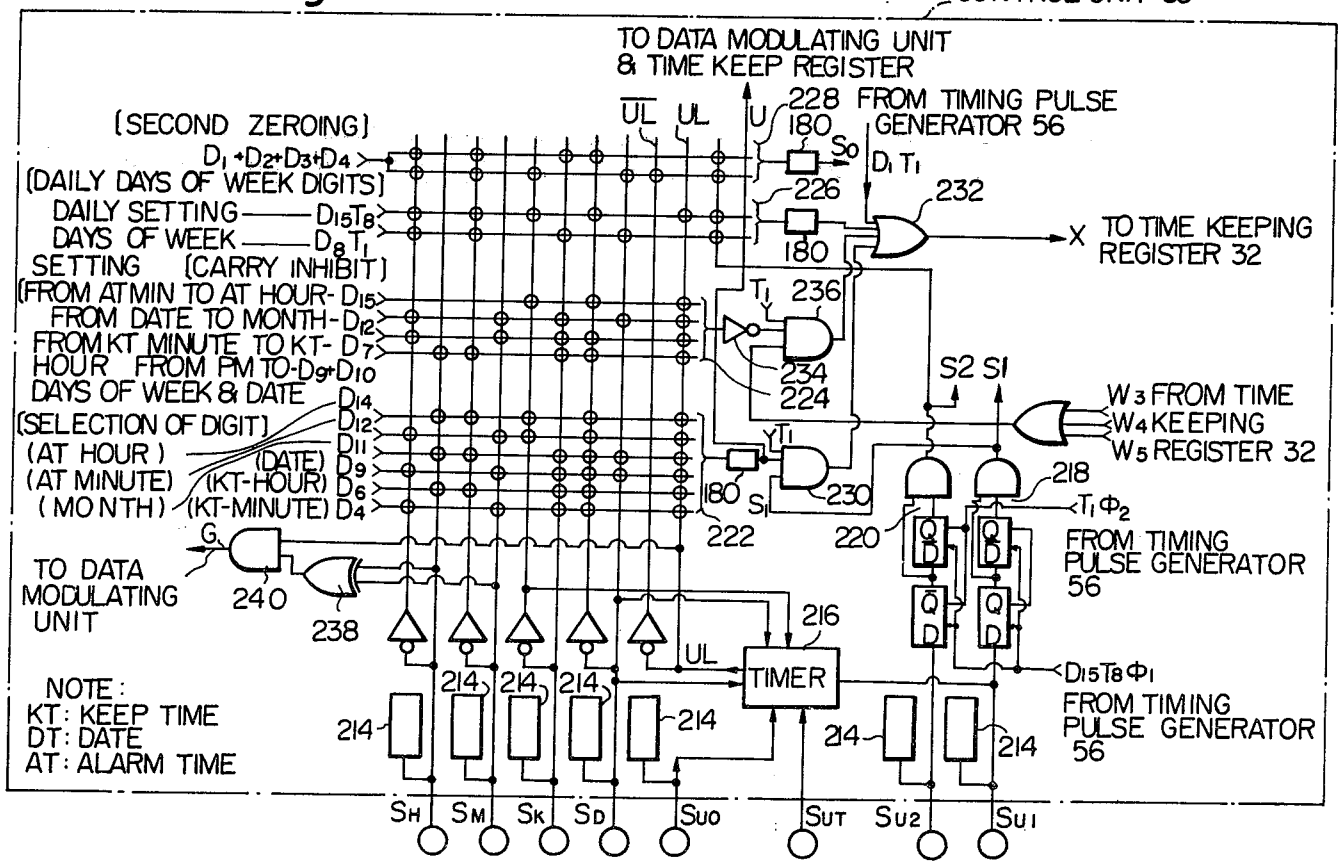
FIG. 12 shows details of electric circuitry for the control unit shown in FIGS. 4A, 4B and 4C.

FIG. 12 shows a preferred example of circuitry for the control unit 30. This unit is connected to a number of switch input terminals SH, SM, SK, SD, SUO, SUT, $SU_1$ and $SU_2$ and is actuated by input signals coming from these terminals to produce various control signals which are applied to the timekeeping register 32 and the data modulating unit 36. SUO and SUT represent input terminals of electrical unlocking switches, which enable setting of new time data into the timepiece, and $SU_1$ and $SU_2$ represent data input terminals for delivering the data inputs $S_1$ and $S_2$, respectively. The input terminals SH, SM, SK and SK are utilized to control the storage locations to which input data is transferred. Each of these input terminals is connected to a logic level setting circuit 214, which maintains the input terminals normally at a logic level "L". When input terminal SH is a "H" level, data from input SI is read into data words with a maximum count of 12. When SM="H", the data from input SI is directed to data words with maximum counts of 60, 28, 29, 30 or 31. When SD="H", data from input SI is directed to the date, month and days of week data words.

Table II shows an example of the relationship between the signals from the switches SM, SH, SK and SD, and the resultant unlocking of various data storage locations and flashing of various parts of the displayed data. The table is followed by an explanatory list of the abbreviations used. For example, referring to the "time setting mode", it can be seen that a combination of SH and SK high state signals, after unlocking signal UL has been generated, will cause flashing of the display of current time hours and updating of this data, i.e., new hours data is set into the timepiece.

TABLE II

| | | SETTING MODE | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|
| | | NORMAL OPERATING MODE | | | | | | | | | | | | | | | | TIME SETTING MODE | | | | | | | | | | | | | | | |
| | SWITCH | SO | DATE DISPLAY (NO MONTH) | | | | | | | NORM | | | | DATE DISPLAY (WITH MONTH) | | | | SO | DATE DISPLAY (NO MONTH) | | | MK/AT | M/AT | H/AT | INH | SO | M/KT | H/KT | INH | DAY | DATE | MONT | INH |
| SW. | SM | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 |
| SETTINGS | SH | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 |
| IN | SK | 0 | 0 | 0 | 0 | 1 | 1 | 1 | 1 | 0 | 0 | 0 | 0 | 1 | 1 | 1 | 1 | 0 | 0 | 0 | 0 | 0 | 0 | 0 | 0 | 1 | 1 | 1 | 1 | 1 | 1 | 1 | 1 |
| | SD | 1 | 1 | 1 | 1 | 0 | 0 | 0 | 0 | 0 | 0 | 0 | 0 | 1 | 1 | 1 | 1 | 1 | 1 | 1 | 1 | 0 | 0 | 0 | 0 | 0 | 0 | 0 | 0 | 1 | 1 | 1 | 1 |
| | UL | 0 | 0 | 0 | 0 | 0 | 0 | 0 | 0 | 0 | 0 | 0 | 0 | 0 | 0 | 0 | 0 | 1 | 1 | 1 | 1 | 1 | 1 | 1 | 1 | 1 | 1 | 1 | 1 | 1 | 1 | 1 | 1 |
| | $SU_1$ | * | * | * | * | * | * | * | * | * | * | * | * | * | * | * | * | * | * | * | * | * | 1 | 1 | * | * | 1 | 1 | * | * | 1 | 1 | * |
| | $SU_2$ | 1 | * | * | * | * | * | * | * | * | * | * | * | * | * | * | * | 1 | * | * | * | 1 | * | * | * | 1 | * | * | * | 1 | * | * | * |
| EFFECT OF SWITCH SETTINGS | $2^{-8}$ $2^{-4}$ & 1′ | | | | | | | | | | | | | | | | | | | | | | | | | | | | | | | | |
| | SEC. | "O" | | | | | | | | | | | | | | | | "O" | | | | | | | "O" | | | | | | | | |
| | "10" | | | | | | | | | | | | | | | | | | | | | | | | "O" fl | | | | | | | | |
| ON DATA | SEC. | fl | | | | | | | | fl | | | | fl | | | | fl | | | | fl | | | fl | | | | | | | | |
| | MIN. | | | | | | | | | | | | | | | | | | | | | | | | | U fl | | | | | | | |
| | H. | | | | | | | | | | | | | | | | | | | | | | | | | | U fl | | | | | | |
| | DAY | | | | | | | | | | | | | | | | | | | | | | | | | | | | U fl | | | | |
| | DATE | | | | | | | | | | | | | | | | | | | | | | | | | | | | | U fl | | | |
| | MONT. | | | | | | | | | | | | | | | | | | | | | | | | | | | | | | U fl | | |
| | MIN/AT | | | | | | | | | | | | | | | | | | | | | | | U | | | | | | | | | |
| | H/AT | | | | | | | | | | | | | | | | | | | | | | | | U | | | | | | | | |
| MARK | AM/PM | | | | | | | | | | | | | | | | | | | | | | | | | | | | | | | | |

TABLE II-continued

| | NORMAL OPERATING MODE | | | SETTING MODE | | | | | | TIME SETTING MODE | | | | | | | |
|---|---|---|---|---|---|---|---|---|---|---|---|---|---|---|---|---|---|
| SWITCH | SO | DATE DISPLAY (NO MONTH) | NORM | DATE DISPLAY (WITH MONTH) | SO | DATE DISPLAY (NO MONTH) | MK/ AT | M/ AT | H/ AT | INH | SO | M/ KT | H/ KT | INH | DAY | DATE | MONT | INH |
| DD | | | CI | | | | | | | | | | | CI | | | | |
| ALX | | | | | | | U | | | | | | | | | | | |
| MDLY | | | | | | | U | | | | | | | | | | | |
| | | | | | | | U | | | | | | | | | | | |

Figure 15:
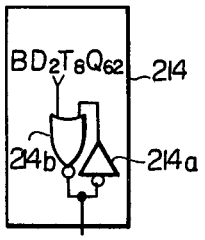
FIG. 15 shows an example of the logic level setting circuit shown in FIG. 12.

REMARKS
NORM:Normal current time display
*:Either 1 or 0 (don't care case)
So:Seconds zero setting
Sw:Switch
UL:Data location is unlocked.
CI:Carry out inhibited
IN:Signal generated within control unit due to switch signals.
U:Updating
fl:flashing
SEC.:Seconds
MIN.:Minutes
H.:Hours
DAY:Days of the week
DATE:Date of the month
MONT.:Month
M/AT:Minutes of the alarm time
H/AT:Hours of the alarm time
MK/AT:Alarm time daily/temporary symbols
INH:Input inhibited
ALX:Connecting mark (for minutes/hours of a data alarm time)
DD:Date mark (for date data of a date alarm time)
"O":The counter is reset to zero, then continues counting from zero.
1:High logic level
0:Low logic level
AM/PM:AM/PM condition indicating bit As already noted, each of the input terminals SH, SM, SK, SD, SUO, $SU_1$ and $SU_2$ is connected to a logic level setting circuit 214. This sets the terminal to a low logic level spontaneously when the corresponding switch is released. As shown in FIG. 15, the logical level setting circuit 214 comprises an inverter 214*a* and a NOR gate 214*b* connected in a DC positive feedback loop. The input of inverter 214*a* is connected to the output of NOR gate 214*b* and also to a switch input terminal, while one input of NOR gate 214*b* is connected to the output of inverter 214*a* and the other to a timing pulse $B \cdot D_2 \cdot T_8 \cdot Q62$. It is apparent that if a logic "H" signal is applied to the NOR gate iput, its output will remain latched in the "L" state, and conversely, if a "H" level is applied to the NOR gate output through low impedance, the output will be forced to be set in the "H" state. And in this state, since CMOS circuit elements are used, the output impedance presented by the NOR gate will be high. In this example, a $B \cdot D_2 \cdot T_8$ pulse having a width of 64 μsec. is applied to the terminal every 1/16 second, setting the NOR gate output to the low logic level. The low level output impedance is about 100 kohms for CMOS elements. When the switch connected to the input terminal is depressed, the terminal is set to the high level. In this condition, the output of the NOR gate goes to the low impedance state every time the pulse $B \cdot D_2 \cdot T_8$ goes high. But due to the low duty cycle of this pulse, the current drain is extremely small, since the effective impedance presented by the terminal will be of the order 100k $\Omega \times 1/16 \times 10^6/64 \approx 100M\Omega$, when the corresponding switch is depressed. And the impedance to ground when the switch is released is sufficiently low, about 100 kohms, to greatly reduce interference pickup.

The switch input terminals SK, SD, SUO, SUT and $SU_1$ are connected to a timer 216. When a data unlocking command signal is applied to the timer 26 from the input terminals, the timer produces an unlocking signal UL. When UL is in the "H" logic state, this releases an inhibit applied to a group of matrix gate circuits, permitting data to be written into selected data words. The input terminals $SU_1$ and $SU_2$ are connected to differentiating circuits 218 and 220, respectively, which differentiate the data input signals applied to the switch input terminals $SU_1$ and $SU_2$ and generate the corresponding differentiated signals $S_1$ and $S_2$ respectively, in dependence on the number of operations of the switches. The leading edges of signals $S_1$ and $S_2$ are coincident with the leading edge of word pulse $D_1$, and each has a pulse width equal to the repetition period of word pulse $D_1$.

The input signals from terminals SH, SM, SK and SD and the unlocking signal UL from timer 216 are applied to matrix gate circuits 222, 224, 226 and 228. Matrix gate circuit 222 serves to select the data words to be updated, in response to the word pulses and the signals delivered from the input switch terminals. Thw word pulses $D_4$, $D_6$, $D_9$, $D_{11}$, $D_{12}$ and $D_{14}$ select the minutes and hours data of the current time, date data and month data and minutes and hours of the alarm time, respectively.

The minutes data of the current time is selected when the input supplied to the gate circuit 222 is in a state in which $\overline{SH} \cdot SM\ SK \cdot \overline{SD} \cdot UL =$ "H", generating an output designated U. This output signal is delayed by one word time by a delay bistable 180 and applied to one input of AND gate circuit 230. The differentiated signal $S_1$ is also applied to the AND gate 230, enabling it to output a minutes data setting signal in response to the timing pulse $T_1$, which is supplied to OR gate 232, generating output signal X. The output X is applied to the adding circuit 62 of the timekeeping register 32 to add "1" count to the minutes data.

Similarly, the hours data of the current time is selected when $SH \cdot \overline{SM} \cdot SK \cdot \overline{SD} \cdot UL =$ "H". The date data is selected when $\overline{SH} \cdot SM \cdot SK \cdot \overline{SD} \cdot UL =$ "H". The month data is selected when $SH \cdot \overline{SM} \cdot SK \cdot SD \cdot UL =$ "H". The minutes data of the alarm time is selected when $\overline{SH} \cdot SM \cdot \overline{SK} \cdot \overline{SD} \cdot UL =$ "H". The hours data of the alarm time is selected when $SH \cdot \overline{SM} \cdot \overline{SK} \cdot \overline{SD} \cdot UL =$ "H".

The gate circuit 224 produces a carry inhibit signal when time data is being set into the timepiece, generated by applying various input signals from the input terminals, unlock signal UL and word pulses $D_9$, $D_{10}$, $D_7$, $D_{12}$ and $D_{15}$ to it. The word pulses $D_9$ and $D_{10}$ correspond to the days of week and the date data, respectively. In response to these word pulses, gate circuit 224 produces output signals to inhibit a carry from the days of week data to the date data when the PM symbol is changed to the AM symbol. The word pulse $D_7$ corresponds to the hours data of the current time. In response to this $D_7$ pulse, gate circuit 224 generates an output signal to inhibit a carry to the hours data when the minutes digit of the current time is being set. The word pulse $D_{12}$ corresponds to the month data. In response to the word pulse $D_{12}$, gate circuit 224 generates an output signal to inhibit a carry to the month data when the date being set. The word pulse $D_{15}$ corresponds to the hours data of the alarm time. In response to the word pulse $D_{15}$, the gate circuit 224 produces an output signal to inhibit a carry to the hours data of the alarm time when the minutes data of the alarm time is being set. The carry inhibit signals thus generated are applied to an inverter 234, so that when the output of matrix gate 224 is "H", the AND gate 236 is inhibited. This prevents carry signals being applied to gate 232. Matrix gate circuit 226 generates an output which sets either a daily or temporary alarm time condition, also an output signal which sets the days of the week data. The timing pulse $D_8T_1$ is used to set the days of week, and the timing pulse $D_{15}T_8$ is used to set the alarm condition.

Figure 16:
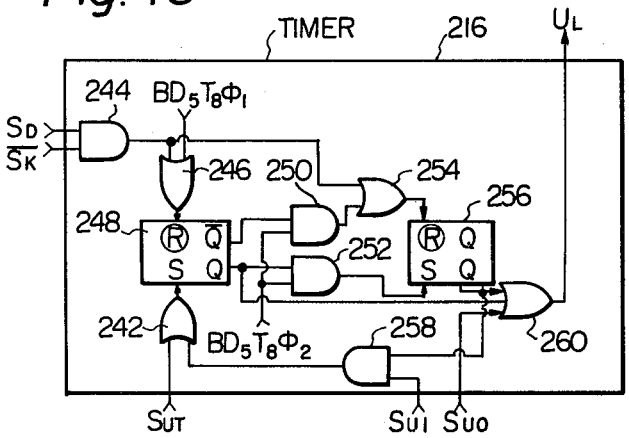
FIG. 16 shows details of a circuit arrangement for the timer used in the control unit of FIG. 12.

If input terminal $SU_2$ goes to "H" level, generating signal $S_2$, when $\overline{SH} \cdot \overline{SM} \cdot SK \cdot SD \cdot UL =$ "H" or $\overline{SH} \cdot \overline{SM} \cdot \overline{SK} \cdot \overline{SD} \cdot UL =$ "H", then the gate circuit 226 generates output signals which set the day or week or the daily/temporary alarm time condition respectively. If input terminal $SU_2$ goes to "H" level when $\overline{SH} \cdot \overline{SM} \cdot \overline{SK} \cdot SD \cdot \overline{UL} =$ "H", or $\overline{SH} \cdot \overline{SM} \cdot SK \cdot \overline{SD} =$ "H", then matrix gate 228 generates a signal which is delayed to become SO. This signal is applied to the input of gate 66 of timekeeping register 32, to perform the seconds zeroing function. FIG. 16 shows an example of circuitry for timer 216 utilized in control unit 30 of FIG. 12. This timer unit is arranged to be activated when input terminal SUT goes to the "H" level. The output of OR gate 242 is applied to the set input of first stage bistable 248, which is reset by one-minute signal $B \cdot D_5T_8\Phi_1$ or by input signal combination $SD \cdot \overline{SK}$. A second stage bistable 256 is set to "H" level after less than one-minute, when output Q of the first stage bistable 248 goes to "H". Output Q of 248, output Q of 256 and signal SUO are applied to OR gate 260, which generates output signal UL, enabling data to be set into the control unit by signals $S_1$ and $S_2$. The Q output of second stage bistable 256 and signal $SU_1$ are applied to AND gate 258, generating an output signal which again sets bistable 248. Thus, as long as pulses $SU_1$ are applied, if frequency of these pulses is less than 1/60 Hz, output signal UL is continuously generated. The timer must, however be initially activated by input SUT. Timer 216 is especially advantageous when data is input by a push button type switch. If the level of the terminal $SU_1$ is alternately changed between "L" and "H" levels, after the input terminal SUT has been changed to a high level "H" and then to a low level "L", setting in of data to the timepiece may be readily performed simply by combined modes of operation of push buttons.

Figure 17:
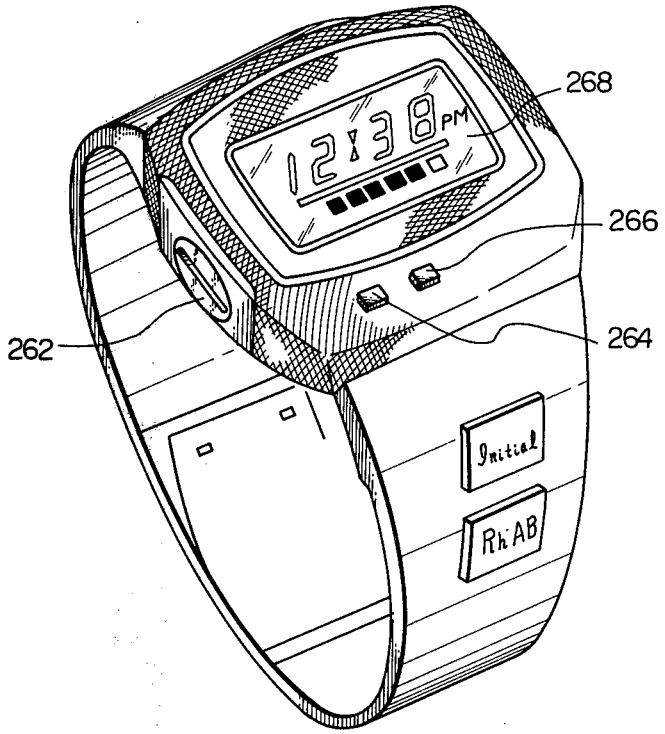
FIG. 17 is a schematic view of an example of a wristwatch embodying the present invention.
Figure 18:
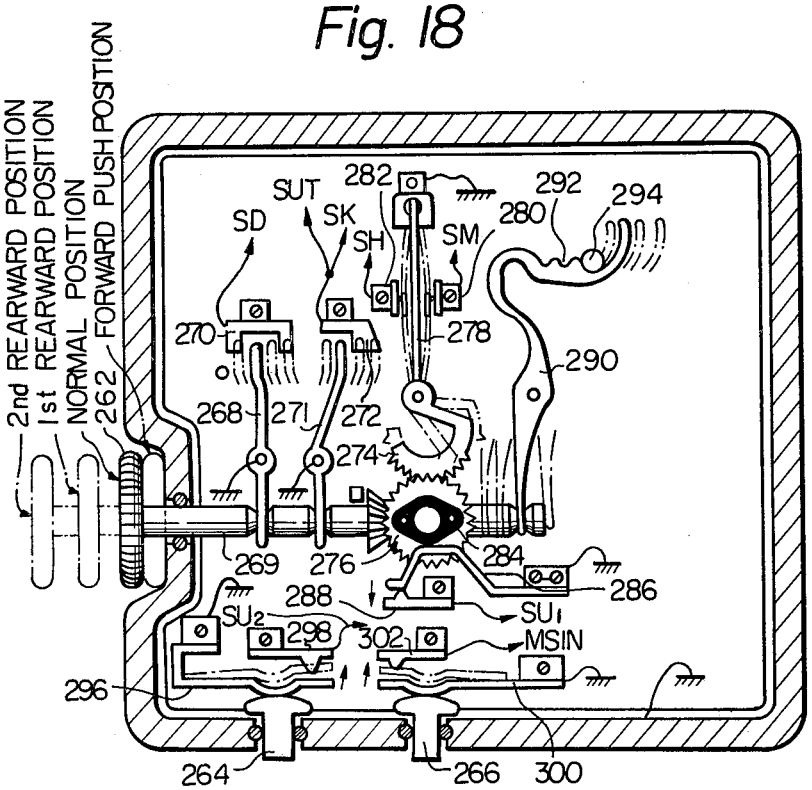
FIG. 18 is a cross section illustrating the relationship between the position of the crown and associated parts.
Figure 19:
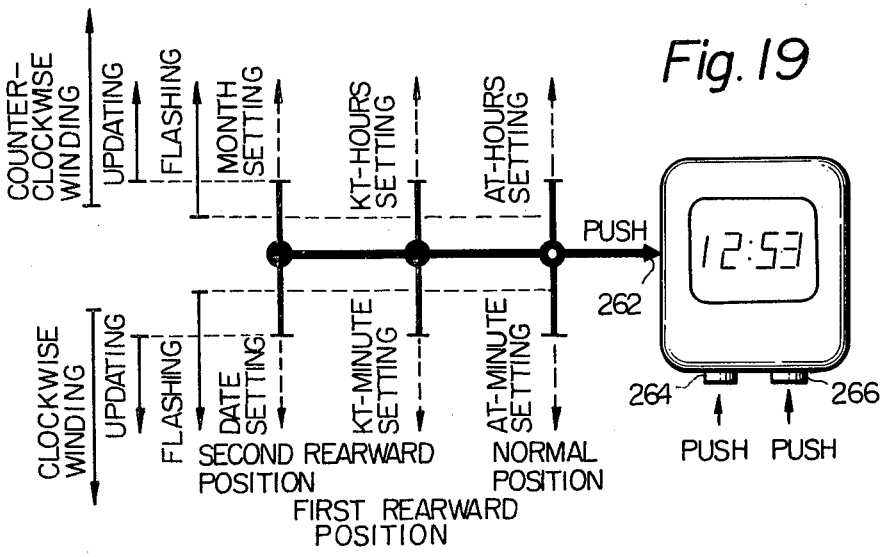
FIG. 19 is a view showing the operating mode of the crown and switches shown in FIG. 18.

FIG. 17 shows an example of a perspective view of an electronic timepiece embodying the present invention. FIG. 18 shows a switching mechanism which may be utilized in the electronic timepiece shown in FIG. 17. FIG. 19 is a diagram showing the operating modes of the crown shown in FIG. 17.

As shown in FIG. 17, the crown 262 is arranged to be movable in two stages in a rearward direction and in one stage in a forward direction. The crown 262 is also rotatable in either direction at each stage. The electronic timepiece also has a display symbol setting switch 264 and a manual shift switch 266 for setting multi-alarm times. The switch 266 may also be used for lighting a lamp. Indicated as 268 is a display face on which the time data is displayed. The hours and minutes, for example, 12:38, are displayed on the display face 268 together with the AM/PM symbol. This occurs when none of the switches 262, 264 and 266 is depressed. When switch 262 is depressed, the date and days of week are displayed. The display is not changed if switches 264 and 266 are depressed either separately or together and the current time stored in the timepiece is not affected. If, however, the switch 264 is depressed, while the crown 262 is either depressed to its forward position or set to its 1st rearward position, the seconds data is set to zero.

In FIG. 18, if the crown 262 assumes either the forward position or the 2nd rearward position, the input terminal SD for setting the date day and month is grounded and thereby goes to "H" level, since lever 268 operated by shaft 269 connected to the crown 262 engages contact 270. If the crown 262 assumes either the 1st or 2nd rearward position, lever 271 engages contact 272, which is consequently grounded. In this situation, input terminals SK and SUT for the keeping time information are grounded and go to "H" level. If the crown 262 is rotated clockwise, a sector gear 274 is also rotated clockwise through a predetermined angle by means of a gear 276. Thereafter, the sector gear 274 rotates freely and pushes a spring 278 against a contact 280, causing the input terminal SM to go to "H" level. If, on the other hand, crown 262 is rotated counter-clockwise, sector gear 274 is rotated counter-clockwise so that spring 278 engages with contact 282 causing terminal SH to go to "H" level. The gear 276 turns about a fixed axis, rotated by shaft 269. A cam 284 is secured to the gear 276. A lever 286 is normally pushed against cam 284. If cam 284 is rotated more than 180°, lever 286 is moved toward and away from contact 288 so that input terminal $SU_1$ is grounded and goes to "H" level intermittently. Since lever 286 is pushed against the cam 284 by its spring force, it is maintained in a stable position spaced from the axis of the cam 284 by a minumum distance when the crown 262 in its normal position. The spring 278 directly coupled to sector gear 274 does not engage either of the contacts 280 and 282 when the crown 262 is in its normal position, but if the crown is rotated even only slightly, spring 278 engages either one of the contacts 280 and 282. Even when the crown 262 is rotated beyond a large enough angle for the sector gear 274 to disengage from gear 276, spring 278 is still held against one of the contacts. One end of a lever 290 is linked to shaft 269 and pushes shaft 269 in an axial direction. The lever 290 is provided at its upper end with notches 292 adapted to engage a stationary pin 294. If the finger of the wearer is released from the crown 262 when it is held in the forward position, it is returned to its normal position by the action of the lever 290. When the crown 262 is pulled rearward from the normal position, it remains in that extended position. When lever 296 of switch 264 is depressed, it engages a contact 298 so that the input terminal $SU_2$ goes to the high level. Likewise, the input terminal MSIN goes to the high level when lever 300 is caused to engage with contact 302.

FIG. 19 shows an example of operating modes of the crown and switches shown in FIG. 18. As already stated hereinabove, if the crown 262 is pushed to the forward position a date is displayed. If, in contrast, crown 262 is pulled to its 1st rearward position, the input terminal SK goes to the high level, and the input terminal SD remains at a low level "L". Since the input unlock signal terminal SUT is connected to contact 272, it is possible to set the current time while the crown is pulled into its 1st rearward position.

If the crown 262 is rotated counter-clockwise, i.e., upward as viewed in FIG. 19, the display of the hours data begins flashing. As the crown is further rotated, the hours data is incremented i.e. now data is set in. If, on the contrary, the crown 262 is rotated clockwise, i.e., downward as viewed in FIG. 19, the display of the minutes data begins to flash. As the crown 262 is further rotated in the same direction, new minutes data is set in. Since the data being set is caused to flash on the display face before the data is incremented, there is no danger of erroneous setting. When the switch 264 is depressed without rotating the crown 262 while switch 264 is depressed, zero setting of the seconds digit is performed. If a seconds count of between 0–29 is displayed when zero setting of the seconds is performed, the seconds data is set to zero. If a second count of between 30–59 is displayed during zero setting, the seconds data is set to zero, and a carry signal is generated which increments the minute data by one. There are two modes of setting the seconds data to zero, the first being to depress the crown 262 and switch 264 at the same time and the second mode being to depress the switch 264 while crown 262 is set in its first rearward position. Accordingly, it is possible to perform this setting operation according to the needs or wearer's preferences. After completion of the time setting, if the crown is fully depressed to the forward position, whereby the date is displayed, and simultaneously an electric lock signal is applied so that accidental touching of the switches does not affect the stored time data. If the wearer fails to fully depressed the crown after completion of the time setting, a timer operates to automatically apply the electric lock after a predetermined interval, for example, two minutes as shown in FIG. 16.

If the crown is pulled to its 2nd rearward position and rotated counter-clockwise, the setting of the month data is possible whereas when the crown is rotated clockwise, the setting of the date data is possible. In this condition, if switch 264 is depressed without rotating crown 262, the days of week can be set. If the crown 262 is pulled to its 2nd rearward position, in which the setting of the month digit and the date digit is possible, the display elements for the days of the week are caused to flash. If, in this condition, crown 262 is rotated, the flashing of the display elements of the days of week is stopped, and the display elements of the data being set begin to flash, depending upon the direction of rotation of the crown. A clear indication is thus given of which data is being set.

When the crown 262 is pulled to its 1st rearward position, the setting system for the current time data is unlocked. When the crown is then returned moderately to its normal position, input terminal SUT goes to the "L" level, thus maintaining the unlocked condition. Accordingly, the alarm time data is displayed, and it is possible to set in a new alarm time. Under these conditions, if crown 262 is rotated counter-clockwise, the hours digit of the alarm time can be set, whereas clockwise rotation of the crown permit the setting of the minutes digit of the alarm time, and if the switch 264 is depressed without rotating the crown, it is possible to set the alarm time to either a daily or temporary mode. When a multi-alarm facility option system is incorporated, switch 266 is used to display the stored alarm times by stepping frm one to another each time it is depressed. Thus it is possible to check what alarm times, if any, are set. Each time the switch 266 is depressed, a different stored alarm time is read out and displayed. If the crown 262 is rotated, setting of the particular alarm time data being displayed becomes possible. If the switch 266 is kept depressed for a time interval of more than 1.5 seconds, then the stored alarm times start to be automatically sequentially read out at a rate of one per second. This alarm data sweeping operation ceases when the switch 266 is released. In addition, the design is such that, when the wearer wishes to set in a new alarm time and a multi-alarm facility is incorporated, an automatic search is performed to find a data location storing an alarm time of zero, i.e. a vacant location. This search operation takes place when the switches are set to display alarm time data from normal mode display. If such a vacant location is found, then a display of zero hour will appear, but if all locations contain alarm time data then the last alarm time set in will be displayed. The automatic search takes a time of 0.5 seconds maximum.

In the timepiece system of this invention, the display face is switched between three different data displays, that is current time, alarm time and data. A further display state is of alarm time zero. This is shown as a zero digit followed by a colon mark, with a blank space in place of minutes digits. The decoder for the display driver circuit is constructed to identify states of a word of 4 bits, and to erase or modify the display mode by modulating the data to be displayed depending upon the content of the data itself. These functions can be accomplished by the data modulating unit shown in FIGS. 20A and 20B.

At first the display system itself will be discussed. There are many methods of displaying the time data on a timepiece. Time display is just as important as timekeeping. Since there are many types of display, it is necessary to have a choice of display drive circuit to suit the type of display.

According to this invention, the data to be displayed is selected, then transmitted to the display unit. In addition, the display data is chopped into data bursts, before tramsmission.

Figure 20A:
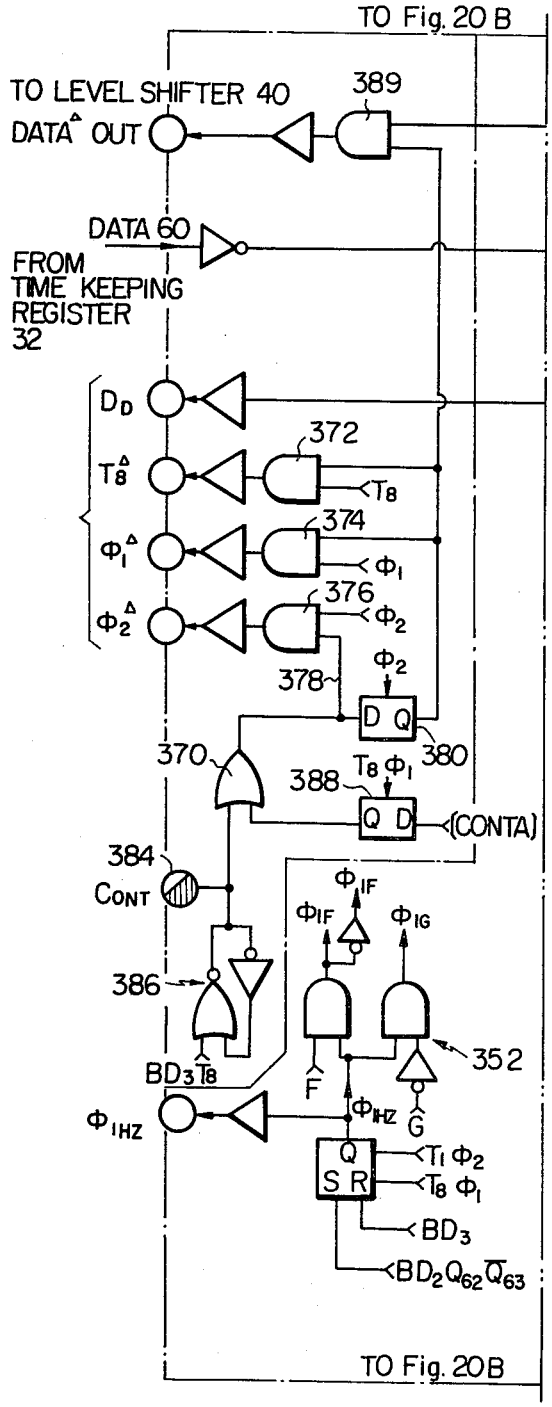
FIGS. 20A and 20B show details of an example of circuitry for the data modulating unit shown in FIGS. 4A, 4B and 4C.
Figure 20B:
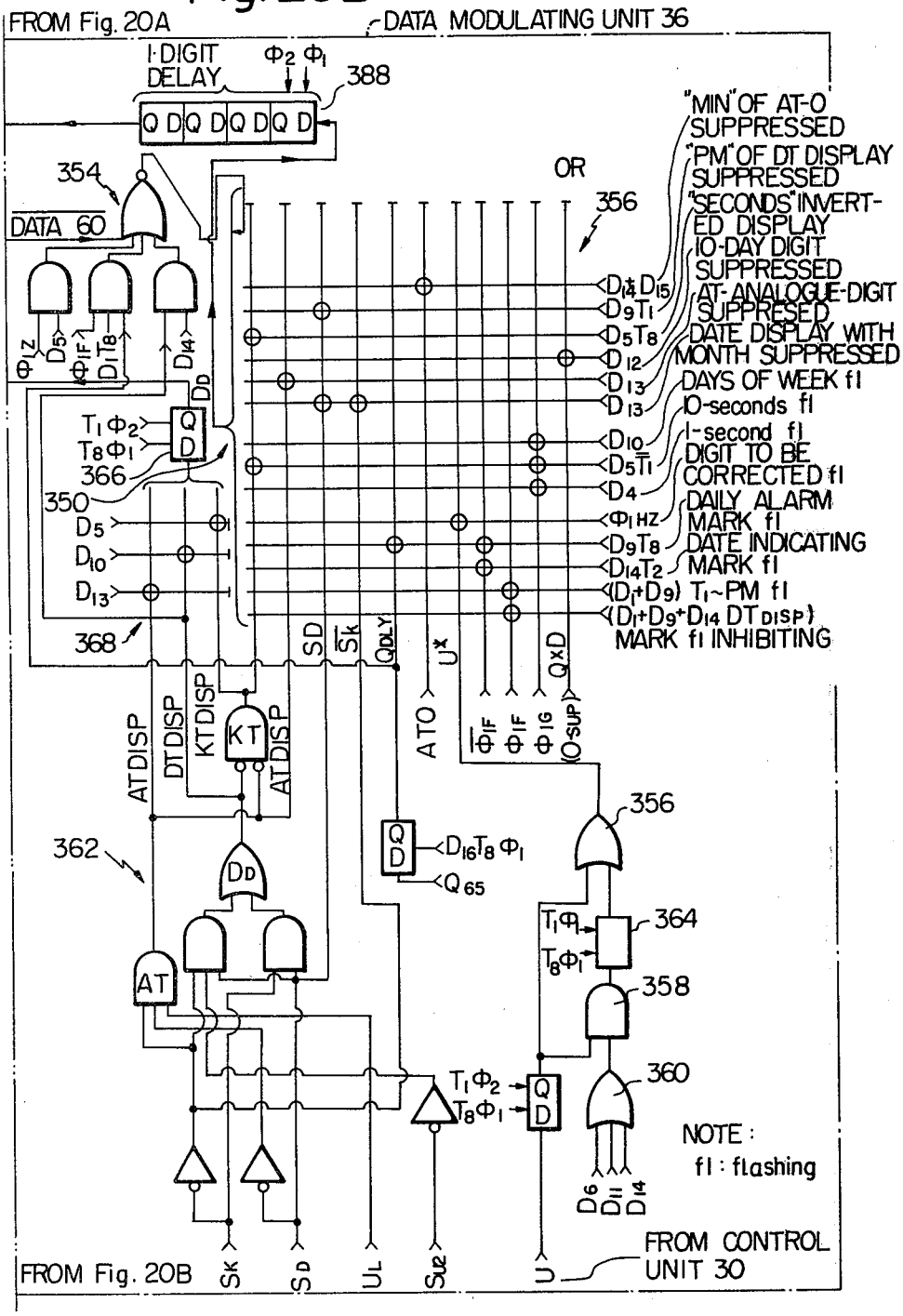

More particularly, as shown in FIGS. 20A and 20B, the data to be displayed is selected from signal DATA 60, is modulated in matrix gate 356, then sent out in periodic bursts at DATAΔOUT by a chopping circuit 352. The data modulator 350 is shown as comprising an OR/AND gate circuit 354 and a matrix gate circuit 356. Both circuits may of course be constructed using ordinary gate elements, or combined into a single matrix gate. However use of the matrix circuit shown is advantageous, because it is easy to understand the configuration, and because an inexpensive and compact ROM type matrix can be obtained when C/MOS integrated circuits are used. It is also possible to incorporate the various gate circuits designated as 356, 358, 360 and 362 into the matrix circuit.

A one bit delay bistable 364 is used to form a signal U*, causing flashing of the both of "units" and "tens" digit data being set in. This is done by increasing the pulse width of a data update indication signal U by the circuit shown in FIG. 20B. The gate circuit 362 is controlled by switches SK, SD, UL and $SU_2$, to select the data to be displayed. Word pulses $D_{13}$, $D_{10}$ and $D_5$ select the alarm time, date and current time, respectively, and the circuit is designed to switch the data to be displayed in accordance with the timing of the display selection pulse $D_D$. The display selection signal is passed through delay bistable 366 to be delayed by one word time and to shape the signal waveform.

Gate circuit 370 generates a 16Hz chopping signal from input CONTA, sent from the control unit 30. This serves to chop the flow of data from shift register 388 into periodic bursts, by AND gate 389. This chopped data is sent to the display driver 16 times per second, where it is decoded and displayed. If terminal CONT is set to a low logic level (this is set at the time of manufacture, normally but can also be under logic control if required), then the data is sent in bursts as described, but if CONT is set to the high logic level, data and clock pulses are transmitted continuously. Gate circuits 372, 374 and 376 produce bursts of timing and clock pulses $T_8$,$\Phi_1$, and $\Phi_2$, which are transmitted in synchronism with the data bursts to the display driver circuits, and to the option unit. The latch circuit 380 ensures correct timing for chopping $\Phi_2$ pulses. The technique of transmitting data in bursts results in a considerable reduction in power required for the driver and option system circuits.

Figure 22A:
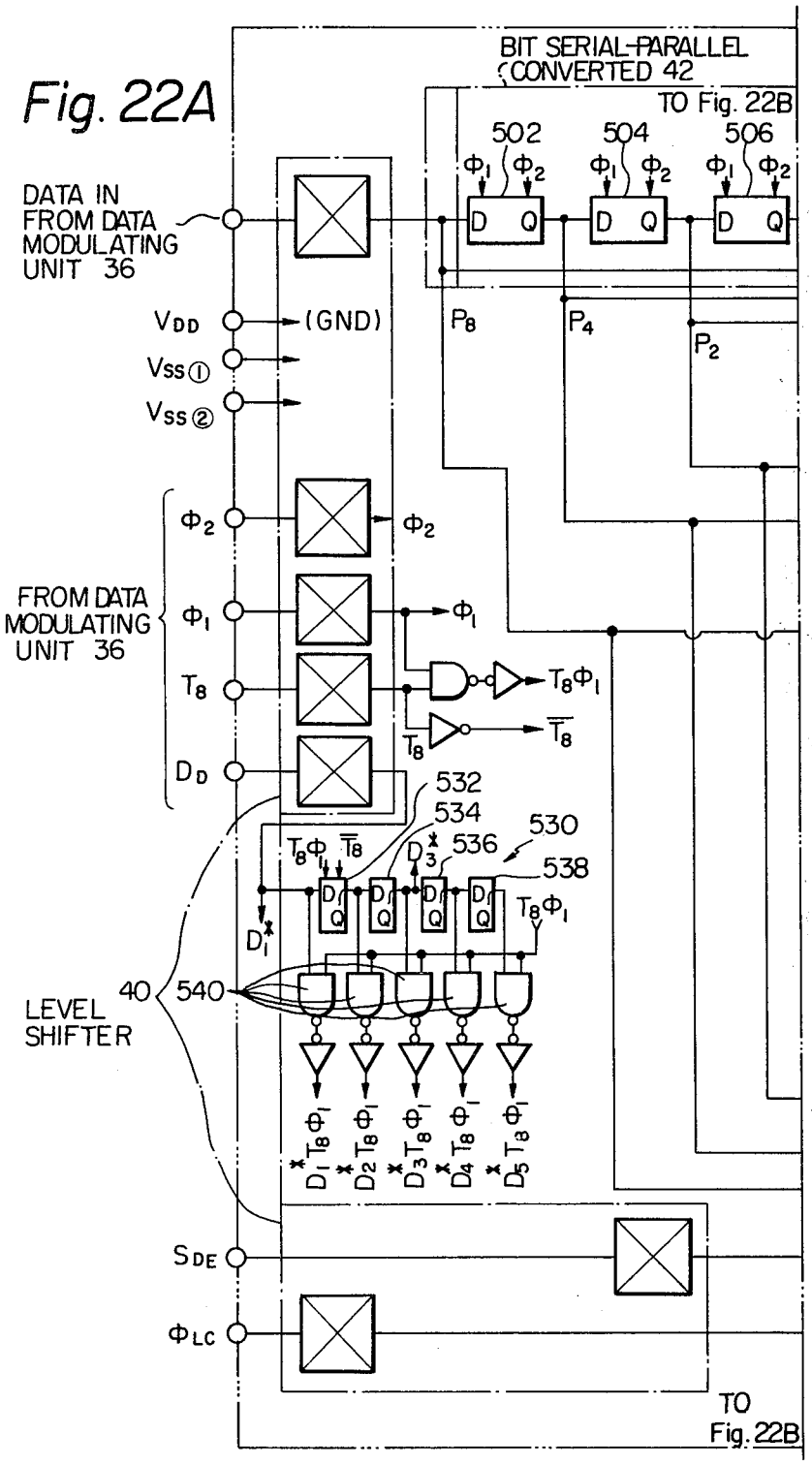
FIGS. 22A, 22B and 22C are detail block diagrams of the display driver and associated parts.
Figure 22B:
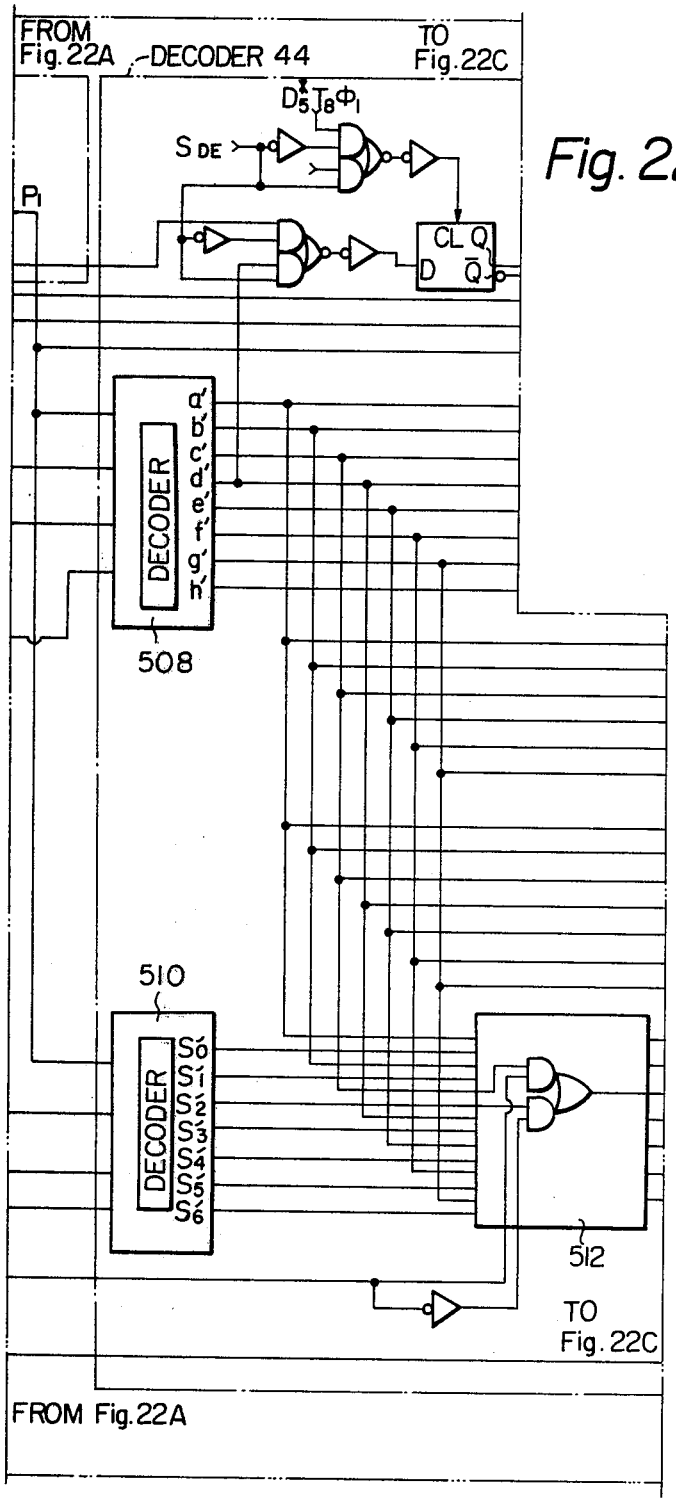
Figure 22C:
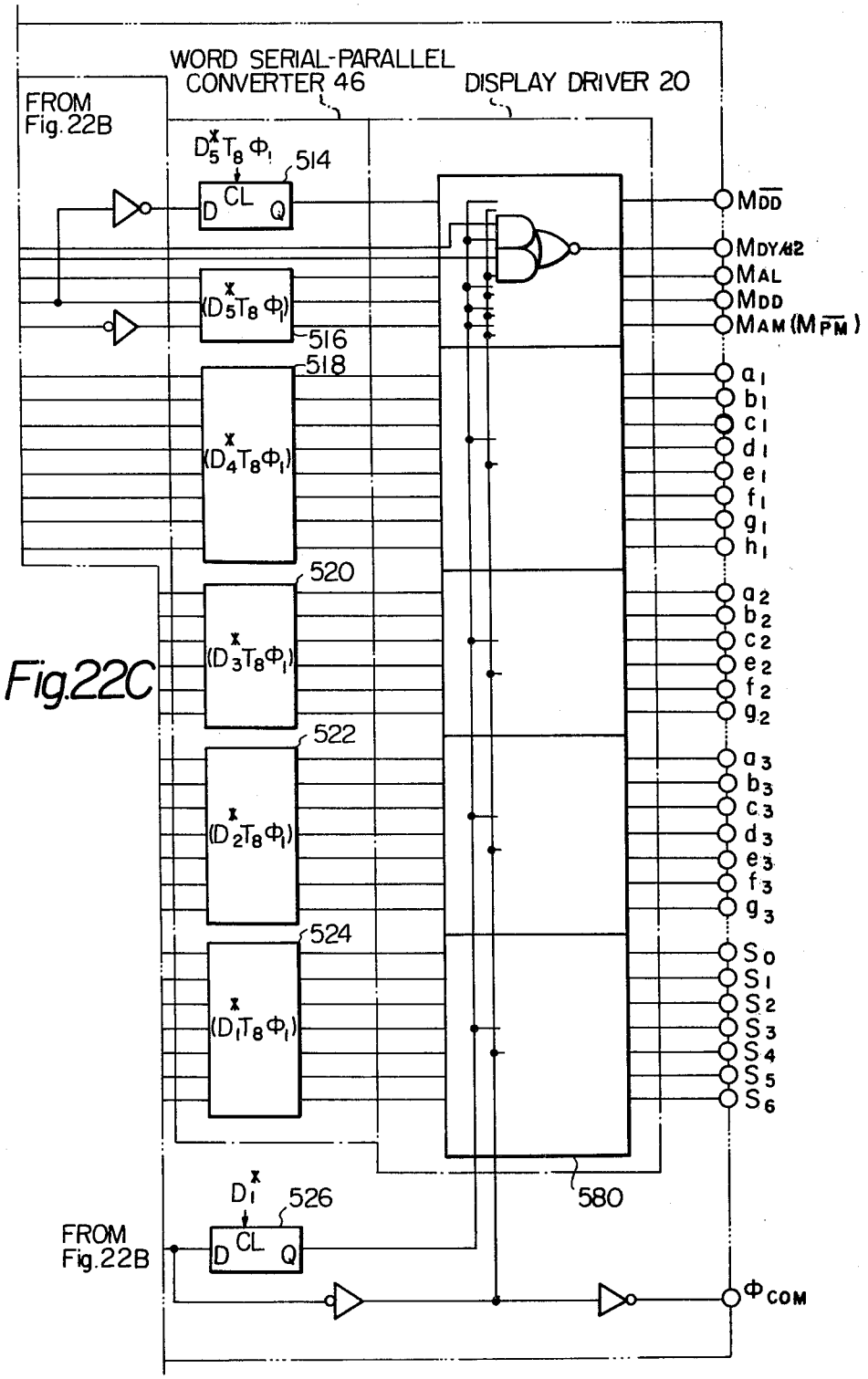

The following Table III is a truth table for the display driver unit, illustrated in FIGS. 22A, 22B and 22C. This table shows the relationship between the sixteen possible combinations of data of 4 bit weights and the corresponding segment display outputs, for both the display digits (showing for example hours and minutes) and the linear type display used in the particular example of the present invention described herein to display days of the week and "tens" of seconds data.

TABLE III

| | Input data bit weights | | | | Display driver outputs (digit display) | | | | | | | | Display driver outputs (linear display) | | | | | | |
|---|---|---|---|---|---|---|---|---|---|---|---|---|---|---|---|---|---|---|---|
| No. | "1" | "2" | "4" | "8" | a' | b' | c' | d' | e' | f' | g' | h' | So' | S1' | S2' | S3' | S4' | S5' | S6' |
| 0 | 0 | 0 | 0 | 0 | 1 | 1 | 1 | 1 | 1 | 1 | 0 | 0 | 1 | 0 | 0 | 0 | 0 | 0 | 0 |

TABLE III-continued

| | Input data bit weights | | | | Display driver outputs (digit display) | | | | | | | | Display driver outputs (linear display) | | | | | | |
|---|---|---|---|---|---|---|---|---|---|---|---|---|---|---|---|---|---|---|---|
| No. | "1" | "2" | "4" | "8" | a' | b' | c' | d' | e' | f' | g' | h' | So' | S1' | S2' | S3' | S4' | S5' | S6' |
| 1 | 1 | 0 | 0 | 0 | 0 | 1 | 1 | 0 | 0 | 0 | 0 | 0 | 0 | 1 | 0 | 0 | 0 | 0 | 0 |
| 2 | 0 | 1 | 0 | 0 | 1 | 1 | 0 | 1 | 1 | 0 | 1 | 0 | 0 | 0 | 1 | 0 | 0 | 0 | 0 |
| 3 | 1 | 1 | 0 | 0 | 1 | 1 | 1 | 1 | 0 | 0 | 1 | 0 | 0 | 0 | 0 | 1 | 0 | 0 | 0 |
| 4 | 0 | 0 | 1 | 0 | 0 | 1 | 1 | 0 | 0 | 1 | 1 | 0 | 0 | 0 | 0 | 0 | 1 | 0 | 0 |
| 5 | 1 | 0 | 1 | 0 | 1 | 0 | 1 | 1 | 0 | 1 | 1 | 0 | 0 | 0 | 0 | 0 | 0 | 1 | 0 |
| 6 | 0 | 1 | 1 | 0 | 1 | 0 | 1 | 1 | 1 | 1 | 1 | 0 | 0 | 0 | 0 | 0 | 0 | 0 | 1 |
| 7 | 1 | 1 | 1 | 0 | 1 | 1 | 1 | 0 | 0 | 0 | 0 | 0 | 1 | 0 | 0 | 0 | 0 | 0 | 0 |
| 8 | 0 | 0 | 0 | 1 | 1 | 1 | 1 | 1 | 1 | 1 | 1 | 0 | 0 | 1 | 1 | 1 | 1 | 1 | 0 |
| 9 | 1 | 0 | 0 | 1 | 1 | 1 | 1 | 1 | 0 | 1 | 1 | 0 | 1 | 0 | 1 | 1 | 1 | 1 | 0 |
| 10 | 0 | 1 | 0 | 1 | 1 | 1 | 1 | 1 | 1 | 1 | 0 | 1 | 1 | 1 | 0 | 1 | 1 | 1 | 0 |
| 11 | 1 | 1 | 0 | 1 | 0 | 1 | 1 | 0 | 0 | 0 | 0 | 1 | 1 | 1 | 1 | 0 | 1 | 1 | 0 |
| 12 | 0 | 0 | 1 | 1 | 1 | 1 | 0 | 1 | 1 | 0 | 1 | 1 | 1 | 1 | 1 | 1 | 0 | 1 | 0 |
| 13 | 1 | 0 | 1 | 1 | 0 | 0 | 0 | 0 | 1 | 1 | 0 | 0 | 1 | 1 | 1 | 1 | 1 | 0 | 0 |
| 14 | 0 | 1 | 1 | 1 | 0 | 0 | 0 | 0 | 0 | 0 | 0 | 0 | 1 | 1 | 1 | 1 | 1 | 1 | 0 |
| 15 | 1 | 1 | 1 | 1 | 0 | 0 | 0 | 0 | 0 | 0 | 0 | 0 | 0 | 0 | 0 | 0 | 0 | 0 | 0 |

NOTE:

For the display segment outputs, "1" indicates the corresponding segment is made visible. "0" indicates the corresponding segment is blanked out. For the serial-parallel converter outputs, "1" indicates a high level output, "0" a low level. For the display outputs, "1" indicates the corresponding display segment is made visible, "0" indicates it is blanked out.

Figure 23:
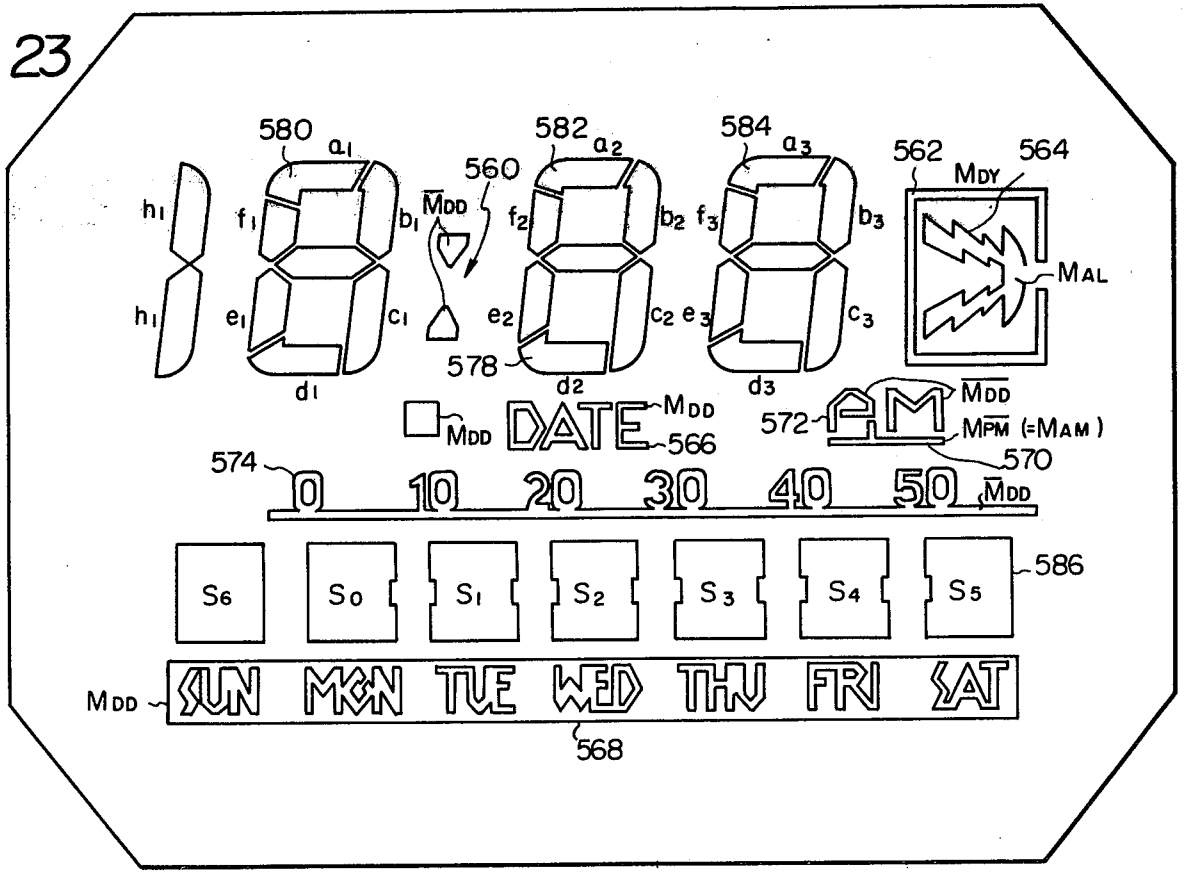
FIG. 23 is a schematic view illustrating an example of the display face.

The term "data modulation" used herein is a general term for various techniques whereby the nature of the data being displayed (and of the alarm time data being stored) is indicated on the display face of the timepiece. These techniques include:

(1) Inversion of a liner type of display (See FIG. 23). This means that, for example, whereas for the display of "tens" of seconds the segment indicating the current count is made to flash on and off, while all other segments of the seconds display are held in the on-state, in the case of these same display segments being used to display the days of week data the relevant segment is also made to flash but all other segments are held in the off-state. Thus there is a definite distinction between the display of seconds data and days of the week data, although the same display elements are used.

(2) Under certain conditions, a part of the displayed data may be made to flash on and off at a periodic rate. For example, while, say, the hours and minutes data of current time is being set, i.e. updated by the wearer, the hours and minutes data on the display face flashes. Thus the wearer can be certain that he is not accidentally altering some other data in the timepiece.

(3) The nature of the data being displayed, in the case of digital data, may be indicated by, for example, a symbol adjacent to the displayed data. In the embodiment described herein, a stroke is displayed between the months and days of month digits, whereas a colon is displayed between the hours and minutes digits. Thus discrimination may be made between the two types of data although the same display elements are used to display them.

(4) A mark or symbol may be used to indicate some continuous internal condition of the timepiece. For example in the embodiment described here, one kind of alarm symbol is kept on continuously so long as an alarm time is stored in the timepiece, and another symbol is kept on if the alarm time is of the "daily" type.

(5) The displayed data may be modified by an additional symbol, for example the display of hours and minutes is modified by the AM/PM symbol.

(6) Although not shown in the present embodiment, where a liquid crystal display is used additional data may be read out by an additional display layer situated behind the layer of liquid crystal display elements. Information marked on each element of this "background" layer will be revealed when the display element situated above it is switched from opaque to transparent. Thus, for example, when the display element corresponding to weekday Tuesday is switched on, the information "TUES" could be revealed.

The display of data is controlled by:

(1) Switching operations (switching on and off of the data on the display face)

(2) The content of the data to be displayed (for example, erasure of the minutes data when alarm time zero is displayed)

(3) Externally input data (for example, control by inputs such as DIN from the option unit)

Although in this specification the data modulating unit is connected to a serial shift register, it should be understood that the invention is also applicable to data storage systems other than a serial shift register, for example, a parallel system utilizing static type bistable circuits such as shown in FIG. 13.

Turning back to FIGS. 20A and 20B, the information printed at the right of the matrix gate 356 describes the selection functions of the crosspoints on the rows of the matrix. The DATA 60 output from the shift register ring is delayed 4-bit more than output from stage $Q_1$ of the shift register ring. The timing of data output from $Q_1$ is used as the reference timing for the timepiece data. The suffixes of the word pulse signals applied to the matrix 356 are therefore larger by one than the suffixes applied to the corresponding word pulses utilized for carry detecter 72, so as to match data 60 and $Q_1$ data. The output from the gate circuit 354 is combined with the output of matrix gate 356 so as to modulate the data displayed. A signal $\Phi$1Hz is formed by a latch circuit, shown in FIG. 20A, and converted by gate circuits 352 into two signals $\Phi_{1F}$ and $\Phi_{1G}$. F actuates display flashing of the entire display when alarm coincidence occurs, and G represents a flashing inhibiting signal sent from the control unit in FIG. 8A. The word pulses $D_{14}$ and $D_{15}$ or OR'd and applied to matrix gate 356 so as to erase display of the minutes data of alarm time data if the alarm time hours data has been set to zero. This permits a clear indication that no alarm time has been set in.

Timing pulse $D_9T_1$ is applied to the matrix to suppress the AM/PM symbol when date data is displayed. (The AM/PM data bits is output from $Q_1$ of shift register 58 at time $D_8T_1$.)

The function of the input $D_5T_8$, designated "SECONDS" inverted display is as follows. Looking at Chart III, it can be seen that adding a bit of weight 8 to the output counts 0 to 7 of the serial-parallel converter will result in the display sequence shown in the lower half of the "linear display" outputs. This is a display sequence where the segment corresponding to the data count is held "OFF", and the other segments (apart from that connected to $S_6$) are held "ON". As explained previously, this is the opposite display mode to the days of week data, which corresponds to the top half of the right hand portion of Table III. Thus a distinction is made between the days of week data display and the seconds data display, although the same display elements are used.

The "tens" display digit of the date days is suppressed by word pulse $D_{12}$ applied to matrix gate 356, whenever this "tens" digit is a zero. The suppression of this digit when it is zero is normally considered desirable in a wristwatch.

For the timepiece display of this invention, it is advantageous to display the months data only when it is specifically required. This is because, since the same display elements are used for months data and hours data display, greater clarity is given to the date display if the months digits are suppressed. Thus, normally when the wearer operates the external switches to obtain a date display, only the day of the month (in place of the minutes digits) and the day of the week (on the linear display, in place of "tens of seconds") will appear. However, if the wearer operates the switches to the "date setting" mode, then the month number will also appear on the date display. This is achieved by the input "DATE DISPLAY WITH MONTH SUPPRESSED", using word pulse $D_{13}$, to matrix gate 356. Referring to Table III, it will be seen that an output of "all ones", i.e. "15" state of the word, from the serial-parallel converter will result in a display of "all zeroes". Thus by applying word pulse $D_{13}$ while the months data is entering shift register 388, the months data is converted to "all ones", and thereby is blanked out on the display face.

The input $D_{10}$ to matrix gate 356, gated by flashing signal Φ1G normally causes flashing of the weekdays display when the date data is displayed. This occurs when signal G is in the "L" state, which occurs when the input switch signals are in the condition ($\overline{SH}\cdot SM + SH\cdot\overline{SM} = L$). Thus, when signal G is "H", this flashing is suppressed.

The input $D_5\cdot\overline{T_1}$ causes flashing of the "tens" of seconds data. The logic product $D_5\cdot\overline{T_1}$ is equivalent to $D_5\cdot(T_2+T_4+T_8)$. Referring to Chart III, it will be seen that causing the serial-parallel converter outputs, "2", "4" and "8" to go to the "all ones" state causes the display outputs S0 to S5 to become "all ones". Thus, the "0" display output which is indicating the current "tens" of seconds count is switched to "1" when input $D_5\overline{T_1}$ is at "H" level. Since $D_5\overline{T_1}$ is gated into matrix gate 356 at a frequency of 1Hz by signal Φ1G, the segment of the seconds display which is indicating the current time count will be flashed on and off at a 1Hz rate.

In the timepiece system illustrated, only the six successive states of the "tens" of seconds data are output from the display driver circuit, so that 0, 10, 20, 30, 40, 50 and 60 second times are sequentially displayed. It is however possible to arrange the system such that "units" of seconds are also displayed, and input $D_4$ (1-second $F_L$) to matrix gate 356 caused the "units" of seconds data also to flash when displayed.

As previously explained, when the wearer sets new data into the timepiece for current time, alarm time or date, the corresponding part of the display is caused to flash at a periodic rate. This is caused by inputs $\Phi_{1Hz}$ and U* to matrix gate 356. It is necessary that U* have a duration of two word times. This is because, for example, while the minutes data is being set, both the "tens" of minutes and "units" of minutes display digits should flash simultaneously. This is accomplished by extending the action of input U, from Control Unit 30, to two word pulse durations, by means of gates 358 and 356, together with latch 364. Thus the displays of "units" and "tens" of current time minutes, alarm time minutes and days of the month are caused to flash together when their particular data is being set by the wearer.

To flash the daily alarm symbol, date symbol and AM/PM symbol, the signals generating these symbols are modulated by signals $\Phi_{IF}$,$\overline{\Phi_{IF}}$ or $\Phi_{1G}$.

Continous enable terminal 384 is normally set to the level "L" by an output from bistable circuit 389, which is repeatedly reset by a narrow pulse signal $BD_3T_8$ at a frequency of 1Hz. The CONTA signal output is obtained by detecting the instant when the 1/16 second data in the timekeeping register becomes "0". This output is utilized by the latch circuit 386 to form an output enable signal having a width of 1 memory cycle, or about 4 milliseconds which is delayed by about ½-bit time with respect to the instant when the 1/16 second data becomes "0". This enable signal is latched into 386 at timing $T_8\Phi_1$ and is used to generate periodically chopped bursts of data and clock signals which contain no spurious transient pulses.

To this end, it is passed through OR gate 370, so that if so desired, a continuous enable signal may be obtained by setting the CONT terminal to the "H" level. (This present of the CONT terminal would be performed at the time of manufacture.) The enable signal is then applied to AND gate 376, to generate bursts of $\Phi_2$ clock pulses. It is then delayed in latch circuit 380 so that bursts of $\Phi_1$ clock pulses are gated out of AND gate 374, beginning one period of $\Phi_2$ after the $\Phi_2$ clock bursts (see timing diagram FIG. 8) and continuing for exactly one memory cycle. This delayed output enable signal also gates out concurrent bursts of data (designated DΔ) and of timing pulses $T_8$.

Figure 21:
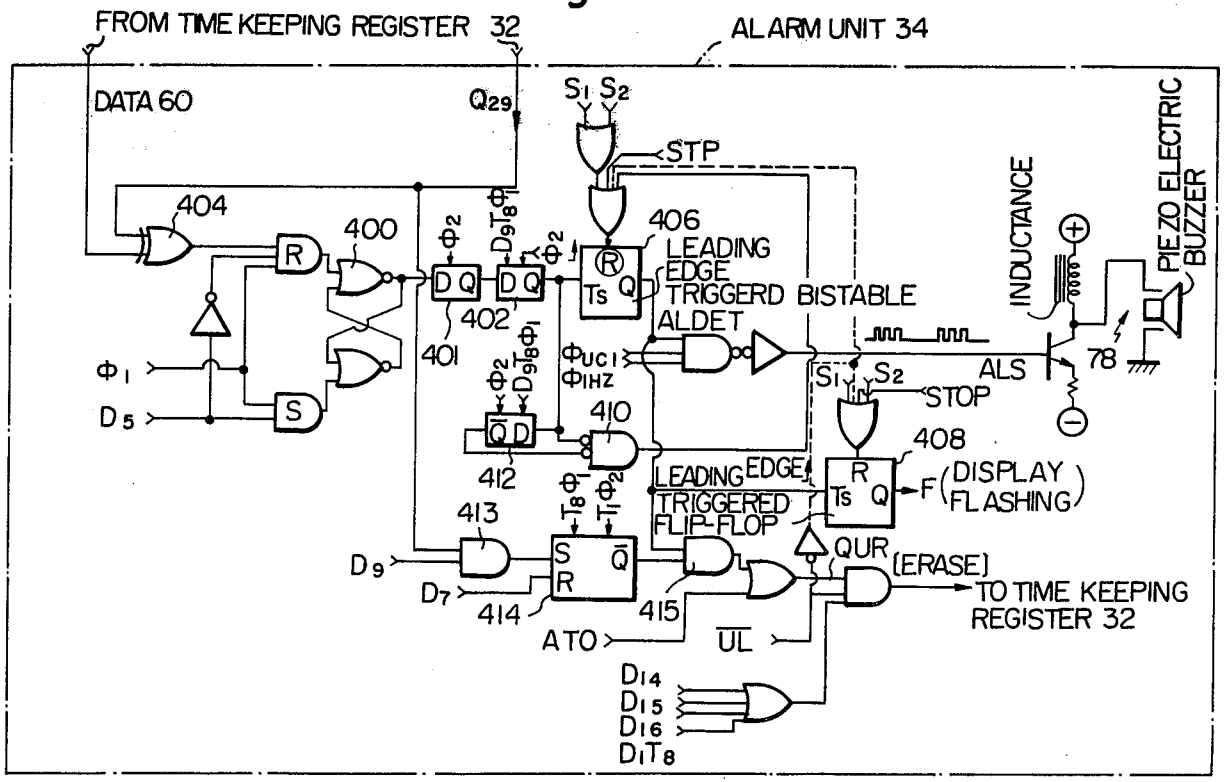
FIG. 21 shows a preferred example of the alarm unit shown in FIGS. 4A, 4B and 4C.

The facility for sending data out in synchronized bursts has the advantage of greatly reducing power requirements for the subsystems to which the data is transmitted. It permits subsystems such as the display decoder and driver circuits, and the option system, to be updated periodically at a low frequency, while the basic timekeeping system operates continously at a high frequency. Thus, energy dissipated in charging and discharging stray capacity in terminals and leads connecting the various integrated circuit chips of the system is greatly reduced. The burst signals are designated $DATA^{\Delta}OUT$, $T_8^{\Delta}$, $\Phi_1^{\Delta}$ and $\Phi_2$, and have a burst repetition rate of 16 Hz and burst duration of one memory cycle of shift register 58 in the timekeeping system. FIG. 21 shows one possible circuit configuration for the alarm unit 34. The input designated DATA 60 comes from the input to the 60th bistable circuit in the time data storage shift register ring, in accordance with the previously described numbering system. Similarly, the data input to the 28th bistable circuit of this shift register ring, i.e. the output of the 29th bistable circuit, is designated DATA 28. Coincidence between the logic levels of DATA 60 and DATA 28 is detected by Exclusive-OR gate 404, causing its output to go to "L" logic level. In this way, the alarm time tAT is compared with real time tKT. The DATA 60 output signal is delayed by the duration of one word time relative to the timing reference serial adder outputs designated as Q65. Since the DATA 28 signal is delayed by 8 word times relative to DATA 60, then during times $D_6$, $D_7$, $D_8$ and $D_9$ the DATA 60 signal represents the minutes, tens of minutes, hours and AM/PM state for the current time respectively while the DATA 28 signal represents the minutes, tens of minutes, hours and AM/PM state (or other symbol) of the stored alarm time respectively.

The detection of timing coincidence is initiated by setting the output of bistable circuit 400 (which has an override reset input) to "H" level at time $D_5T_8\Phi_1$. Any subsequent lack of coincidence between DATA 60 and DATA 28 inputs cause bistable circuit 400 to be reset, by the output of Exclusive-OR gate 404. If complete coincidence does occur i.e. tKT=tAT, bistable circuit 400 remains in the set condition for the duration of digit pulses $D_6$ to $D_9$. More precisely, the comparison between the real time data tKT and the alarm time data tAT is continued until time $D_9T_8\Phi_1$, when the output state of bistable circuit 400 is transferred to D-type bistable 402 through a one bit delay bistable 401. It should be noted that there is a time delay between detection of coincidence for real time tKT and alarm time tAT in gate 404 and the writing in of this condition to bistable circuit 402. Because of this, signals DATA 60 and DATA 28 are actually compared during the time interval between $D_6T_1\Phi_1$ and $D_9T_4\Phi_1$.

If only a single alarm time facility is incorporated, then the alarm time data from DATA 28 is always at the "L" level at times $D_9T_2$ and $D_9T_4$. However if alarm time data is transmitted from the option unit, it is possible that the alarm time data will be "H" level at either of these times.

Coincidence between alarm time and real time is indicated by the output of the bistable 402 going to the "H" logic level. It can be seen that, since complete coincidence between tKT and tAT will only be apparent while the value of the "minutes" data is the same for both of them, the output of bistable circuit 402 will only remain in the "H" logic state for one minute when complete coincidence is detected, and will be in the "L" state at all other times.

Bistable 406 (edge-triggered type), is set by the "L" to "H" transition of the output of bistable 402. Its output is used to control an audible alarm signal. According to this invention, the alarm consists of bursts of 2045 Hz tone with a duty cycle of 25%, a repetition of 1 Hz. If this signal is further modulated at a frequency of several Hz, the resultant audio alarm somewhat resembles the chirping of a cricket. This is not irritating, but attracts the attention of the user.

Edge-triggered bistable circuit 408 is set by the rising edge of the output from bistable 406, and its output serves to actuate flashing of the timepiece display. Both bistable circuits 406 and 408 have override reset inputs, and can be reset by either of the gate inputs $S_1$ and $S_2$, or by the STOP data input of the timepiece. The user can therefore input a signal to the timepiece circuitry to confirm that he has noticed the alarm signal, and the timepiece will then respond to his signal by stopping the alarm indications. Even if such an alarm configuration signal is not sent, the circuit is designed to automatically terminate the audible alarm signal after one minute. This is so as to minimize power drain on the battery, and avoid generating unwanted noise. In this event, however, flashing of the timepiece display will continue until the user inputs an alarm confirmation signal. Bistable 406 is connected such that it is reset by the output of gate 410 one minute after alarm coincidence is first detected.

Since the audible alarm consists of tone bursts at a frequency of 2048 Hz with a duty cycle of 25% and a repetition rate of 1 Hz, it contains frequency components within the range of about 2 Hz, the range to which the human ear is most sensitive. Also, because of 25% duty cycle of the 1 Hz repetition rate, the power required to actuate the audible alarm is greatly reduced, thereby prolonging battery life.

The control signal for the audible alarm is applied to the base of an NPN type transistor, connected in common emitter configuration, which has a 100 Kohm resistor in series with its emitter lead. The activating coil for a piezo-electric buzzer is connected in series with the collector lead of the transistor. It is also possible to use an electro-dynamic type buzzer in place of the piezo-electric type. In either case, the increase in battery current required to operate the buzzer is only about 10%.

The output from bistable 402 is delayed by bistable 412. Gate circuit 410 serves to detect non-coincidence between the logic levels of the outputs of bistable 402 and 412. It therefore generates an output on the falling edge of the output of bistable 402, at the end of the one-minute duration coincidence signal (when tKT=tAT). DATA 28 and word pulse $D_9$ are applied to AND gate 413 to detect whether a daily alarm condition has been set. If it has, bistable 414 is set in time $D_9T_8\Phi_1$. If a temporary alarm has been set in, 414 output $\overline{Q}$ remains at "H" level. This output is designated QER. An erasure signal ERASE is thereby generated by a logical combination of the alarm coincidence signal ALDET from bistable 406, a logical negation QER of the erasure inhibit signal, the inversion of the unlock signal, $\overline{UL}$, a word timing signal and signal ATO. The latter indicates that the stored alarm time is set to zero. Generation of the ERASE signal causes the corresponding alarm time data to be set to zero.

The logic relationship of the above is:

$$ERASE=(D_{14}+D_{15}+D_{16}D_1T_8)\cdot\overline{UL}\cdot(ATO+QER\cdot ALDET)$$

Even if the alarm time being set in should coincide with real time, erasure will not occur while the alarm setting is taking place. Erasure can only occur under the normal operating condition, when $\overline{UL}$ is in the "H" logic state. If the state of $\overline{UL}$ were not made one of the controlling inputs to the ERASE generating circuit, setting of the temporary alarm would be extremely difficult. This is because, if the alarm time being set in should happen to coincide with current real time, while setting was taking place, the alarm time data would be erased.

Usually, symbols giving information concerning the alarm data can only be displayed together with the digits of the displayed alarm data. According to this invention, however, particular alarm symbols such as the daily alarm symbol and the alarm set symbol can be made to appear with the current time dispay. This enables the user to easily check the state of the alarm setting at any time. The condition of zero alarm time being set in is detected and stored in latch circuit 204 in FIG. 11B, the resultant output being designated ATO. As well as being applied to the alarm unit, as described above, this signal is input to the data modulating unit 36 (FIG. 20B). Here, it is used to inhibit the output of alarm time minutes data to the display driver unit, thereby causing blanking of alarm time minutes digits when the alarm time zero condition is set in.

Figure 24A:
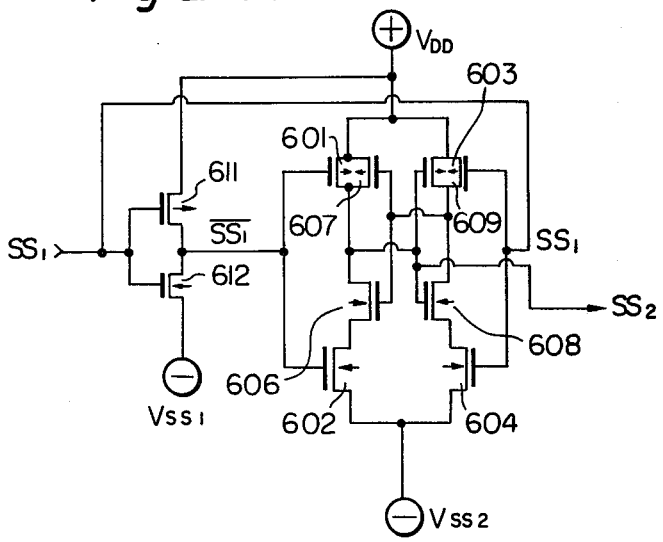
FIG. 24A shows details of electric circuitry for the level shifter shown in FIGS. 22A, 22B and 22C.
Figure 24B:
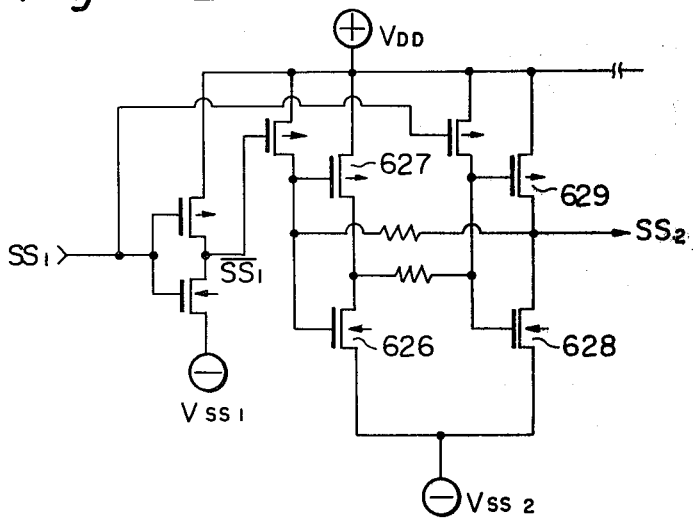
FIG. 24B is similar to FIG. 24A but shows a different example of the level shifter.

To drive liquid crystal display elements, the level shifter circuits 40 are used. Details of the level shifter circuitry are shown in FIGS. 24A and 24B. After the "L" logic level voltage of the data has been changed by level shifter 40, it is sent to a bit serial-parallel converter 42, made up of shift register stages 502, 504 and 506. Outputs from converter 42, $P_1$, $P_2$, $P_4$ and $P_5$ are applied to decoders 508 and 510, whose outputs are written into storage latches in word serial-parallel converter 46. Decoder 508 provides outputs for display digits, whereas decoder 510 provides outputs for a 7-segment linear display. A transfer switching circuit 512 is used to select the outputs of decoders 510 and 508 so that linear display outputs $S_0$ through $S_6$ can also be used to drive display digits, if this is desired. As stated previously, the truth table for the decoders is shown in Table III. Word serial-parallel converter 46 is made up of a number of latch circuits 514 through 526, 514 through 524 being used to convert decoded serial data words from the decoder outputs into static outputs, i.e., parallel form. These latch circuits provide fixed output signals as long as the data does not change. The latch circuit 526 functions to slightly delay the ΦLC input signal.

Figure 24C:
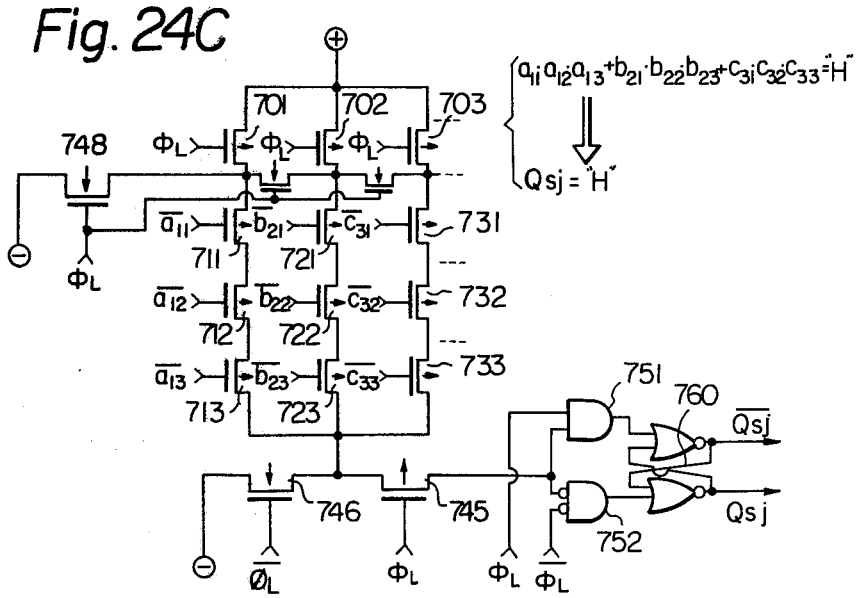
FIG. 24C is an example of the decoder shown in FIGS. 22A, 22B and 22C.
Figure 24D:
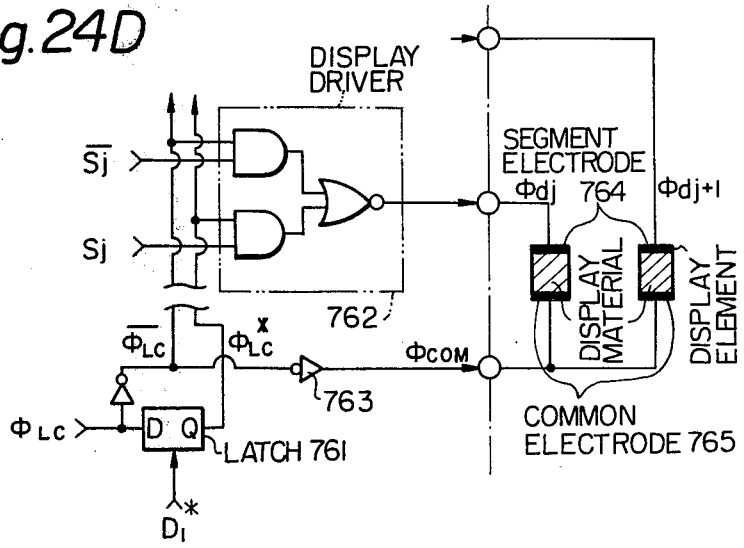

As shown in FIG. 24D the display driver 20 comprises an equal number of AND-NOR gate circuits and latch circuits. Each latch circuit produces signal ΦCOM when its Q output is at the low level, and a signal slightly lagging the signal ΦCOM in phase when the Q output is at the high level. In FIG. 24D each display element is connected between output ΦCOM and the output Φdj of the corresponding driving circuit. A voltage of zero is appied to the element when the latch output is at a low level, and a voltage having a frequency equal to that of the output ΦCOM when the latch output is at a high level.

Timing pulse reproducing circuit 530 comprises shift register stages 532, 534, 536 and 538 for reproducing timing pulses $D_1T_8\Phi_1$, $D_2T_8\Phi_1$, $D_3T_8\Phi_1$, $D_4T_8\Phi_1$ and $D_5T_8\Phi_1$ and gate circuits 540. The timing pulse $D_5{*}T_8\Phi_1$ is applied to latch circuits 514 and 516 to act as a clock signal. Similarly, timing pulses $D_4{*}T_8\Phi_1$, $D_3{*}T_8\Phi_1$, $D_2{*}T_8\Phi_1$ and $D_1{*}T_8\Phi_1$ are applied to latch circuits 518, 520, 522 and 524 respectively.

The signal from output terminal $M_{\overline{DD}}$ is used to actuate display of certain of the markings and symbols shown in FIG. 23, for example symbol 572. This indicates a time display. The signal from output terminal $M_{DY/d2}$ actuates display of a symbol showing that a daily alarm time has been set, for example the symbol 562 shown in FIG. 23. Output $M_{AL}$ actuates display of a symbol which indicates an alarm time has been set, for example symbol 564 in FIG. 23. The appropriate daily alarm symbol or temporary alarm symbol will be displayed even while an alarm time is being set, with the alarm time being displayed, as well as when the timepiece is displaying current time in the normal operating condition. The output from terminal $M_{DD}$ actuates display of symbols such as 566, indicating that a date is being displayed, and 568, indicating the current weekday. The output $M_{\overline{PM}}$ actuates display of a segment 570, which when combined with segment 562 activated by output $M_{\overline{DD}}$ provides discrimination between the displays of PM and AM. 574 represents a "seconds" frame, which is also activated by output $M_{\overline{DD}}$. Output $M_{DY/d2}$ is switched so as to display segment 578 ($d_2$), shown in FIG. 23, when a 7 segment display is designated. It should be noted that, if the display has to show solely time data, then the display digit shown as the second from the right on FIG. 23 only has to handle counts of from one to six (i.e. the "tens" digit of minutes or days.) Accordingly, segments $d_2$ and $q_2$ are either on or off together, and so these segments may be driven by a common drive output. However, if this invention is applied to a chronograph or calculator facility, where fractions of seconds or the full range of decimal digits must be displayed, then $d_2$ and $q_2$ must be driven by separate drive outputs. The leftmost, or first digit of the display shows only the symbol "1". The second digit, 580, is displayed by segments $a_1$ through $q_1$, the third digit 582 by segments $a_2$ through $g_2$ and the fourth digit 584 by segments $a_3$ through $g_3$. The 7-segment linear type display of "tens" of seconds 585 is provided by segments $S_0$ through $S_6$. These can alternatively, drive a 7-segment digit display if input $S_{DE}$ is set to "H" level.

As has been described hereinabove, the potential of the signals applied to the inputs of the display driver unit are switched between $V_{DD}$ (0 volts) and $V_{SS1}$ (−1.5 volts) but according to this invention level shifter circuits 40 are connected at the input of the driver unit, to change the "L" logic level of these signals from $V_{SS1}$ to $V_{ss2}$ (−3 volts). An example of the level shifter circuit is shown in FIG. 24A. The configuration is of an inverter stage, to which logic input SS1 is applied, and whose input and output are connected to opposite inputs of a bistable. This bistable, constituted by CMOS transistors 601 to 609, is based on two NAND gates. Each of these gates has one input connected to the output of the opposing gate, the other input being driven from the complementary input. The MOS FET transistors 602 and 604 are produced such that in the circuit arrangement shown they are not driven into the "pinch-off" condition by the potentials applied to their gates. Thus, as the input logic level is switched from "H" level $V_{DD}$ to "L" level $V_{SS1}$, the output logic level is switched between $V_{DD}$ and $V_{SS2}$, due to the conducting paths through transistor pair 601 and 607, and transistor 606, being opened or cut off by the switching of the bistable.

A modified form of this level shifter design is shown in FIG. 24B. It should be noted that it would be possible to reduce the power consumption of the display driver unit shown in FIGS. 24A and 24B by performing the level shifting at the display drive outputs, since the number of logic level transitions performed by these circuits per second is much less than at the inputs. In this case, latch circuits 514 to 524 could be replaced by the level shifter circuits shown, modified so that the bistable has SET and RESET inputs. However, this results in an increase in the total number of FETs required in the display driver unit.

An example of the display driver circuit is shown in FIG. 24D. As is normally done in liquid crystal display driving, the display segment which is to be made visible has a periodic square-wave alternating voltage applied to its electrodes. It is a feature of the present design, however, that a delay time is arranged at the stage of each electrode applied voltage transition when the applied voltage is zero. During this delay time, the electrical charge on the electrodes is discharged through by passing CMOS FETs connected to the electrodes, so that this discharge current is not passed through the supply battery of the timepiece. This results in a reduction in the power required to drive the display of about 50%, as compared with conventional techniques. This delay is accomplished by timing signal $D_1$, applied to latch circuit 761, which produced delayed drive signal $\Phi_{LC*}$. To blank out a display segment signal $\overline{SJ}$ is set high. Alternating voltages of identical phase and polarity are thus applied (i.e. $\Phi_{LC}$) through NOR gate 762 and inverter 763, to the corresponding segment electrodes 764 and 765.

Referring now to the display drive unit shown in FIGS. 22A, 22B and 22C, the level shifter circuits 40 are indicated by a set of square blocks at the inputs on FIG. 22A. After level-shifting, the data input is converted from parallel to serial form by bit serial-parallel converter 42, composed of shift register circuits 502, 504 and 506. The four parallel outputs from the converter 42 are applied to decoders 508 and 510, which generate display segment data outputs for digital and analog (linear) display formats respectively. For some applications, an analog type display will not be incorporated, all readouts being in digital form. In order that a standardized IC chip may be utilized for both types of application a "transfer" circuit 512, controlled by input $S_{DE}$ is included. When input $S_{DE}$ is "H", then the outputs of decoder 508 will appear at the transfer circuit outputs. This would be apreset at the time of manufacture of the timepiece. In the case described here, input $S_{DE}$ would be set permanently to the "L" logic state. The outputs of the decoders 508 and 510 corresponding to the weights of the input bits are shown on Table III. Decoder 508 generates 8-segment outputs, for the digital part of the display, and 510 generates 7 outputs for the analog part.

The composition of each element of the decoder is shown in FIG. 24C. An assemblage of MOS FET transistors constitutes a matrix of AND/OR gates, whose output is latched into bistable circuit 760. This technique enables easier manufacture of the decoder in highly compact form. The incoming data which is to be displayed is sequentially stored in word serial-parallel converter 46 by clock pulses $D_1T_8\Phi_1$ to $D_5T_8\Phi_1$. These are generated by an input shift register consisting of stages 532 to 538, and are initiated by input $D_D$ from the data modulation unit. It should be noted that since the timing of $D_D$ is determined by the output of data selector 362 in the data modulation unit (FIG. 20B), this signal effectively selects which of the three data categories, current time, alarm time and data, will appear on the display.

Figure 25:
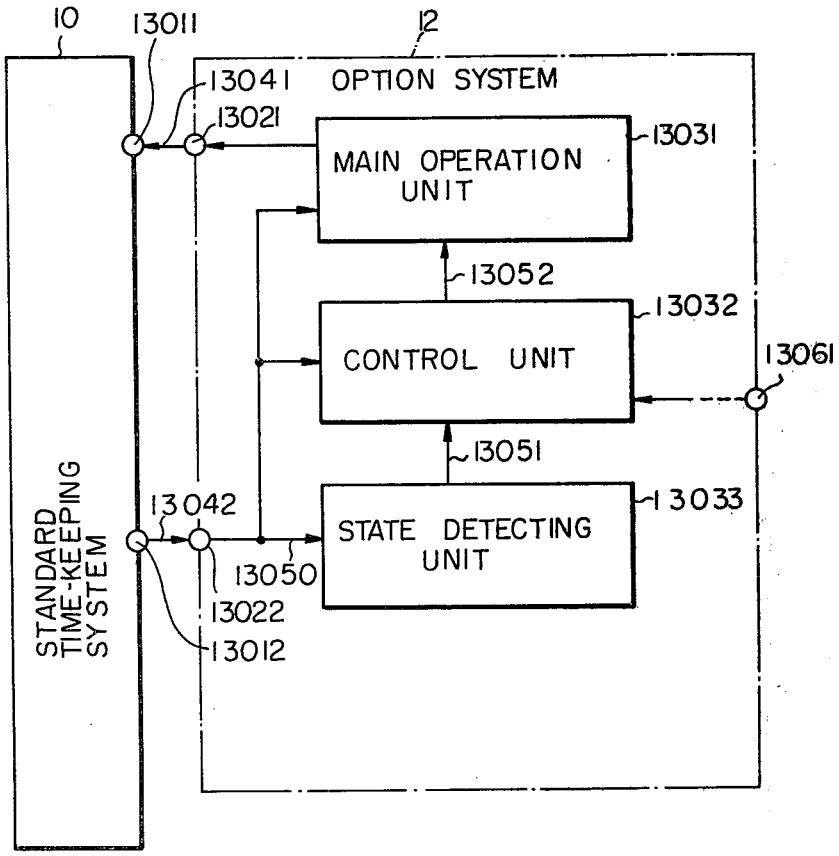
FIG. 25 shows the general concept of an option system according to the present invention.

One example of the option unit 13020 for this invention is illustrated in the block diagram shown in FIG. 25. The option unit is combined with a standard unit 10 of the timepiece system. Various control signals are transmitted between the standard unit and the option unit through terminals 13011, 13012, 13021 and 13022 and interconnecting conductors 13041 and 13042, the direction of flow of signals being designated by arrows shown on conductors 13041 and 13042. Either one of the interconnecting conductors 13041 and 13042 may be omitted, depending on the particular system design. Input terminal 13061 is shown, connected only to the option unit, but in some cases this terminal may be omitted.

Main operation unit 13031 is based on a data storage register if only a multi-alarm option facility is intended; or on an operating unit, a data storage register, and timing pulse generator where an automatic gain/loss compensation option facility is intended; or an operating unit and a data storage register where a calculator option facility is intended; or a pressure detector, a data converter and a data storage register where a blood pressure monitoring option facility is intended. A control unit 13032 is provided. When a multi-alarm option facility is intended, the control unit 13032 generates signals, which cause each of a number of alarm times stored in the option unit to be successively compared with the current time, and, on demand by the wearer, command signals which cause the alarm times stored in the option unit to be successively read out on the timepiece display face. Where a gain/loss compensation option facility is intended, the control unit 13032 produces a signal causing the commencement of an error measurement, and a command signal to cause a pulse generating circuit in the option unit to generate gain/-loss correction pulses required to correct any error. In the case of a calculator option facility, the control unit 13032 produces command signals causing exchange of data between the calculator and various data storage locations in the option unit, in response to calculate command signals such as x, ', +, =, etc.

In addition, the control unit 13032 may also be constructed such that it stores the entire operation sequence of the option unit, or part of the sequence. It may also be constructed so that a portion of the standard unit is controlled by the option unit, through signal conductor 13041. For example, in the case of a multi-alarm option system, upon coincidence between one of the alarm times and the current time, this alarm time data is erased from the option unit storage register automatically. A gate circuit whereby data is transmitted from option unit 1320 to the standard unit is closed when alarm coincidence is detected, and a control signal is produced by the control unit causing interruption of the supply of clock pulse to the shift register of the option unit. Just previous to this time, the alarm data coinciding with current time has been supplied to the data storage register of the standard unit. After one minute, the supply of clock pulses from the standard unit to the option unit is resumed, thus sequentially transferring other alarm time data to the standard unit from the option unit. When the normal current time display is changed to an alarm time setting display, by actuating an external operating member, the control unit produces a signal that causes the data stored in each location of the option data storage register to be examined sequentially. When a location is found in which there is no alarm time stored, or after a predetermined time, for example 0.5 second, a signal that terminates the search is produced. If a vacant storage location is found, a signal is produced, causing termination of the supply of clock pulses to the data storage shift register of the option unit. If no vacant location is found, the search is automatically terminated, after 0.5 seconds maximum. In this case, the lastly set alarm time is transferred to the standard unit and displayed, and the supply of clock pulses to the option unit storage shit register is terminated. The new desired alarm time data is now written into the data storage register of the standard unit by the wearer, using external control members. As stated above, at the end of the termination of the search for a vacant alarm location, the data flow between the standard unit and the option unit has been interrupted. When the wearer now actuates another control member, a circuit path is opened allowing flow of data from the standard unit to the option unit by the control circuit of the option unit. The new alarm data is then transferred from the standard unit to the option unit at a timing such that it is written into the vacant data location.

If the system incorporates a calculator option facility, the technique of sending clock pulses in bursts may also be applied, while maintaining a high speed of computation. When a data entry is made to the calculator, or an operating command is given to it, this causes the CONT terminal of the standard unit to be set high for a time depending on the particular operation. This in turn causes a continuous train of clock pulses at high frequency to be sent to the calculator option unit. When the computation or entry is completed, the clock pulses may be then again sent in periodic bursts, as described for the multi-alarm option facility. This technique enables the power requirements for a miniaturized calculator to be reduced from several milliwatts to about 1 microwatt, a reduction of the order $10^3$.

The use of a combination of standard unit and control unit offers a number of advantages. Since the clock pulses used in the option unit are generated by the standard unit, while they are controlled by a control unit in the option unit, there is a saving of component elements and a corresponding reduction in power requirements. In addition, detection circuits can be incorporated in the control unit to monitor the status of data stored in the option unit, the state of external control members or such things as supply battery voltage. Also, the use of such detection circuits within the option unit makes it possible to utilize the same external operating members for various purposes, thereby reducing the number of such external members required, as will later be shown in the description of the option unit operation. As an example, if both an automatic gain/loss compensation facility and a multi-alarm facility are incorporated, the same external switch can be used both to update the time data and also to cause the various stored alarm times to be sequentially displayed. It is also possible to design control unit 13032 such that it can control certain operations within the standard unit also. For example, if alarm times which include date data are stored in the option unit, the control unit can produce command signals causing the colon of the digital display (indicating time data) to be erased and a stroke together with the letters "DATE" to be displayed. Where an automatic gain/loss adjustment facility is incorporated, a gain/loss compensation signal can be sent from the option unit to the timing pulse generator within the standard unit.

Interconnecting conductor 13042 transmits data, clock pulses and various timing signals, as well as DC power to the option unit. If the standard unit is utilizing a clock pulse frequency of 16,348 Hz ($\Phi_1$ and $\Phi_2$), for example, bursts of these clock pulses ($\Phi_1\Delta$ and $\Phi_2\Delta$) are transmitted to the option unit at a repetition rate of 16 Hz. Thus the means clock frequency of the option unit is 1,024 Hz. Use of the burst technique enables data to be transferred between the option unit and standard unit in synchronism, in spite of the difference in mean clock frequencies. This has the advantge of obviating the need for a separate clock frequency generator in the option unit, thereby decreasing power consumption.

Signals $\Phi_{UC1}$ and $\Phi_{UC2}$ are sent to the option unit to enable various timing pulses within the word times $D_1$ to $D_{16}$ to be regenerated. These signals may also be used, if necessary, to provide switching pulses for a voltage booster circuit in the option unit. This booster circuit is only required for certain types of liquid crystal displays. The higher voltage which it supplies is applied to the circuitry of the display driver unit. If necessary, other circuits of the option may be operated from this boosted output voltage, or from an inermediate point wihin the booster circuit.

The combination of the standard unit with an option unit offers numerous advantages, not afforded by either of the units used separately. This is because the particular features of each unit are combined to the best advantage.

Figure 26:
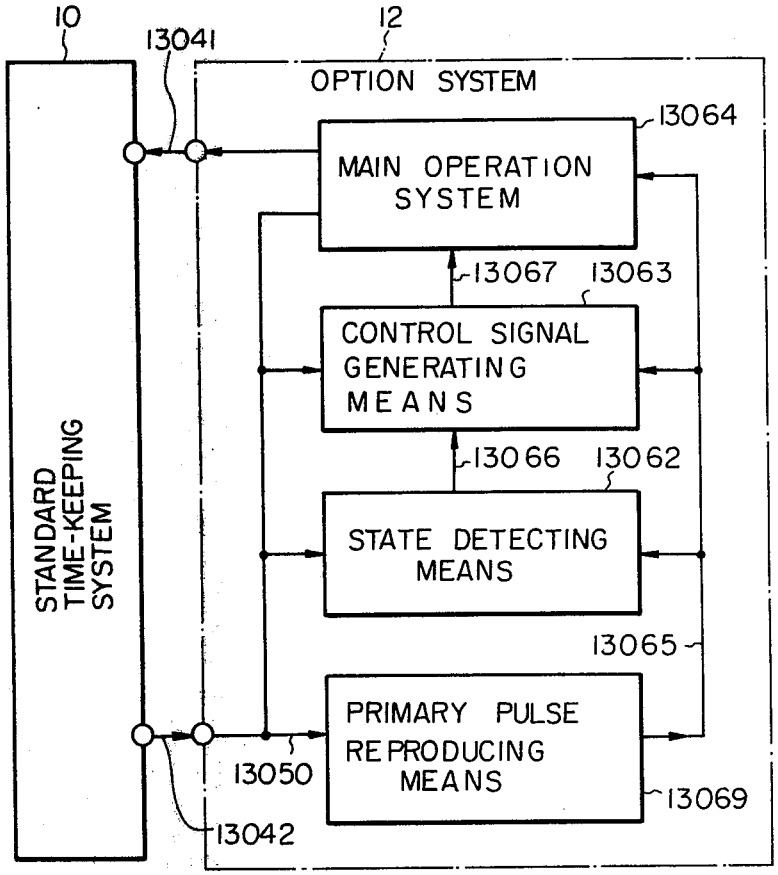
FIG. 26 is a simplified block diagram illustrating a preferred embodiment of the option system according to the present invention.

FIG. 26 shows a basic block diagram of one example of an option unit providing multi-alarm and gain/loss functions. For simplicity, the wiring for the word pulses, timing pulses and clock pulses, etc., is not shown. Table IV gives a breakdown of the functions of the various blocks shown in FIGS. 27A, B and C. In this table, classification group "a" comprises the blocks which generate the basic timing signals required to operate the option unit. Classification group "b" covers those blocks in which various conditions of the data, for example coincidence between an alarm time date and the current date, are detected. Group "c" covers the blocks which generate various control signals, which control the operation of not only the option unit, but in some circumstances the standard unit operation also. Group "d" comprises various data control gating circuits, controlled by signals from the standard operating unit, option unit control signals, etc. Comparing FIG. 25 to FIG. 26, it should be noted that FIG. 26 is a basic block diagram of the embodiment of the present invention described herin, corresponding directly to the more detaled diagrams of FIGS. 27A to C. As shown, timing and control pulses sent from the standard timekeeping system 10 causes timing pulsing 13065 to be produced by primary pulse generation circuits 13069, and applied to state detection circuits 13062, control signal generating circuits 13063 and main operation circuits 13064. The group classifications "a", "b", "c", "d" amd "e" in table IV correspond to blocks 13069, 13062, 13063 and 13064 in FIG. 26, as well as to the corresponding to blocks in FIGS. 27A to C.

TABLE IV

| Classification Group | Number | Designation | Function | Outputs (in Figs. 27A to 27C) |
|---|---|---|---|---|
| a: Primary pulse generation | | Qi-RP-a | Reproduce composite word timing pulses. | $Q_1$–$Q_{16}$ and $\phi_{\alpha+\beta}$ |
| | 1431 | Tj-RP-a | Reproduce Bit timing pulses. | $T_1$–$T_8$, $T_{12}$,$T_{24}$ |
| | 1451 | Width-a | Synthesis of signals determining transmit- | WKT, WDT, WATI, WATO |

TABLE IV-continued

| Classification Group | Number | Designation | Function | Outputs (in Figs. 27A to 27C) |
|---|---|---|---|---|
| | | | ting and receiving data time durations | |
| | 1454 | TPG-a | Synthesis of composite timing signals. | $T_8\phi$, $O_{10}T_8\phi_2$, etc. |
| [b: state detection | 1410 | OHAT-b | Alarm time zero detection | OHAT |
| | 1411 | QOHER-b | Detection of "all ones" of alarm data | QOHER |
| | 1424 | DT-DET-b | Detection of coincidence of alarm date and current date | $\overline{ERDY}$ |
| | 1425 | AT-DET-b | Detention of coincidence of alarm time and current time | DETAT, QERAT |
| | 1427 | AT-DISP-DET-b | Alarm time display state detection | QA, $Q\phi_3AT$ ②, $Q\phi_3AT$ ① |
| | 1429 | KT-DISP-DET | Current time display state detection | QKT |
| | 1482 | DT-GATE-b | Count of days, for control of automatic gain/loss circuits | $\overline{DGO}$ |
| [c:control signal generation] | 1402 | SB-c | Output control | SB ①, SB ②, SB ③ |
| | 1403 | SA-c | Input control | SA |
| | 1420 | MAN-SHIFT-c | Manual shift, to enable display of the various stored alarm times | $\overline{MS\uparrow}$ ① SM ↑ ② CONT$\phi$ |
| | 1426 | SRG-STOP-c | Halting operation of data storage shift register | $\overline{QSTP}$ |
| | 1452 | MAR-SET-c | Mark set | ALI ①, ALI ②, ALD ①,ALD ② |
| | 1483 | INPUT ANALYSIS-c | Control of operation of automatic gain/loss adjustment | $P_1$, DGR |
| [d: gating system around main component] | 1401 | OUT-CONT-d | Data output control gate | DOUT, $D_{CL}$ |
| | 1408 | CLOCK-CONT-d | Clock pulses control gate | $\phi_1^*$, $\phi_2^*$ |
| | 1409 | DATA-DEMOD-d | Data-input demodulating gate | $D_{IN}$ ①, $D_{IN}$ ②, $D_{IN}$ ③ |
| | 1407 | DIN-GATE-d | Shift register data input control gate | 1407-OUT |
| | 1406 | AL ①-d | Mark input $gate_1$ | SRG-448-IN |
| | 1405 | AL ②-d | Mark input $gate_2$ | SRG-438-IN |
| | 1404 | DT-ER-d | Date data erasing gate | AXO |
| | 1490 | SRG-RING-e | Data storage shift register ring | SRG-OUT(111, 121, 311, 441) |
| [e: main operating system] | 1481 | COMP-e | Counter and comparator for gain/loss adjustment | $Q_{31}$-$Q_{36}$ |

Figure 27A:
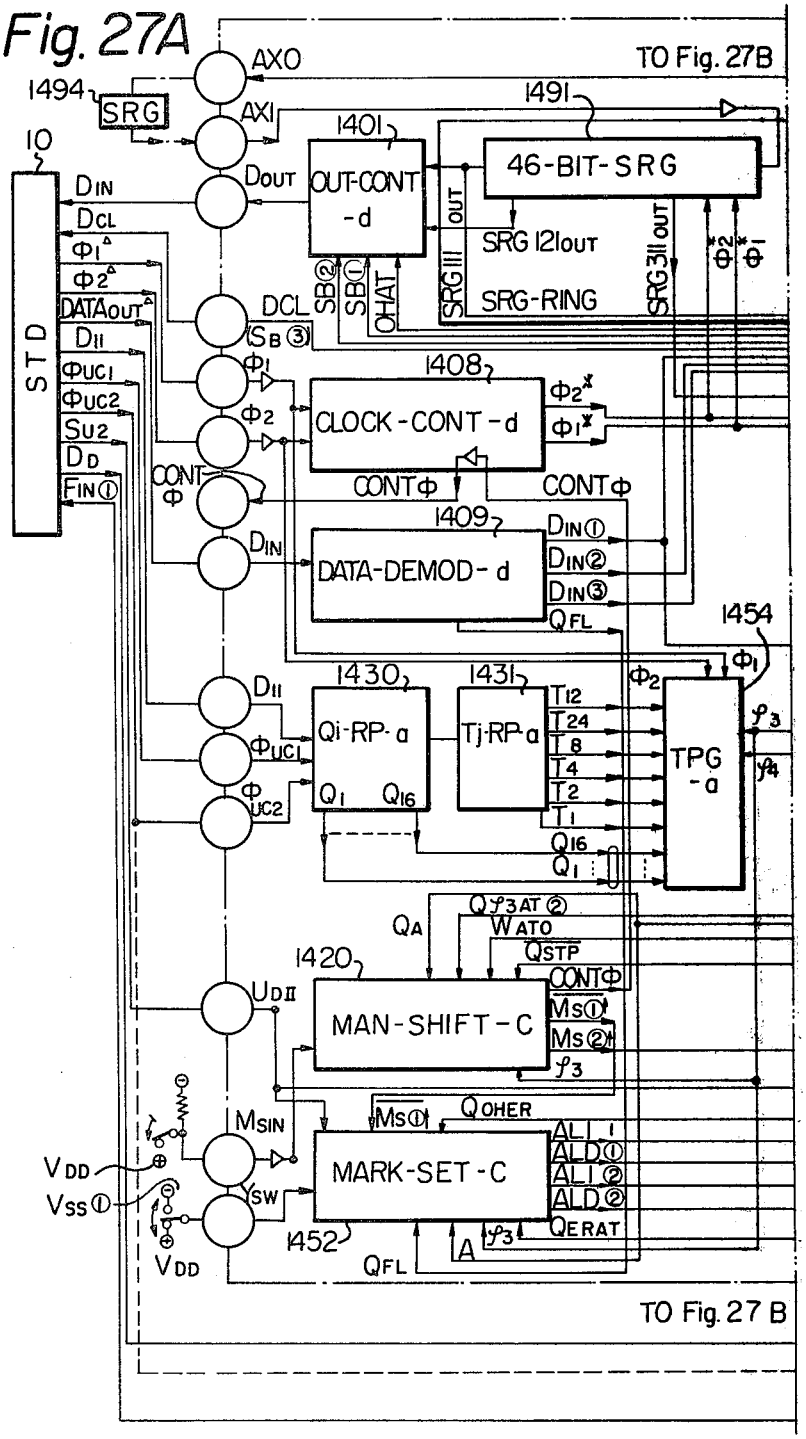
FIGS. 27A, 27B and 27C show detail block diagrams for an example of the option system shown in FIG. 26.
Figure 27B:
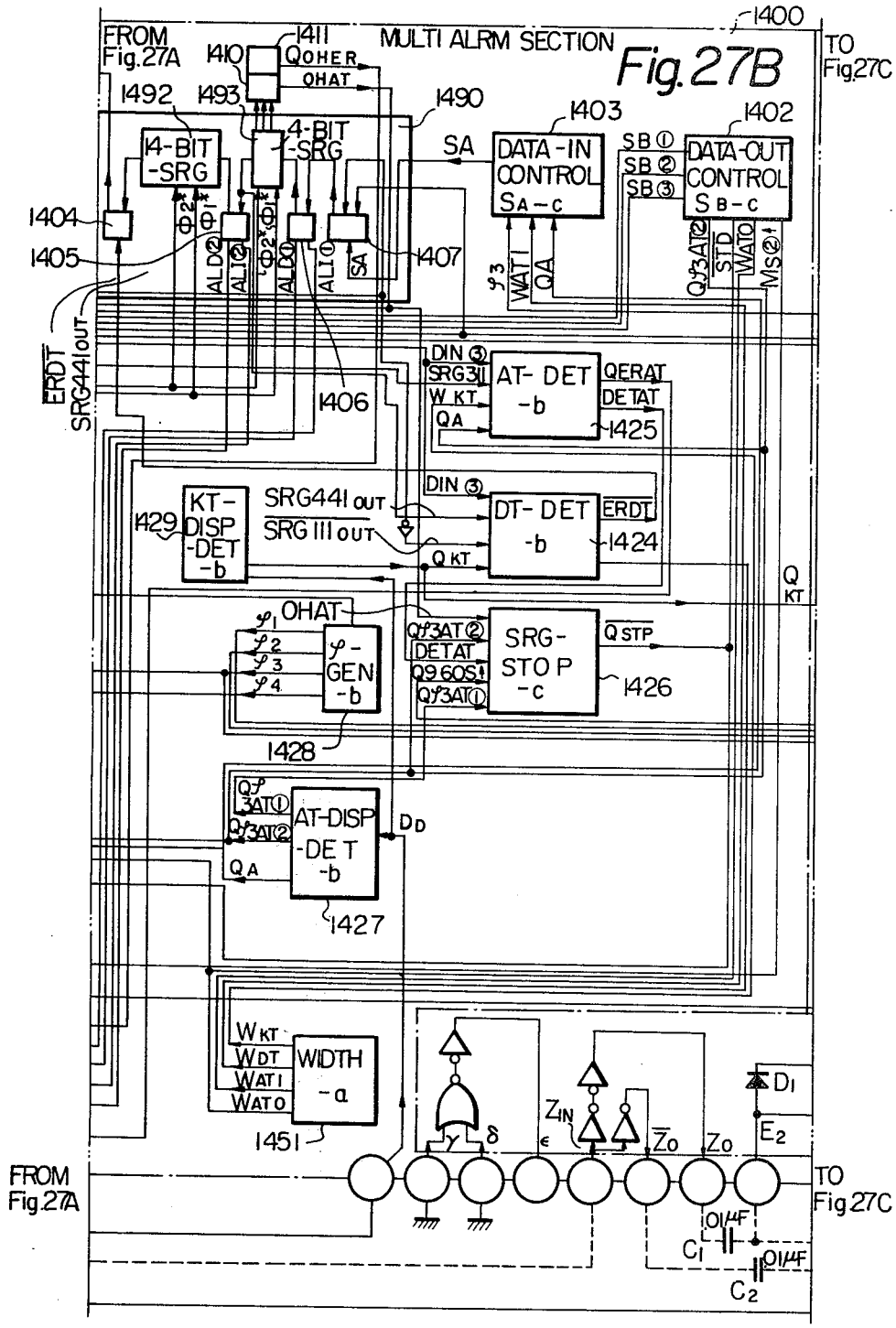
Figure 27C:
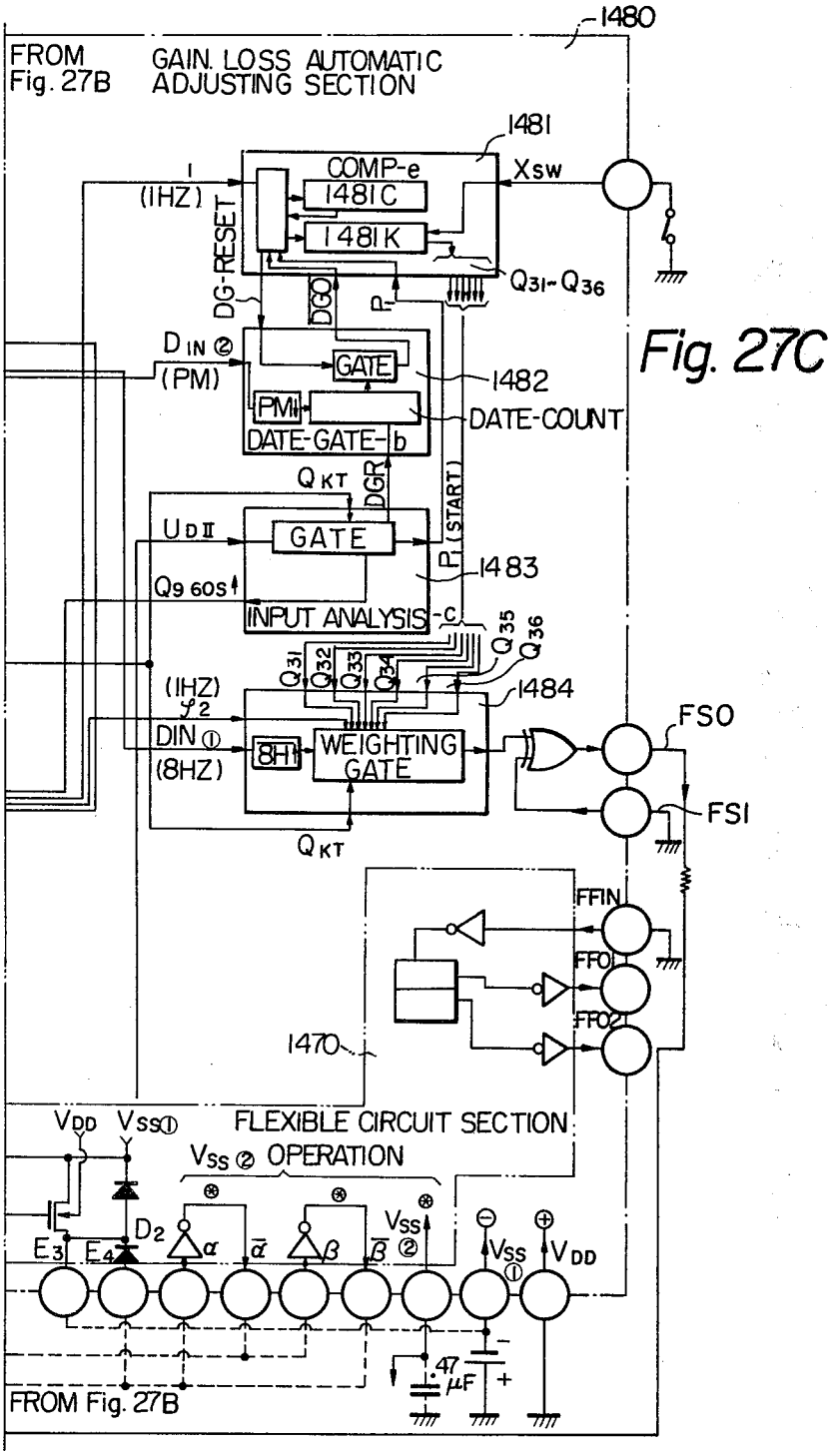

In describing the construction and operation of the example of the option unit shown in FIGS. 27A, 27B and 27C, the overal functions of the unit will first be outlined. The option unit comprises a 64 bit shift register ring 1490 to accommodate alarm data, a group of data blocks 1401 through 1454 including various gate circuits for controlling the shift register ring, circuits generating varius signals, the gates, an automatic gain/-loss adjusting block 1480, and a "flexible" circuit block 1470, which can be utilized are required by the particular design. The 64 bits of the shift register ring 1490 can accommodate either four sets of alarm time data comprising hours and minutes or two sets of alarm time data comprising hours, minutes, month and date. It is possible to increase the amount of alarm time data by adding additional shift reigster stages. The alarm time data includes AM/PM information and the wearer can select either a daily alarm mode, whereby an alarm is generated at the same time every day, or a temporary alarm mode in which alarm coincidence is detected only once, generating an alarm warning and thereafter the corresponding alarm time data is automatically erased. The setting of multi-alarm data in the option unit is performed using external operating member connected to the standard unit, so that additional operating members for the option unit are unnecessary. By means of the gain/loss adjustment system, it is possible to compensate the oscillation frequency of a mass produced quartz crystal to an accuracy of $7\times10^{-7}$, without using trimer capacitors or other measures. This accuracy results in an error of the order of two seconds per month, which is less than can be obtained by a quartz crystal oscillator adjusted at the time of manufacture of the timepiece. According to this embodiment it is possible for the wearer to quickly adjust the timepiece to a very high accuracy, by means of internal circuitry which measures the gain/loss of seconds over a period of one week. Since this error will vary according to such factors an ambient temperature (which is affected by the wearer's daily activities), aging of the particular quartz crystal used, etc., this method is basically preferable to a factory present frequency adjustment. The adjustment is performed by the wearer resetting the seconds data of the watch to zero (by depressing a switch) at the "zero" time of, say, a standard radio time signal. Precisely one week later, at the same "zero" time signal, the wearer again resets the timepiece seconds display to zero. Compensation has now been automatically achieved.

Gate circuits 1404, 1405 and 1406 are provided for shift register ring 1490 so that data may be rapidly input to the register in semi-parallel form. These gate circuits are also used to set in alarm daily/temporary data, and to erase stored data when necessary as will be described later. Output SRG-111 is sent to the standard unit from the option unit, at word timings $D_1$ through $D_{14}$ under the normal display condition of the timepiece. Output SRG-121 is used to transmit data from the shift register 1490 to the standard unit when alarm time data is being displayed prior to setting in a new alarm time. For this reason the timing of data from this output SRG121 OUT is one word time prior to that of output SRG-111. Output SRG-441 is used to enable month and date information sent from the standard unit to be compared with the date alarm data stored in shift register 1490. Output SRG-311 is used to compare current time information from the standard unit with the hours and minutes of alarm time stored in the option unit. Normally, with data is stored in serial form it is possible to process all data by taking a single output from one stage of the shift register ring. However, since with this invention, the clock pulses are transmitted to the option unit in periodic bursts, the output circuits of the shift register must be accordingly suitably designed and controlled. Data supplied from input terminl DIN are written in to the 64 bit shift register ring 1490 via input control gate circuit 1407, after passing through data demodulation block 1409. Date circuit 1407 passes data into shift register ring 1490 in accordance with input control signal SA generated by input data control block 1403. Data outputs SRG-111 or SRG-121 of the shift register ring are designated $D_{OUT}$, after selection by gate circuit 1401, which controls Data output. $D_{OUT}$ is connected to the DATA-IN input of the standard unit. Data in shift register ring 1490 is shifted by clock pulses $\Phi_1$* and $\Phi_2$*, generated from clock pulses $\Phi_1$ and $\Phi_2$ from the standard unit by clock pulse control circuit 1408. It is possible to increase the capacity of shift register ring 1490 by connecting a 64(n−1) bit shift register between output terminal AXO and input terminal AXI, where n is an integer.

Referring to FIGS. 27A, 27B and 27C, the option unit receives signals from the standard unit at clock pulse input terminals $\Phi_1$ and $\Phi_2$, data input terminal DIN, reference word timing pulse input terminal $D_{11}$, display selector pulse terminal $D_D$, composite timing pulse input terminals $\Phi_{UC1}$ and $\Phi_{UC2}$, manual shift signal input terminal MSIN and DATA setting input terminal UDII. Output terminals $D_{OUT}$ and $C_{CL}$ of the option unit is connected to input terminals $D_{IN}$ and $D_{CL}$ of the standard unit. Various DATA can thus be exchanged between the standard unit and the option unit through the respective input and output terminals.

The option unit also includes an output terminal FSO, which is connected to input terminal FIN of the standard unit. After gain/loss compensation has been initiated, pulses are sent from terminal FSO to compensate for errors in the oscillator frequency of the standard unit. Output terminal AXO and input terminal AXI of the option unit permit the installation of additional shift register stages, enlarging the capacity for multi-alarm time data storage in the option unit. Direct connection of these terminals AXI and AXO allows up to four different alarm times of hours and minutes to be set. This can be extended to eight alarm times by providing an additional 64 bits, or sixteen by providing an additional 256 bits of shift register storage capacity. It should be noted that, with more than sixteen alarm times, terminal CONT of the standard unit must be set to the high logic level, so that clock pulses are transmitted continuously to the option unit. Indicated by dashed lines in FIGS. 27A, 27B and 27C are connections which may be made to the "FLEXIBLE" circuit, mentioned previously, the gates and inverters of which are shown here connected to form a voltage booster circuit. The output Vss2 of this circuit is capable of applying a boosted voltage to the display driver circuit at an efficiency of more than 95%. Inputs $\Phi UC_1$ and $\Phi UC_2$ are applied as switching signals to the voltage booster circuit.

Terminals $Y_{SW}$ and $X_{SW}$, shown in FIGS. 27A and 27B respectively, are preset to either the high or low logic level at the time of manufacture of the timepiece. If terminal $Y_{SW}$ is set high, then the wearer can set in date data as well as hours and minutes data for multi-alarm times. If $Y_{SW}$ is set low, then it is only possible to set in the hours and minutes data of alarm times. Terminal $X_{SW}$ is used in presetting an initial value into a couner in the automatic gain/loss adjustment circuits in manufacturing process, to be described later.

Input signals $\Phi_1$, $\Phi_2$ and $D_{IN}$ of the option unit occur in periodic bursts if terminal CONT of the standard unit is set low, and are transmitted continuously if this terminal is set high. The option unit is designed such that its operation is not affected, regardless of whether these signals are sent in bursts or continuously. Option unit input signals $D_{11}$, $\Phi UC_1$ and $\Phi UC_2$ are always continuous.

Data applied from the standard unit to terminal DIN of the option unit is delivered to shit register ring circuit 1490 via data demodulator block 1409. The data demodulator block serves to eliminate the effect of modulation applied to all or part of the data to cause flashing of the display.

The delivery of the data to the shift register ring 1490 is performed through gate 1407, controlled by command signal SA generated by data input control block 1403. Either output SRG-111 OUT or SRG-121 OUT of the shift register ring circuit are selected and transmitted as output $D_{OUT}$ by output gate 1401. Gate 1401 is controlled by command signals SB ① and SB ② from data output control block 1402. Output signal SB ③ of control block 1402 is transmitted from the option unit to the standard unit with the designation DCL. It's function is to cause erasure of certain alarm The shift register ring circuit comprises a total of 64 bit shift register stages, and is capable of storing four different sets of alarm time data, each consisting of four word times of DATA.

Shift register ring 1490 is periodically actuated to shift the data stored in it by bursts of clock signals $\Phi_1$* and $\Phi_2$*. These signals are generated by selectively gating portions of input clock signals $\Phi_1$ and $\Phi_2$ in clock control circuit 1408, under the control of clock command signal CONTΦ. The latter is generated within the manual shift circuit block 1420.

Input $D_{11}$ to the option unit is used as a reference timing signal within circuit block 1430, to generate composite word timing pulses from input signals $\Phi UC_1$ and $\Phi UC_2$. The composite timing pulses can be represented by the formula $Q_i = D_i + D_{i+1}$, where $Q_i$ is any one of the composite timing pulses $Q_1$ to $Q_{17}$. As already stated, signals $\Phi UC_1$ and $\Phi UC_2$ are also used in a voltage booster circuit.

Circuit block 1431, labelled TJ - RP-a, generates various combined bit timing signals, from inputs Φ1 and Φ2 and input $\Phi\alpha+\beta$ from circuit block 1430. Signals generated are $T_2$, $T_4$, $T_8$ and $T_1$, all of which have the same phase relationships to he data words as the corresponding bit timing pulses in the standard timekeeping system, and also composite timing pulses $T_{12}$ and $T_{24}$. $T_{12}$ is logically equivalent to $T_1+T_2$, and $T_{24}$ to $T_2+T_4$. The latter composite signals are produced in order to simplify the interconections within the integrated circuit.

Figure 34:
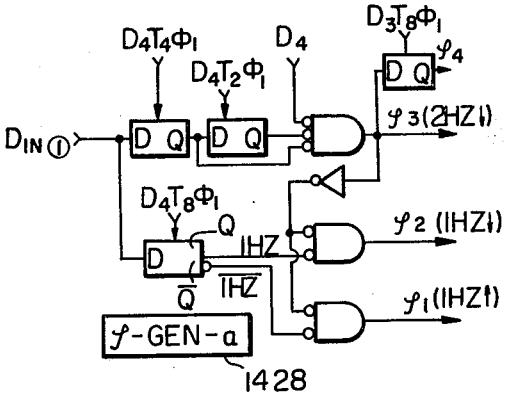
FIG. 34 shows a synchronizing signal regenerating circuit.
Figure 53:
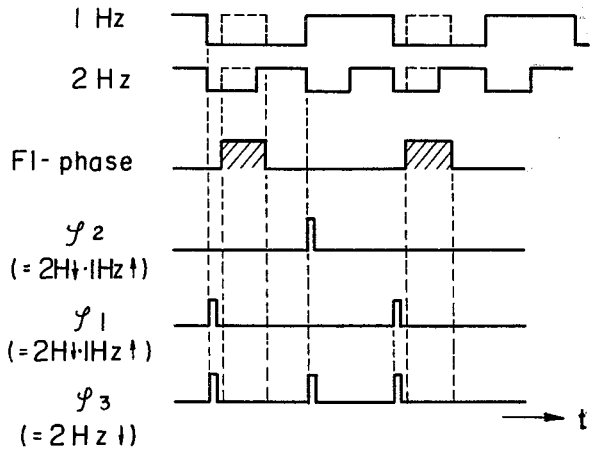
FIG. 53 shows waveforms of the outputs generated by the synchronizing signal regenerating circuit.

Composite timing pulse genrator TPG-a, block 1454, generates various composite timing signals, from inputs $Q_1$ to $Q_{16}$, the bit timing signals, and synchronizing signals $\phi_1$ to $\phi_4$, to be discussed hereafter, as well as clock signals $\Phi_1$ and $\Phi_2$. This block produces such composite signals as $\phi_3 D_{11} T_8 \Phi_1$. The timing of data interchange between the standard timekeeping unit and the option unit under various conditions is basically determined by control signals $W_{KT}$, $W_{DT}$, $W_{AT1}$ and $W_{ATO}$, generated by the WIDTH-a block 1451. Synchronization signals $\phi_1$ to $\phi_4$ are generated within circuit block 1428. As stated previously, it is necessary to eliminate the effect of modulation applied to the data from the standard unit, i.e. modulation applied to the data or parts of it so as to produce flashing on the display face of the timepiece. It would not be necessary to remove such modulation if a separate unmodulated data output terminal were provided on the standard unit. In the configuration described herein, however, this was not possible due to practical limitations on the number of connections which can be made to the integrated circuit chips. The function of the synchronization $\phi$ signals is essentially to permit the modulated data to be processed within the option unit regardless of any flashing modulation which has been applied. The circuit of block 1428 is shown in FIG. 34, and the waveform generated in FIG. 53. F1-phase waveform in FIG. 53 shows the timing of modulation applied to the data from the standard unit to cause display flashing. As can be seen, the $\phi$ signals are generated at times when the data is unmodulated. They are produced from 1Hz and 2Hz signals, which are generated by detecting the state of the seconds data of current time in latch circuits actuated by timing pulses $D_4T_4\Phi_1$and $D_4T_8\Phi_1$. (The current time data being one component of the data stream input as $D_{IN}$ to this circuit). $\phi_4$ is identical in waveform to $\phi_3$, but is delayed by one memory cycle with respect to it.

Circuit block 1429, labelled KT-DISP-DET-b, serves to detect the condition that the timepiece is displaying current time. Output $Q_{KT}$ from this block is applied to the automatic gain/loss adjusting block 1480, as well as to the DT-DET-b block 1424 where it is used in generating a signal which erases the date data of a date alarm time when alarm coincidence is detected.

Block 1427, AT-DISP-DETECT-b, detects the condition of alarm time being displayed on the timepiece. If this condition is detected, signals are produced which cause the stored alarm time data to be examined to determine if a vacant alarm location exists. This process is actuated by signals Q3AT ① and Q3AT ② going high, these signals being applied to the MAN-SHIFT block to control the timing of shift register clock pulse outputs, and to the DATA-OUT-CONTROL block 1402 to control signals SA and SB, which switch the flow of data into and out of the option unit.

Alarm time coincidence detecting circuit AT-DET-b, block 1425 detects coincidence between any alarm time stored in the option unit with the current time applied thereto from the standard unit. The circuit AT-DET-b compares the data from output SRG 311 of the shift register ring 1490 with the current time and, upon coincidence being detected, immediately produces a signal initiating erasure of the corresponding alarm time data. This signal, QERAT, is generated within the same memory cycle. A coincidence detection signal designated DETAT is fed to an SRG-STOP block thereby stopping the operation of the shift register ring 1490 for a fixed period.

Likewise, date alarm coincidence detecting circuit block DT-DET-b compares the month and date data of stored alarm times with the current time day and date. A coincidence signal from this circuit erases the data bit designated as a "connecting mark", which is set high for the hours and minutes data portion of a date alarm. The SRG-STP circuit block 1426 generates an output signal $Q_{STP}$, whose function is to halt the operation of the option unit shift register ring for a period of one minute. During this time, the standard unit functions as if it were not connected to the option unit, and had only a signal alarm time stored within it. $Q_{STP}$ is generated when alarm coincidence is detected, by signal DETAT, or by signal $O_{HAT}$ when an empty alarm data location has been detected. $Q_{STP}$ is reset to the low logic level by input $Q_9$605 ↑ or signal Qϕ3 AT(2). Signal OHAT is generated by gate 1410, when an empty alarm data location occurs. When alarm coincidence occurs for a data alarm time, the month and date portion of this date alarm and the connecting mark are automatically erased by circuitry in the standard unit.

Gate 1410 of OHAT-b is used to detect vacant data storage locations in shift register ring 1490, and send an output signal to the SRG-STOP circuit. Whenever a vacant alarm time data location is generated, either by the wearer setting an alarm time of zero or by alarm coincidence occurring for a temporary alarm, then the hours portion of the corresponding data in the shift register of the standard system is set to zero and the minutes portion is set to "all ones". The reseult is that the display then shows zero hours digits and a blank space in place of the minutes digits. When this data is transmitted to the option unit, it is necessary to reset the "all ones" state of the minutes data to zero, so that no errors will be caused when the "zero alarm time" data is subsequently sent back to the standard system. The "all ones" minutes data is therefore detected by gate 1411, which generates a signal $Q_{HER}$. This is sent to circuit 1405, and resets the minutes data to zero.

Manual shift circuit MAN-SHIFT-c 1420 applies a clock pulse control signal CONTΦ to the clock control block 1408 so as to change the relative synchronization of the shift register ring circuit 1490 and the shift register ring circuit of the standard unit 58. Manual shift circuit 1420 also passes a control command signal MS↑ ② to output control circuit 1402 to permit new alarm time data to be transferred from the option unit to the standard unit under control by signal from terminal MSIN, which is connected to an alarm display shift switch.

Mark set block 1452 is used to set in mark bits which indicate, whether the alarm data to which they are connected is month/day or hours/minutes data. These marks are set in accordance with the number of transitions in the level of the UDII input. The mark set block 1452 also functions to erase the alarm data stored in the option unit when necessary.

Signal MS↑ ① is applied from the manual shift block 1420 to the mark set block 1452 to set the count in a counter used for the abovementioned mark setting to zero.

Figure 28A:
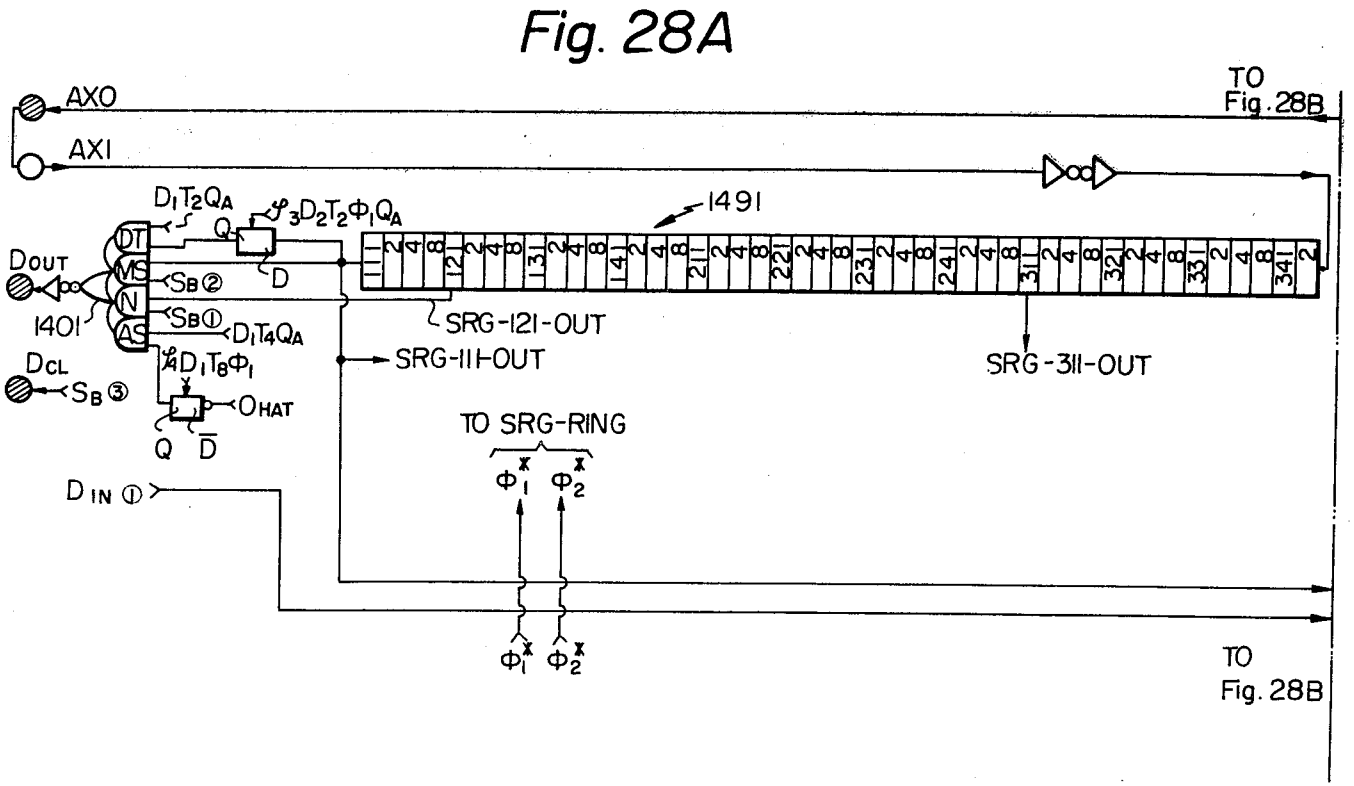
FIGS. 28A and 28B are circuit diagrams of the shift register ring circuit of FIG. 26.
Figure 28B:
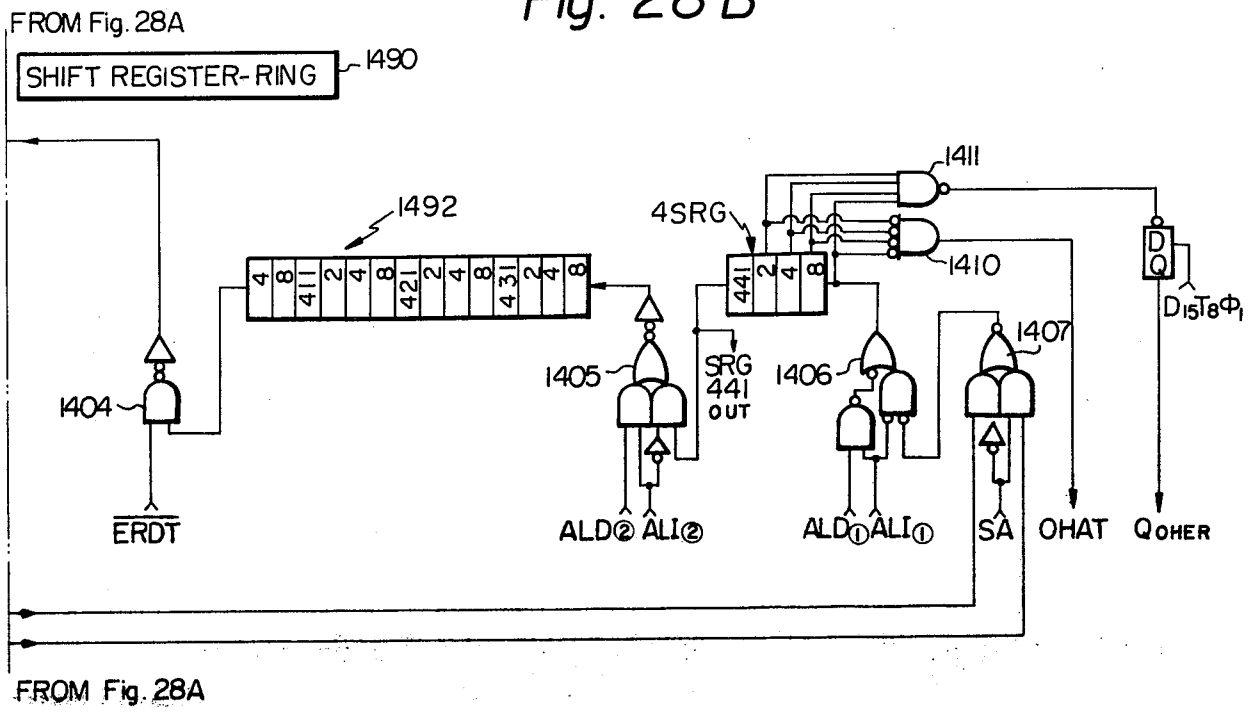
Figure 29:
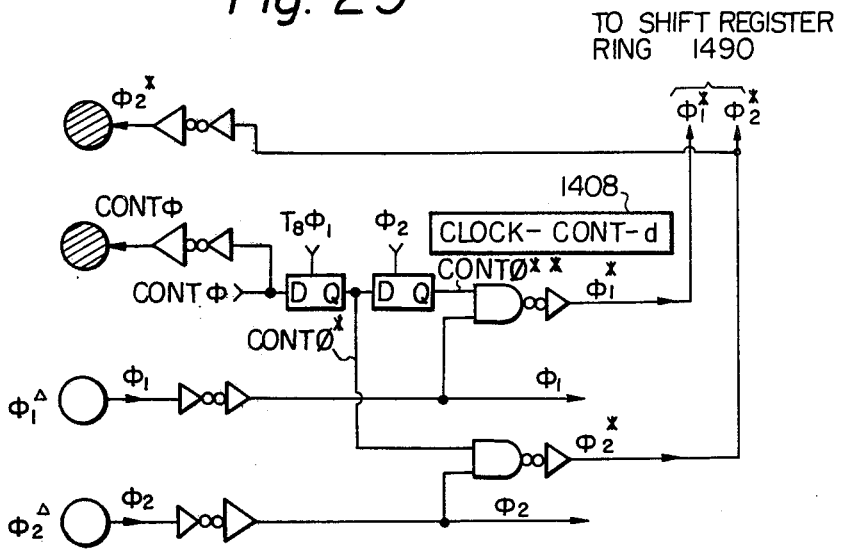
FIG. 29 is an example of a clock pulse control gate shown in FIGS. 27A, 27B and 27C.

An example of the multi alarm option circuit is illustrated in FIGS. 28A and 28B. The shift register ring 1490 at the top of the drawing comprises sixty four data-type flip-flops designated by numerals 111 to 448. The shift register ring is shown as being interrupted at two terminals $Ax_0$ and $Ax_1$. These are provided so that additional shift register stages 1494 may be connected if desired. The terminals $Ax_0$ and $Ax_1$ are directly connected if shift registers 1494 are not used. Output DOUT of the option unit is connected to terminal DATA-IN of the standard system whereas output DCL of the option unit connected to the terminal DATA CL of the standard system. (See FIGS. 11A and 11B) Terminal DATA OUT of the standard system is connected to input terminal DIN of the option unit. Signals designated $\Phi_2$* and CONTΦ are available at output terminals of the option unit, for use in other option units if required. The signals DIN, $\Phi_1$ and $\Phi_2$ will normally be sent in bursts, and this must be borne in mind when examining how the option unit functions in combination with the standard system. The option unit is designed such that it operates irrespective of whether the signal mode is intermittent or continuous. The waveform of, input data signal $D_{IN}$ is reshaped by passage through two inverters in data processing block 1409, then passed to the shift register ring through input gate 1407. Gate 1407 is controlled by control signal SA, produced by data input control block 1403. The input data is written into the shift register ring while SA is high in level. The stored data circulates around the closed ring 1490 of shift registers when SA is low. Data from the shift register ring appears on outputs SRG-111 and SRG-121 either of which can be applied to output terminal DOUT via output control block 1401, whence it is connected to terminal DATA-in of the standard system.

The output gate 1401 has control signals SB① and SB② applied to it, generated by output control block 1402. Referring to FIG. 9 in the description of the standard timekeeping system, it will be seen that the data at work reference timing D16 is designated at mark. The bits of this data word are used to indicate various characteristics of the alarm time data. Bits T1 and T8 indicates AM/PM and daily/temporary alarm time data respectively. If Bit T4 is high, this causes the "alarm set" symbol (indicated as $M_{AL}$ in FIG. 23) to be made visible on the display. If, when the timepiece is in the alarm mode with a multi-alarm option facility, this symbol appears, this indicates to the wearer that the alarm storage location selected already contains alarm data. Accordingly, if it is desired to set in a new alarm time, the manual shift switch must be actuated to select a different alarm time storage location. When a vacant location is selected, the "alarm set" symbol disappears.

In the case of a date alarm, however, it is necessary for there to be two sequential data storage locations vacant, to accommodate the four words of hours-minutes data and the four words of day-date data. Accordingly, in this invention, the circuit is arranged so that when the timepiece is in the date alarm setting mode, then:

(a) If the data location immediately subsequent to the location which has been selected for setting in the hours-minutes of a date alarm is already filled with data, then an indication is given to the wearer that be cannot utilize the location in question for a date alarm. This is done by setting bit T4 in the alarm mark work of the data selected for hours-minutes setting to the high level, causing the "alarm set" symbol to be displayed. This happens even if the location selected is vacant, so that zero hours and blank minutes digits appear on the display.

(b) If the location sebsequent to that selected for hours-minutes setting is vacant, and if the selected location is also vacant, than the "alarm set" symbol will be blanked out, and alarm time zero will be displayed. This indicates that the hours and minutes of a date alarm can now be set in .

For the subsequent date data, the bits of the alarm mark word are set as shown in Table IV, to be explained later. Bits T4 and T8 are set to zero, and T1 and T2 are set high. In this case, bit $T_2$ indicates to the display decoding circuitry that a date alarm is to be displayed, causing the appropriate date symbols to be displayed.

These mark bits are inserted into the alarm time data before it is sent to the standard system, by output control block 1401.

The shift register ring 1490 is driven by clock pulses $\Phi_1$* and $\Phi_2$* applied thereto from the controlled clock pulse generating block 1408. The clock pulses $\Phi_1$* and $\Phi_2$* consist of bursts of the clock pulse trains $\Phi_1$ and $\Phi_2$ supplied from the standard unit, the bursts are timed to control the relative phase relation between data in the shift register ring 1490 and the shift register ring (64 bits) of the standard unit. The passage of the Φ clock pulses is inhibited at the low level of the signal CONTΦ.

The output control signal SB ① generated by the output control block 1402 selects signal SRG-111-OUT as data output by opening gate 1401, when data is transferred from the option unit to the standard system in the normal time display mode. Signal SB ② , generated in manual shift operation when the timepiece is put in the alarm time display mode, selects the SRG 121 stage as the source of output data from the option unit. Signal SB ③ is the logical sum of SB ① and SB ② , and is used in erasing data stored in the shift register ring of the standard system.

Gates 1405 and 1406 connected to shift register ring 1490 are used in setting in the T2 and T4 bits of date alarm mark times, as described previously. Owing to the short duration of the bursts of shift pulses applied to ring 1490, it is necessary to insert these mark bits in semi-parallel form utilizing two gates. Block 1404 is a gate circuit whose function is to erase the month and day data of a date alarm time when date coincidence occurs, at 12.00 midnight when coincidence takes place.

At this stage in the description of the illustrated embodiment, it will be advantageous to give some clarification of the timing relationship between the standard system and the option unit.

When data is transmitted in burst form to the option unit, then it is apparent that the standard system and the option unit cannot operate in synchronism, strictly speaking. The data in the shift register of the standard system circulated 256 times per second, and that in the option unit only 16 times per second. Thus the two sets of data can only be in complete synchronism once in every 16 circulations of the standard unit. Considering the standard system from the option unit, however, since the 15/16 of a second during which the contents of the option unit shift register are static occurs between the end of a $\Phi_1$ clock pulse and the beginning of a $\Phi_2$ clock pulse, there is in effect no loss of synchronism. Because of this fact, it is possible to examine the interaction of the two units as if they were operating completely in synchronism, provided that clock pulses applied to the option unit, and not seconds of absolute time, are used as the units of time.

In the illustrated embodiment, new alarm data stored in the option unit is transferred to the standard unit with the timepiece in the normal current time display condition once in each memory cycle of the option unit, that is, only once in every 16 memory cycles of the standard unit; the standard unit keeps circulating the alarm data thus applied thereto until the next set of data reaches it, that is, for 15 memory cycles. If terminal CONT of the standard unit 203 is grounded, setting it to the high logic level, clock pulses will be delivered from the standard unit in continuous mode, so that the standard unit and the option unit operate in synchronism. This does not alter the operation of the system, however. In other words, the timing relationship between the standard unit and the option unit can be contemplated with the clock pulses as time base units, except for the mark formation in the output control block 1401. Here, bits $D_{16}T_2$ and $D_{16}T_4$ are inserted into the data sent from the option unit to the standard system, continuously. This is independent of whether clock pulses and data are sent from the standard system to the option unit in bursts or continuously. In the standard system, as shown in FIG. 11A, output Q1 data signal is used as a timing reference for the word timing pulse designations.But before this serial data is sent to the option unit as DATA OUT, it passes through shift register stages 64 to 61 in the timekeeping register 64, then through another four shift register stages in delay unit 388 of the data modulation unit (FIG. 20B). There is consequently a delay of eight bit times or two word times between DATA OUT and the output Q1 of the timekeeping register. Because of this, the standard system transfers the data extending from the 1/256 second to the AT MARK data words during the word timing D3 through D16 to D2. This will be made clearer by the timing chart of FIG. 51. Each word time designation for the option unit description corresponds exactly in terms of absolute time with the corresponding word time of the standard system, i.e. D16 of the option system corresponds with D16 of the standard system. It is necessary therefore to pay careful attention to the difference of two word timings between the data circulating in the standard system shift register and the same data input to the option system.

When data is transferred from the option unit to the standard system, therefore is a delay of one word time between the data output from the option unit and the corresponding data circulating in the standard system. Alarm time data is transferred from the option unit to the standard system when signal WATI is high. Logically, $WATI=D_{15}+D_{16}+D_1+D_2$. Data is transferred from the standard unit to the option unit when WATO is high. $WATO=D_{14}+D_{13}+D_{12}+D_{11}$. Thus, both these timings differ from the timing of the output of alarm data from Q1 of the standard system, which is $D_{13}+D_{14}+D_{15}+D_{16}$.

Hereinafter will be described the various modes of data transfer between the standard unit and the option unit.

(1) In the normal time display condition, a new set of alarm data is transferred from the option unit to the standard unit once in every memory cycle of the option unit.

(2) In the alarm setting mode (in which alarm time data is displayed), the shift registers of the standard and option units are, in effect, held in synchronism. The same set of alarm data is then repeatedly transferred from the standard system to the option unit and displayed on the timepiece. Since the same data train is sent to the option unit as to the display unit, and since this data is normally modulated at a low frequency to cause flashing of certain parts of the displayed data, these transfers only take place when synchronizing pulse $\phi_3$ is at the high level. $\phi_3$ has a repetition frequency of 2 Hz, and as shown in FIG. 53, only goes high when display flashing modulation is not being applied.

(3) With the timepiece in the alarm setting mode, with a multi-alarm option facility, it is possible to change the alarm time data being displayed to show all of the alarm times stored in the option unit. This is done by depressing the manual shift switch. This causes the alarm time stored in the standard system to be transferred to the option unit shift register, in synchronism with $\phi_3$. Next, the data in the option unit shift register ring is shifted by four word times with respect to the timing of the standard system and transferred to the standard system once at the timing of MS ②. The two shift register rings are then set back into synchronous circulation in the following memory cycle. Thus, a new set of alarm time data will now be continuously displayed. If the shift switch is held continuously depressed, the above sequence of operations will be repeated, so that a new alarm time is displayed every ½ second.

(4) When the alarm time coincides with the current time in the normal current time display mode data transfer from the option unit to the standard unit is interrupted for 1 minute and, at the end of the 1 minute is resumed.

(5) When the mode of operation is changed from the normal display mode to the alarm setting mode, the stored alarm time data is automatically examined to detect a data location storing an alarm time of zero, i.e. a vacant alarm location. If such a location is found, the zero data in this location is transferred to the standard system, and the shift register ring in the option unit is halted, i.e. data circulation is temporarily stopped. The new set in alarm time data is then transferred from the standard system to the option unit, during synchronization pulse $\phi_3$. This function is provided to enable new alarm times to be set in easily and quickly.

If no vacant alarm location is found, then the automatic search is halted after 0.5 seconds, and the last alarm time set into the timepiece is transferred to the standard system. In this condition, to change the alarm time data displayed, it is necessary to actuate the manual shift switch, which generated signal MSIN. If this switch is depressed for longer than 1 second, then automatic shifting of the alarm data begins, in which the stored alarm times are consecutively displayed at a rate of one per second. This ceases when the shift switch is released.

(6) When the operating mode is returned from alarm display to normal current time display, the alarm data which has been stored in the standard system is first transferred to the option unit, during synchronizing pulse $\phi_3$, then the normal process of sequential transfer of alarm data from the option unit to the standard system begins.

Regarding the provision of additional shift register stages, 1494 on FIG. 27A, where a large number of additional stages are added, it is possible to connect the CONT terminal of the standard system to the unlock, signal UL output. This means that continuous transmission of clock pulses to the option unit only will occur during the setting in of new time data, and that burst transmission will be perfomed at all other times, thereby affording a substantial reduction in operating power.

Furthermore, if a calculator facility is provided, it is possible to supply clock pulses to the calculator unit continuously when a calculation is being performed or data is being input, and send clock pulses in periodic bursts at other times, thereby ensuring a high speed of computation while power consumption is minimal. The ability to transmit and utilize clock pulses either continuously or in bursts makes for unparelleled flexibility in any embodiment incorporating the timekeeping system of this invention.

The operation of various circuit blocks which control the operation of shift register ring 1490 will now be described.

Signal CONT $\Phi$, applied to clock control block 1408 in FIG. 27A, is output as CONT $\Phi^*$ from a first latch circuit in block 1408 at timing T8 $\Phi$1, so that it is delayed by rather less than one word time before it is applied as a gating signal for the $\Phi_2$ pulses. The logic product of CONT $\Phi^*$ and the $\Phi_2$ pulse train is designated $\Phi_2^*$ and contains no transient spikes at the beginning and end of the gating period. The output of the second latch circuit referred to is further delayed by one bit time, and this output is used to gate out timing pulses $\Phi_1^*$. The timing of CONT $\Phi$ must therefore be one word time in advance of the timing for which a burst of $\Phi^*$ clock pulses is required. CONT $\Phi$ is formed in circuit block 1420, the manual shift circuit.

Input terminal MSIN of the manual shift circuit may be connected to terminal SUT or SU2 of the standard system. However in the embodiment described herein MSIN is connected to a switch whose sole function is to shift the display of alarm time data, so that each of the alarm times stored in the option unit may be examined by the wearer. Each time a transition from low to high logic level occurs on MSIN, a manual shift signal of approximately one memory cycle duration is generated, designated MS ① ↑, in synchronism with timing pulse $\phi_3$. Signals MS ② ↑ and MS ③ ↑ are then consecutively generated at intervals of approximately one memory cycle. If terminal MSIN is kept continuously at the high level for more than one second, then the sequence of shift signals MS ① ↑ to MS3 ↑ is repetitively produced at a rate of one per second. This ceases immediately MSIN is returned to the low level.

Figure 51:
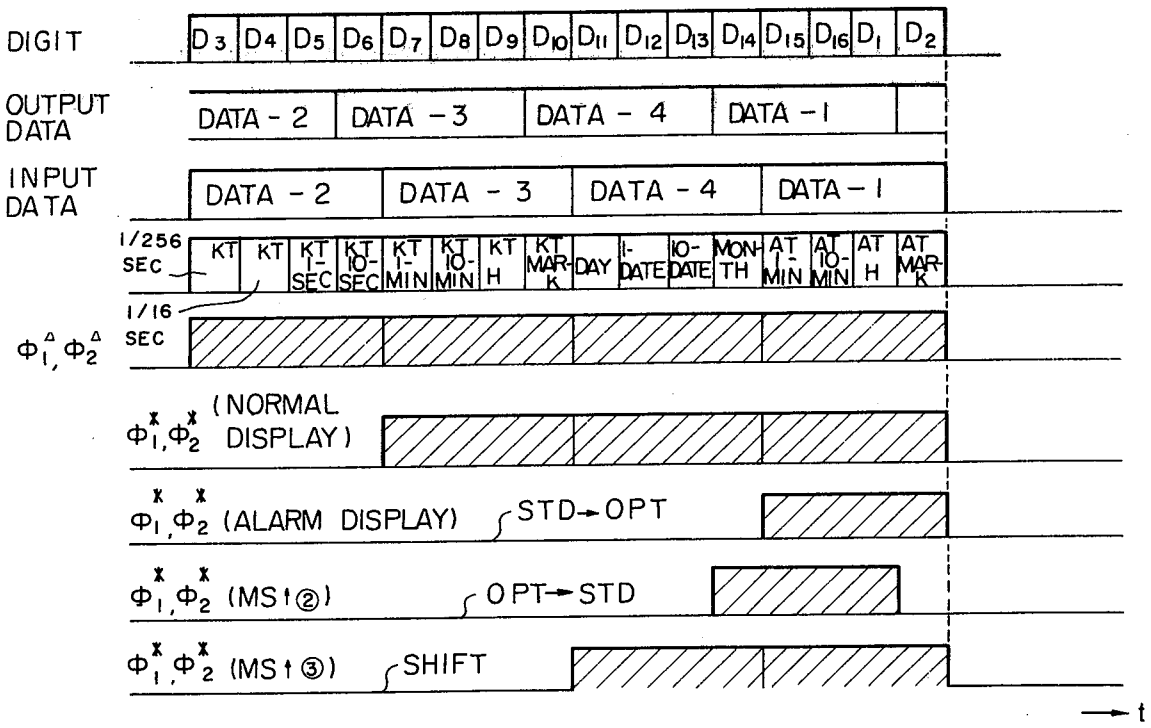
FIG. 51 shows an operating mode of the shift register shown in FIGS. 28A and 28B.
Figure 52:
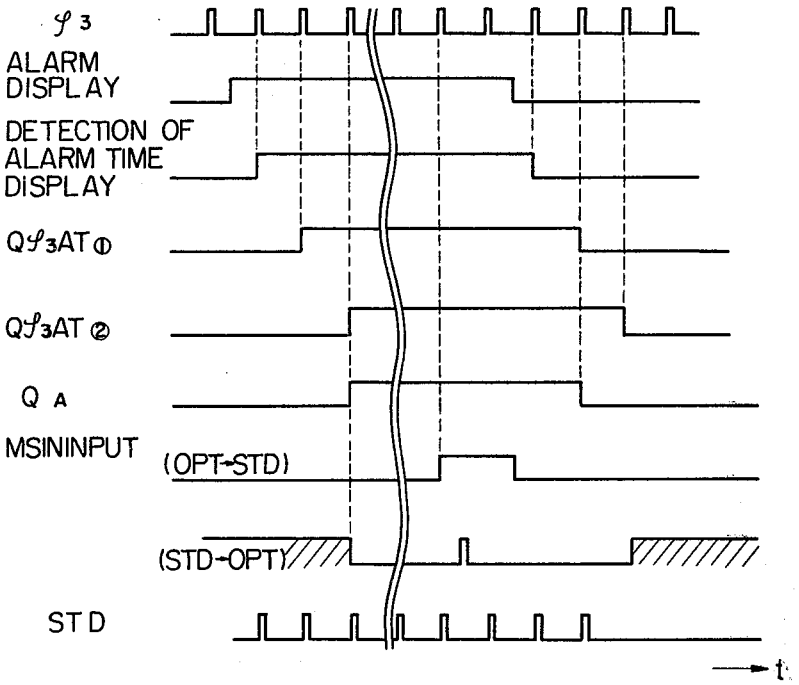
FIG. 52 shows waveforms utilized for the manual shift control circuit shown in FIG. 38.

The timings of the bursts of $\Phi_1^*$ and $\Phi_2^*$ pulses for various operating conditions are indicated by the cross-hatched waveforms shown in FIG. 51. These timings are controlled by clock control block 1408 of FIG. 27A. In the normal time display operating mode, the $\Phi^*$ bursts are output from word time D7 through D16 to D2. In the alarm display mode, they are output from D15 through D16 to D2. When a low-to-high transition of MSIN occurs during the alarm display mode, then in the following memory cycle a $\Phi^*$ burst is output from D14 through D16 to D1. In the memory cycle following that, the clock pulses are output for four word times, from D11 to D2. In the subsequent memory cycles the $\Phi^*$ bursts are again sent from D15 to D2, as long as the alarm display operating mode is continued.

Since signal CONT $\Phi$ must be generated one word time in advance of the clock bursts which it controls, it is generated by word timing pulses whose designating numbers are each one less than the corresponding numbers for the clock pulse bursts. For example CONT $\Phi$ is generated during times D6 to D1 to produce the $\Phi^*$ clock burst fron D7 to D2 in FIG. 51.

Referring again to FIG. 51, the clock pulses applied to the shift register of the option unit in the normal time display mode occur in every memory cycle for a duration of 12 word times, from D7 to D2, whereas the duration of a memory cycle in the standard system is 16 word times. The result of this is that, each time the data in the option unit shift register is shifted and a set of alarm time data sent to the standard system, a new set of data is sent, since the timing offset of four word times between the two shift timing durations corresponds to one set of alarm data. If the mode is changed from the alarm setting to the normal display mode, then the shift register ring of the option unit can be considered as shifting data three times as quickly as in the alarm setting mode. If, therefore, the option unit data is synchronized by the $\phi_3$ pulses in the alarm setting mode, it is also synchronized by the $\phi_3$ pulses in the normal display mode. Thus, in the alarm setting mode, the alarm data in the option and standard systems is held in exact correspondence, and data set into the standard system will be transferred from the standard to the option unit during synchronizing pulse $\phi_3$. If, following the change of operating mode from normal time display to alarm display, a vacant alarm time location is detected by gate 1410, then the option unit shift register circulation is stopped. After data designating a vacant location has been written into the standard system shift register, it is transferred to the option unit, while pulse $\phi_3$ is in the "H" level. Since the repetition frequency of $\phi_3$ is 2 Hz, it follows that correspondence between the alarm data in the standard and option system will be established within 0.5 seconds. Changes in the data transfer paths between the standard and option units can thus take place without affecting the stored data, when the operating mode of the timepiece is changed.

When new alarm time data has been set into the standard system, it is transferred to the option unit every $\phi_3$ signal. When actuating the manual shift switch to cause a low-to-high transition of the MSIN terminal of the manual shift circuit, the succeeding stored alarm time will then be transferred to the standard system and displayed, and may in turn be altered if so desired. The transfer of the newly set alarm time from the standard system to the option unit takes place with timing $D_{15}$ to $D_2$, synchronized by timing pulse $\phi_3$, and the transfer of the succeeding stored alarm time from the option to the standard system takes place from $D_{14}$ to $D_1$ in the following memory cycle of the option unit. In the memory cycle following that, an extra burst of clock pulses, of four word times in duration, is applied to the option unit shift register. The result is that the alarm data in the option unit register is in effect shifted relative to the standard unit shift register data by four word times. In the subsequent memory cycle, the synchronous relationship between the option and standard unit shift registers is restored, but now with a different set of option unit alarm data being in correspondence with that in the standard system. The automatic detection and display of vacant alarm time storage locations described in this embodiment is particularly useful when the number of alarm times which can be stored is extended, by using additional shift register stages as described previously. When the operating mode is changed from normal to alarm display, any vacant alarm location is immediately displayed on the timepiece, so that the wearer can quickly set in a new alarm time if so desired. If all alarm time locations are filled, the wearer can select a time which is no longer required, by actuating the manual shift switch either in the step-by-step or the continuous shift modes. This type of automatic detection of vacant locations is applicable to other types of option units, such as blood pressure measurement and calculator options. The detection process can be actuated by a switch signal generated when operation is changed from the normal time display mode to the particular option unit mode.

MARK-SET block 1452 is used mainly to generate signals to process date alarm data. If terminal YSW, connected to this block, is set to the high level, then date alarm times can be set in, otherwise hours and minutes of alarm times can be simply set. A counter within the MARK-SET block is stepped by input signal UDII, which in the embodiment described herein comes from the SU2 switch terminal of the standard system. Each time a low-to-high transition of the UDII input occurs, the bit timing sequence of outputs ALI ①, and ALI ②, also ALD ② of this block is changed, as shown in TABLE IV below. These signals are used, respectively, to inhibit and set data into gates 1405 and 1406 of shift register ring 1409. The bit input at time D15T4 by ALD ② indicates that a preceding alarm time data is connected to an immediately following date data. Bit D2T2 set in by ALD ① indicates that a symbol indicating date digits should be shown on the timepiece display when this data is displayed.

TABLE IV

| | $D_{15}$ | | | | $D_2$ | | | | |
|---|---|---|---|---|---|---|---|---|---|
| COUNT | $T_1$ | $T_2$ | $T_4$ | $T_8$ | $T_1$ | $T_2$ | $T_4$ | | $T_8$ |
| | | | ALD② | | | ALD① | | | ALD (SHIFT REG. INPUT DATA) |
| 0 | 0 | 0 | 0 | 0 | 0 | 0 | 0 | 0 | |
| 1 | 0 | 0 | 0 | 0 | 0 | 0 | 0 | 0 | |
| 2 | 0 | 0 | 0 | 0 | 0 | 0 | 0 | 0 | |
| 3 | 1 | 1 | 1 | 1 | 1 | 1 | 0 | 0 | |
| | | | ALI② | | | ALI① | | | ALI (SHIFT REG. INPUT DATA ENABLE SIGNAL) |
| 0 | 0 | 0 | 0 | 0 | 0 | 0 | 0 | 0 | |
| 1 | 0 | 0 | 0 | 0 | 0 | 1 | 1 | 0 | |
| 2 | 0 | 0 | 0 | 0 | 0 | 1 | 1 | 0 | |
| 3 | 0 | 0 | 1 | 0 | 0 | 1 | 1 | 0 | |
| | AT MARK OF PRECEDING DATA (HOURS AND MINUTES OF DATE ALARM) | | | | AT MARK OF FOLLOWING DATA (MONTH AND DAY OF DATE ALARM) | | | | |

Note
1:H LEVEL
0:L LEVEL

Clock pulses corresponding to a duration of 4 word times are applied to the shift registers of the option unit during setting of an alarm time. Thus, in order to set mark bits for hours-minutes and months-dates of a date alarm, pulses are applied to gates 1405 and 1406 of shift register 1490 with the timing $D_2$ with respect to the currently displayed alarm time data, and with the timing of $D_{15}$ with respect to the alarm data stored subsequent to this displayed data. The signal QERAT applied to the mark setting block 1452 is used to erase the alarm time data in the option unit which has coincided with the current time in the standard unit. When an alarm time of zero is transferred from the standard unit to the option unit, the data corresponding to the 1-min. and 10 -min. digits will be set to "all ones" state, to cause display blanking of the minutes digits. The signal QOHER resets these minutes data bits to the zero state.

Figure 36:
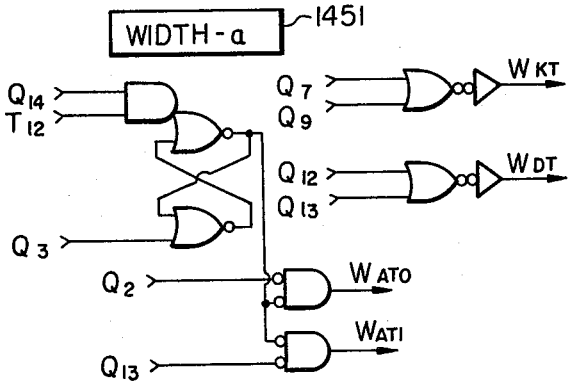
FIG. 36 shows an example of a composite pulse generator.

Circuit block 1451 in FIG. 36 generates signals for determining the widths of the control signals used for data transfer between the option unit and the standard unit. As viewed in the circuit example of FIG. 36, signals WATO and WATI are produced with timings of from $D_{14}$ and from $D_{15}$ to $D_2$, respectively, and are only when clock pulses are applied from the standard unit. Signals WKT and WDT, on the other hand, designate the timings at which data are transferred from the standard unit to the option unit and are derived from a composite digit pulse which is in turn synthesized from boost continuous pulseses $\Phi UC_1$ and $\Phi UC_2$. Thus, the signals WKT and WDT are free from the influence of intermittent clock pulses. These signals WKT and WDT are respectively used in the continuous form since no problems are raised from the viewpoint of circuit design.

Circuit block 1427 detects whether the timpiece is in the alarm display mode, and generates control signals when this mode is detected. Input signal $D_D$ is high during word time $D_{14}$ in the alarm display mode, whereas it is high during time $D_6$ in the normal time display mode. All changes in the condition of data transfer between the standard and option units must take place during a $\phi_3$ pulse, as explained previously. The alarm display mode is therefore detected by applying the $D_D$ signal to a latch circuit to which a clock input $\phi_3 D_{14} T_8 \Phi_1$ is applied. The output is latched into another latch circuit at time $\phi_3 D_3 T_8 \Phi_1$. The output of the second latch is designated $Q\phi_3AT$ ①. This signal is applied to another latch circuit, and read out at time $\phi_3 D_3 T_4 \Phi_1$ with the designation $Q\phi_3AT$ ②. This signal lags $Q\phi_3AT$ ① by 0.5 seconds. These two signals are combined to form a logical product QA. These three signals $Q\phi_3AT$ ①, $Q\phi_3AT$ ②, and QA are used to cause the transition from the current time display mode to the alarm time display mode to be completed within 0.5 seconds after it is initiated by the wearer, with no transient effects on the stored data.

Circuit block 1429 detects the condition of display of normal current time, and outputs corresponding control signals, in precisely the same way as for the alarm display detection, the only difference being in the timing.

In circuit block 1425, coincidence between any of the alarm times stored in the option unit and the current time from the standard system is detected. Upon coincidence, this circuit 1425 generates a signal to erase the alarm data itself during the same memory cycle.

Figure 42:
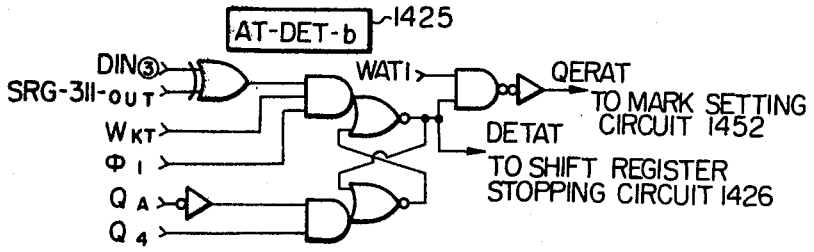
FIG. 42 shows an example of an alarm time and current time coincidence detecting circuit.

To do this, it is necessary to perform the comparison and erasure of the data during D15 to D2. Referring to FIG. 42, it will be seen that the comparison is performed by applying the standard system data DIN ③ and option unit data SRG-311-OUT to an exclusive-OR gate, whose output is applied to the reset input of a bistable, during timing WKT, which is D7 to D10. This bistable is set by input $Q4.Q_A$. If alarm coincidence occurs, the bistable will not be reset. In this case a logic product of the bistable output and signal WAT1, which has timing D15 to D2, is generated as QERAT, and applied to a gate in block 1452 to cause alarm time data erasure.

Figure 43:
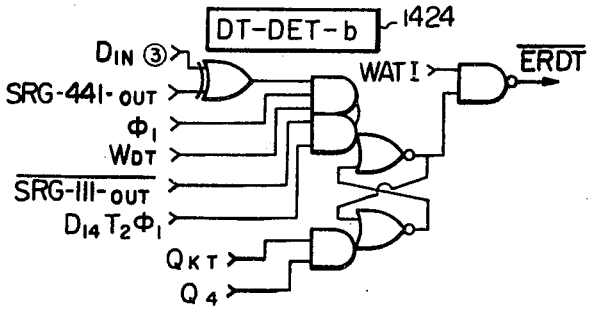
FIG. 43 shows an example of a date alarm and date coincidence detecting circuit.

The month-day date alarm data detecting block 1424 is essentially similar to alarm coincidence detector 1425. However, since the $T_2$ bit of the date mark word in the day-date alarm data is set high, it is necessary to detect this date mark bit also, by ensuring that an alarm coincidence output is only generated when the logical product of $\overline{SRG\text{-}111}$ OUT.$D_{14}T_2\Phi_1$ is low, as shown in FIG. 43. The output of the block 1424 is used to erase the day-date alarm data.

In addition, the bits $T_4$ and $T_8$ of the connected alarm time data, immediately following, which have been set high to indicate that this data is the hours-minutes portion of the date alarm are also erased to zero. This alarm data is now in the same form as any other simple hours-minutes alarm time, and coincidence with current time will later be detected when it occurs that day.

It should be noted that, since bit $T_2$ of the mark word in the day-date portion of a date alarm is set high, and bit $T_4$ of the hours-minutes portion of a date alarm is also set high, this data can never concide with the current time sent from the standard system, since these two bits are always zero in the mark word of the current time hours-minutes data.

Circuit block 1426 contains a bistable circuit, which can be set for a period of one minute, causing shifting of data in the option unit shift register to be stopped for the same period. When the bistable is reset, circulation of data in the register 1490 is again resumed. The bistable is set under two possible detection conditions. The first is, if a vacant alarm data location is detected by the automatic search process when a wearer demands alarm time display. In this case, the bistable is subsequently reset by signal $Q\phi_3AT$ ②. The second case occurs when an alarm coincidence is detected in the normal current time display mode. In this case, setting is actuated by signal DETAT from block 1425, at timing $D_{10}T_8\Phi_2$. The high level output of the bistable is read out from a latch circuit at timing $D_3T_8\Phi_1$ in the following memory cycle of the option unit, and the output signal QSTP is applied to the manual shift block 1420 to stop the shift operation of the shift register 1490. The bistable in block 1426 is reset one minute later by signal $Q_9$6OS ↑ sent from circuit block 1483, and the shift register 1490 starts shift operation.

The data demodulator block 1409 processes the input data from the standard unit in several ways. Data output DIN ① is identical to data input DIN, after waveform reshaping. Data output DIN ③ is applied to the alarm coincidence detection circuits previously described, and for this purpose it is necessary to set bits $T_2$, $T_4$ and $T_8$ of the mark word in the current time portion of the data to zero. This is done as shown in FIG. 30, by inhibiting the flow of data through a gate during word time D10, except for bit $T_1$, which corresponds to the AM/PM data of the current time.

Output DIN ② only goes to the high level when the current time display state is detected. It is applied to the circuits used for automatic gain/ loss adjustment, to be described later, to prevent any errors being caused in the date gate counter of these circuits, when setting in of data takes place.

Figure 30:
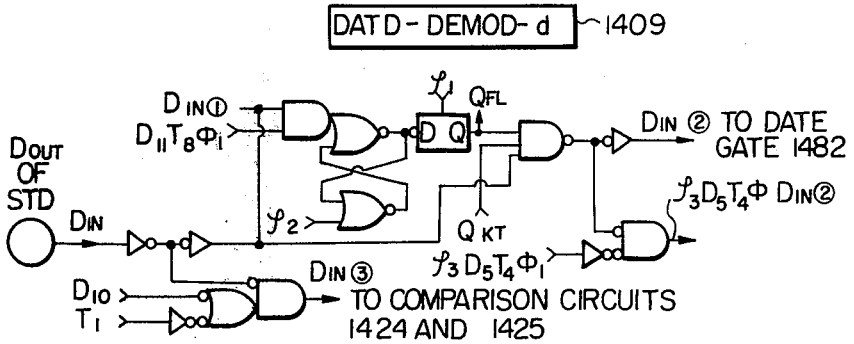
FIG. 30 is a preferred example of a data demodulating circuit shown in FIGS. 27A, 27B and 27C.
Figure 31:
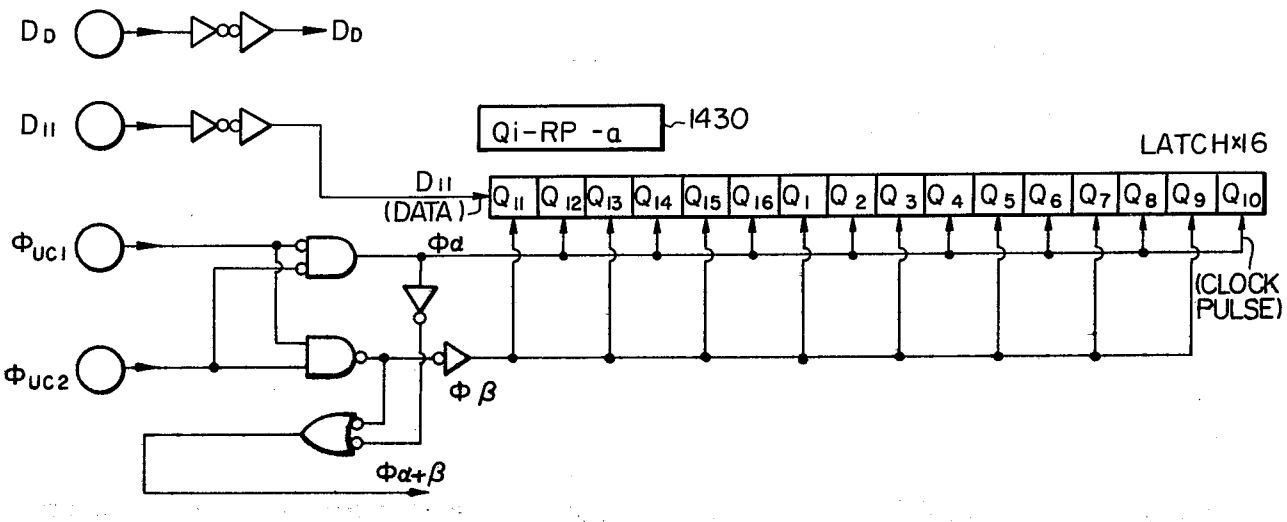
FIG. 31 is an example of a composite pulse regenerating circuit.
Figure 37:
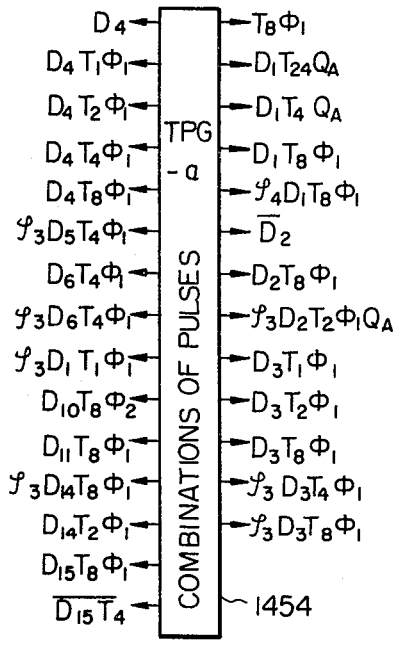
FIG. 37 shows a combined signal generator.

Also in FIG. 30, the AND product $D_{IN}$ ①.$D_{11}T_8\Phi_1$ goes to the high level when bit $T_8$ of the days-of-week data word goes to the high level. In the normal current time display mode, the days-of-week data display is made flashing by a data modulation circuit in the standard system. When this flashing data of a day of the week is transferred to the option unit, high level of $Q_{FL}\cdot U_{DII}$ indicated that the timepiece is in the normal time display mode.

The relationship between the timings of the pulses $\phi_1$, $\phi_2$ and $\phi_3$ is shown in FIG. 53.

Figure 46:
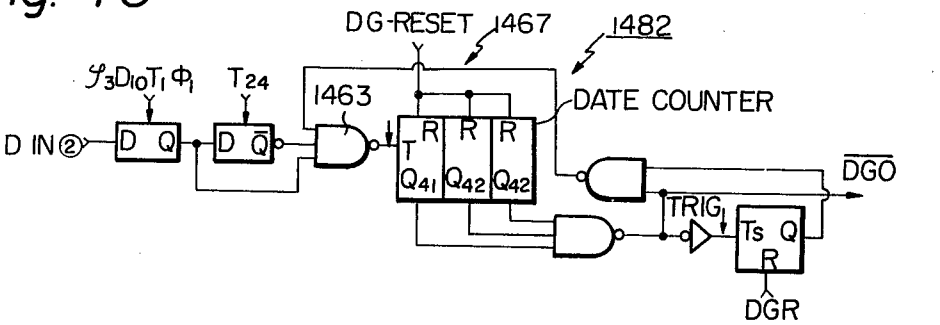
FIG. 46 shows an example of a date gate control circuit.
Figure 54:
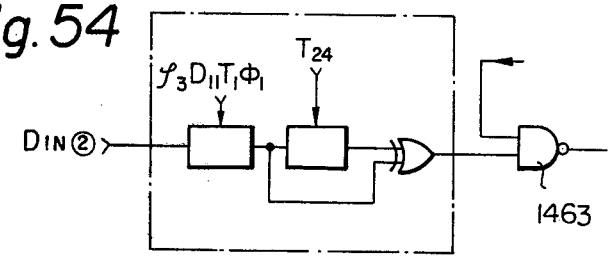
FIG. 54 shows a modification of the date gate counter shown in FIG. 46.
Figure 55:
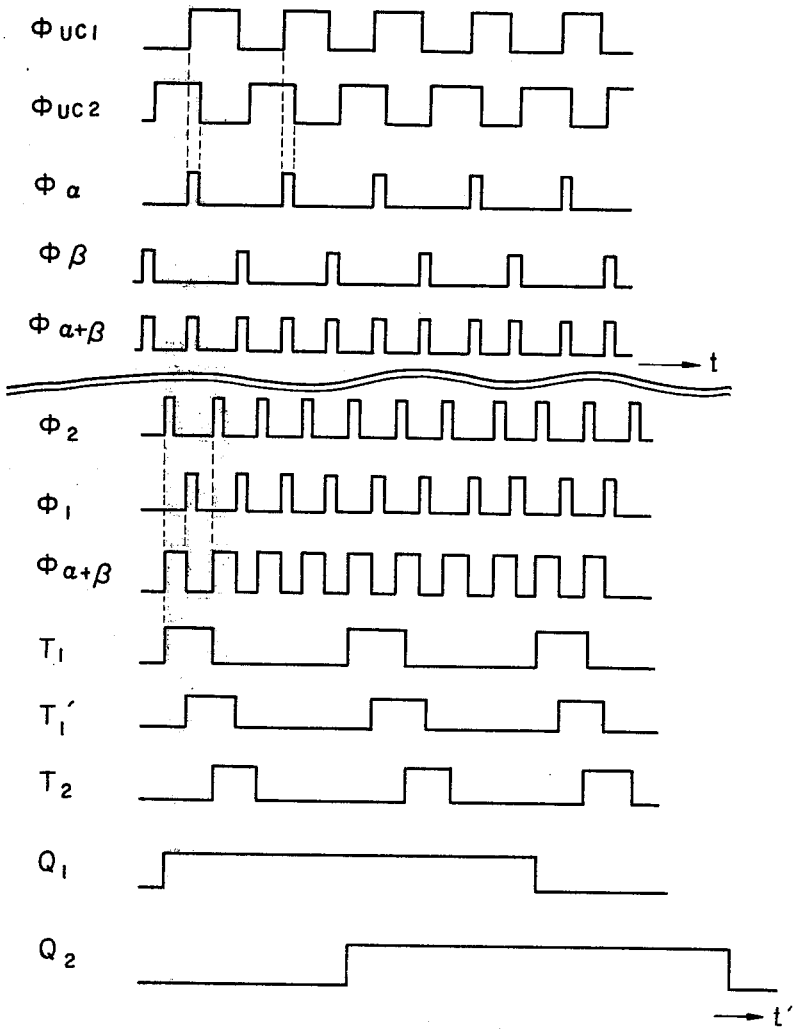
FIG. 55 shows the relationship between various timing signals.

If desired, the circuit shown in FIG. 54 may be used an alternative arrangement for the gate 1463 shown in FIG. 46. Circuit block 1430, labelled Qi-RP-a, is used to generate composite timing signals $Q_1$ to $Q_{16}$, each of which has a duration of two word times and has the relation to the word time of the same numbering designation: $Q_i = D_i + D_{i+1}$, where i is an integer from 1 to 16.

These Q pulses are produced based on the fact that signal $\Phi UC_1$ is the logical sum of the word pulses $D_1$ to $D_{16}$, and that $\Phi UC_2$ lags $\Phi UC_1$ by a period equal to the phase difference between clock pulses $\Phi_1$ and $\Phi_2$. Two sets of clock pulses, $\Phi\alpha = \Phi UC_1 \cdot \overline{\Phi UC_2}$, and $\Phi\beta = \Phi UC_1 \cdot \Phi UC_2$ are therefore applied to shift a synchronizing timing word input $D_{11}$ along a set of latch circuits which output signals $Q_1$ to $Q_{16}$.

Figure 48:
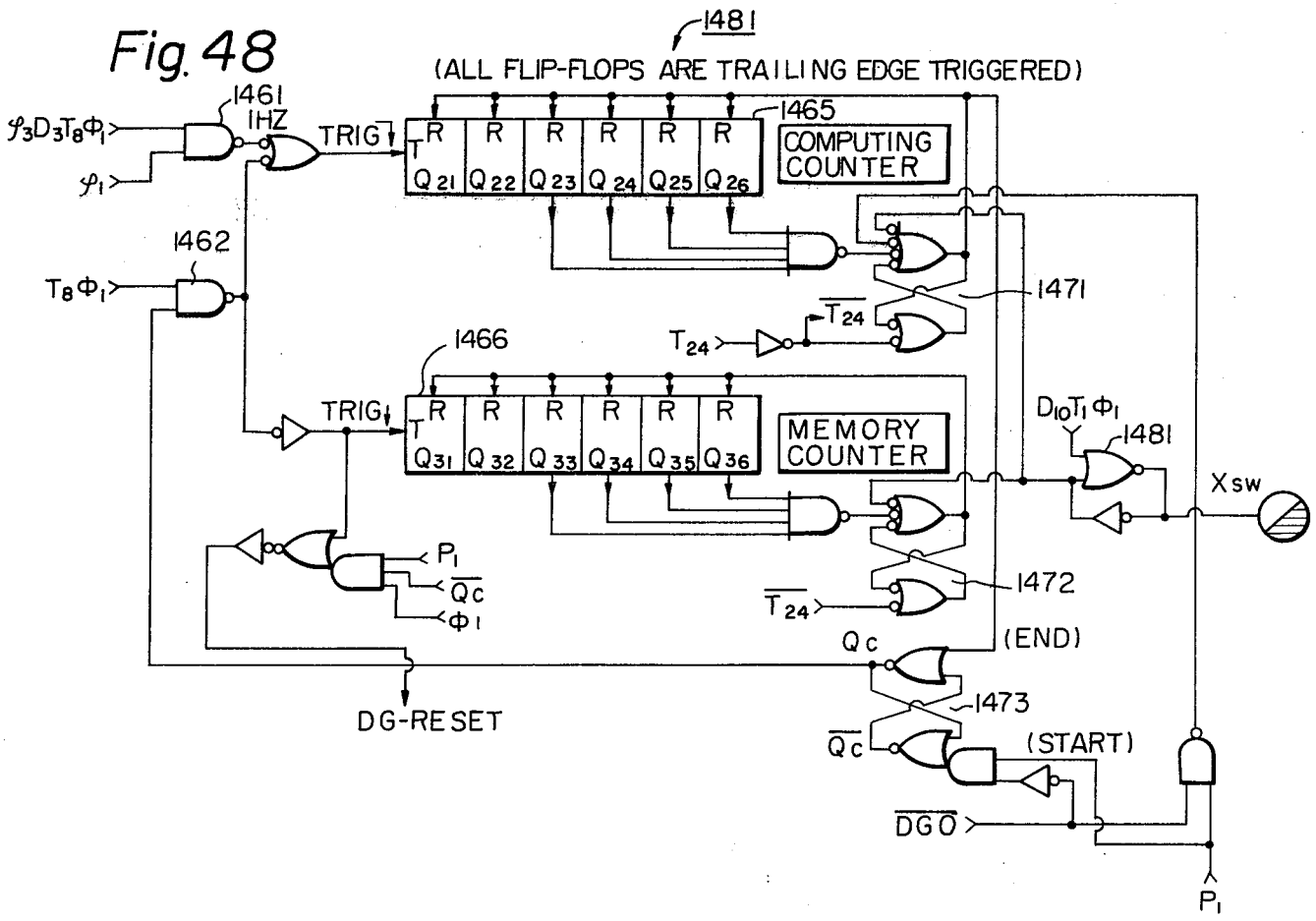
FIG. 48 shows an example of a calculating circuit.
Figure 56:
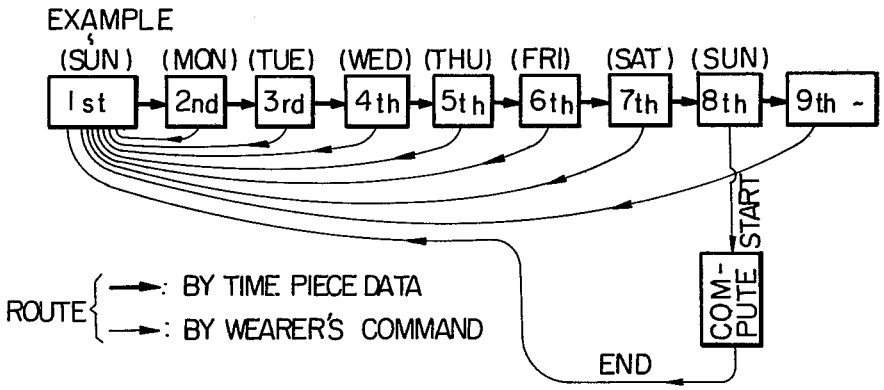
FIG. 56 is a schematic diagram illustrating modes of transferring data.

As previously mentioned, shift register stages 1494 may be added to extend the number of alarm times which may be stored, if desired. Designated as 1480 is the automatic gain/loss adjustment section, consisting of circuit blocks 1481, 1482, 1483 and 1484. Block 1482 is the date gate circuit. This contains a divide-by-eight counter which is used to perform a count from 0 to 7 days, i.e. one week, since the gain/loss calculation is performed over a period of one week. When the wearer initiates a gain/loss calculation, this counter is reset to zero at just "0" second of the current time. Thereafter it begins to count the number of days elapsed, by the input $D_{IN}$ ②. If the day on which the calculation was initiated is designated the first day, then on the eighth day following this (when the date gate counter has attained a count of 7), a gate is opened, as shown in FIG. 48 by output DGO from the date counter. Thus, when the wearer generates a UDII signal on the eighth day by depressing the appropriate switch, at precisely the "0" second of the current time on the eighth day (in response to, say, a broadcast time signal or a telephone service time information), the calculation of time for gain/loss adjustment during the preceding week will be completed and an error compensating signal generated. If the switch is depressed before or after the eighth day, then the date counter is simply reset to zero, and the calculation process begins once more. This process is illustrated in FIG. 56, where the broad arrows indicate the counter being advanced once per day by the current time data, and the narrows indicate the step changes in count caused by switch actuations.

Figure 57:
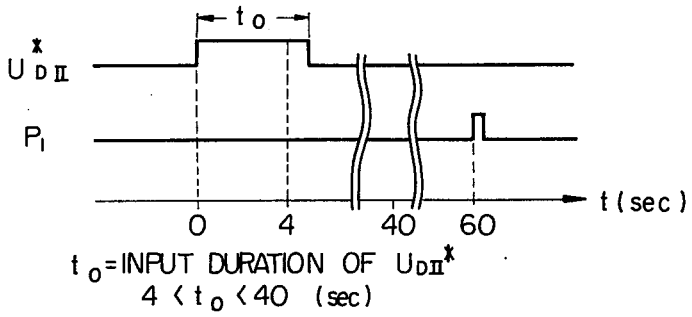
FIG. 57 shows the relationship between various pulses used in the option system according to the present invention.

In order to generate the signals which initiate and, after one week in reliable input operation mode, complete the gain/loss adjustment calculation process, the wearer must depress a switch in such a mode depressing (generating signal UDII) for more than 4 seconds and also less than 40 seconds, each time. This input condition is detected by identification gate circuit 1483. If the switch is depressed for a time duration within these limits, signal $P_1$ is output from circuit 1483 exactly one minute after the switch is first depressed. FIG. 57 shows the relationship between signal $P_1$ and switch input signal UDII.

Circuit block 1481 contains a divide-by-60 counter 1481K, whose count is held constant during the week in which the gain/loss calculation is performed, and another divide-by-60 counter 1481C which counts the units of seconds data of the kept time. Counter 1481C and the seconds count of the current time data kept in the register 58 in FIG. 3 are both reset to zero when the gain/loss calculation is initiated. Thus, at the end of exactly one week, when the count of seconds for current time reaches zero, the count attained by 1481C, if other than zero, represents the time gain or loss in seconds over the one week calculation period. As a result, the count of the counter 1481 K is added to the count of the counter 1481C subtracted from the initial count stored within it in a week. The outputs of counter 1481K, $Q_{31}$ to $Q_{36}$, serve to control the production of error-correction feedback pulses FSO, which are applied to the timing pulse generator circuits of the standard system. A change of +1 in the count of 1481K causes the standard timekeeping system to gain an additional one second per week. To subtract the count in 1481C from the count in 1481K, a gate is opened at the completion of the calculation period, by pulse $P_1$, which causes a high-frequency pulse train of $T_{8\Phi}$ to be simultaneously applied to the inputs of both counters. 1481C is thereby rapidly incremented until it reaches the zero count state. This is detected, and causes the input pulse train to be cut off, leaving counter 1481K with its initial count minus the initial count of 1481C.

The circuit 1484 generates feed-back pulses at a rate depending on the count in the counter 1481K. The feed-back signal is formed by combining existing timing pulses without using a frequency divider.

Assuming that the following logical relationships are true:

$$\overline{8}\,Hz\uparrow = B,$$

$$\phi_2.\overline{T}_{12}.T_{24}.Q_{16}.Q_1.\Phi_1(\equiv B\phi_2 D_1 T_4 \Phi_1) = F_1$$

$$\phi_2.T_{24}.Q_{10}.Q_{11}.\Phi_1(\equiv B\phi_2 D_{11}(T_2+T_4)\Phi_1) = F_2$$

$$\phi_2.\overline{Q}_{11}.Q_{10}.\Phi_1(\equiv B\phi_2 D_{10}(T_1+T_2+T_4+T_8)\Phi_1) = F_4$$

$$T_{12}.T_{24}.Q_{16}.Q_1.\Phi_1(\equiv BD_1 T_2 \Phi_1) = F_8$$

$$T_{24}.Q_{16}.\overline{Q}_1.\Phi_1(\equiv BD_{16}(T_2+T_4)\Phi_1) = F_{16}$$

$$\overline{\phi}_2.\overline{Q}_{16}.Q_1.\Phi_1 (\equiv D_2(T_1+T_2+T_4+T_8)\Phi_1.\overline{\phi}_2.B) = F_{32}$$

and that the frequency of the signal FSO is fso and that of the signal $F_{S1}$ is 0 Hz, then $F_1$: 1 Hz
$F_2$: 2 Hz
$F_4$: 4 Hz
$F_8$: 8 Hz
$F_{16}$: 16 Hz
$F_{32}$: 28 Hz Since the logical product of any two of the signals $F_1$ to $F_{32}$ is at a low level, frequency addition is possible when they are added logically through an OR gate. The mean frequency fso of the signals Fso is expressed as:

$$fso = 1/20(2^0.Q_{31} + 2^1.Q_{32} + 2^2.Q_{33} + 2^3.Q_{34} + 2^4.Q_{35} + 28.\overline{Q_{36}})(Hz)$$

where $Q_{31}$ to $\overline{Q_{36}}$ are either 0 or 1.

Addition of 1/20 Hz to the 32K Hz timekeeping clock frequency makes it possible to causes a gain in time of about 1 sec. in a week, which means that the present system can compensate the weekly gain/loss error to less than 1 second.

The counts 33 to 59 in the counter 1465 can be used to designate the values −27 to −1 if the weight of the signal $Q_{36}$ is not 32 but −28. Since the low level of $Q_{36}$ indicates zero, the counts 0 to 59 in the counter 1465 can be used as 0 to 31 and −28 to −1. Thus, output $F_{32}$ is 28 Hz when signal $Q_{36}$ is at the low level.

Figures 49, 50:
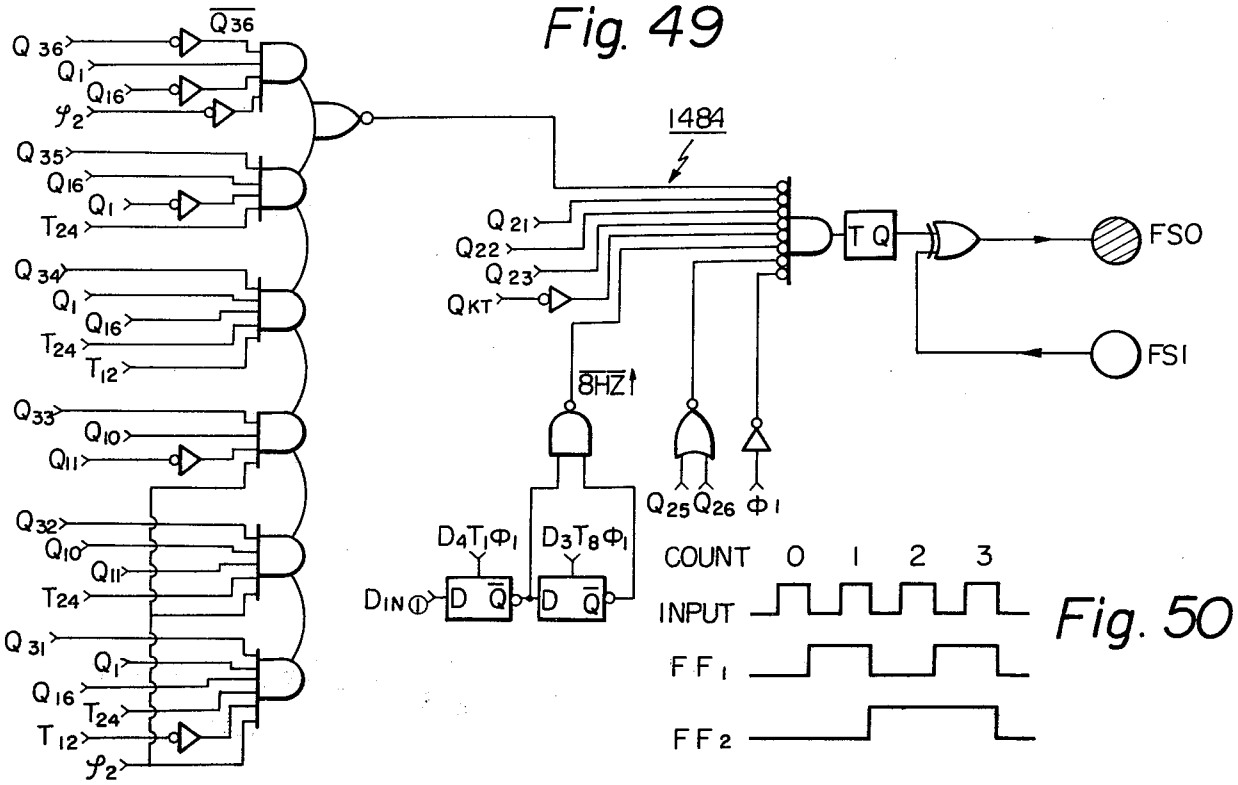
FIG. 49 shows an example of a gain/loss adjusting pulse generator.
FIG. 50 shows waveforms of a bistable circuit used in the option system according to the present invention.

Since part of the AND terms applied to gate 1484 in FIG. 49 is the combination $\overline{Q}_{21}.\overline{Q}_{22}.\overline{Q}_{23}.\overline{Q}_{KT}.(Q_{25}+Q_{26})$, which goes to the high level only for 6 seconds in every 60 seconds, gate 1484 effectively divides the frequencies applied to it by a factor of ten. The signals B and $\phi_2$ have a common 1 memory cycle width and rise in synchronism although the frequency of the B signal is 8 Hz and that of the $\phi_2$ signal is 1 Hz. Thus, if the signal $\phi_2$ is added as a term of a logical product to the input of gate 1484 in FIG. 49, it is easy to provide division of the input frequency signals to this gate by the ratio $\frac{7}{8}$.

In the following, details will be given of the operation of the various circuit blocks of the option unit shown in FIGS. 28A, B and C.

Referring to FIGS. 28A and B, details are shown of the shift register ring 1490 and associated gates. The shift register has 64 stages, identified by the numerals 111, 112, 114, 118, 121, 122 . . . , 448. The shift register is driven by periodic bursts of clock pulses. The period between each burst begins after a $\Phi_1$ phase clock pulse, and ends with the application of a $\Phi_2$ clock pulse. Each stage of the shift register ring consists of a master-slave data type bistable, consisting of a master latch circuit of dynamic type (in the sense that data written in by one clock pulse must be read out within a limited time by another clock pulse), and a static type slave latch circuit. Shift register ring 1490 is equipped with a number of input and output terminals, to enable data to be processed in a semi-parallel form, during the time intervals in which the clock pulse bursts are applied.

While the alarm time stored in the standard system is being applied to the option unit, during word timing $D_{15}$ to $D_2$, another set of alarm data is read out of shift register 1490 output terminal SRG-111. The data from the standard system is delivered to the option unit during synchronizing pulse $\phi_3$, as described previously. The $\phi_3$ pulses have a duration of one memory cycle, and a repetition rate of 2 Hz.

With the timepiece set to the alarm time display mode, each time a manual shift operation is actuated an alarm time, consisting of four data words, is transferred from the standard system to the option unit. Then, in the following memory cycle, a new set of alarm data is transferred from the option unit shift register to the standard unit. For each of these operations, a burst of clock pulses of four word times in duration is applied to the 1490 shift register ring. For the first of these transfers (referring to timing chart FIG. 51), the burst is from word time $D_{15}$ to $D_2$, and for the second transfer, from $D_{14}$ to $D_1$. For the first transfer, i.e. from the standard to the option unit, gating control in the option unit is by signal SA (from circuit block 1403 in FIG. 27B) going high. For the second transfer, from option to standard system, control is by signal SB2 generated by circuit block 1402 in FIG. 27B. SB2 is generated in response to signal MS(2) from manual shift block 1420.

In the normal operating condition of displaying current time, bursts of clock pulses of 12 word times in duration, from $D_7$ to $D_2$, are applied to shift register 1490. During each burst, four words of alarm time data are transferred from the option to the standard system input terminal DIN. Since this output data must be in advance of the alarm time being transferred from the standard system to the option unit in the same memory cycle, by one word time, it is transferred from output SRG-121 of 1490.

The current time hours and minutes data is input to the option system during timing $D_7$ to $D_{10}$. Alarm coincidence for this data is detected in block 1425, by applying shift register output SRG-311 to this block together with the current time data input DIN ③. Coincidence of hours and minutes data causes output QERAT to be generated by block 1425, which is applied to MARK-SET block 1452 generating signal ALI ①. This in turn is applied to gate 1406 of the shift register ring 1490, causing erasure of the alarm time data for which coincidence has been detected. This erasure is performed during time $D_{15}$ to $D_2$.

The month and date data of current time kept in the standard system are delivered to the option unit during word times $D_{12}$ to $D_{14}$. This data differs in phase from the date data of any date alarm time output from SRG111 during the same time, by one word time. To perform a comparison to detect coincidence of a date alarm time and the current date, therefore, output SRG-441 of shift register 1490 is applied to the date alarm time coincidence detection block 1424. On coincidence, signal $\overline{\text{ERDT}}$ is generated, which is applied to gate 1404 of the shift register ring, causing erasure of the month and date alarm time data for which coincidence has been detected.

It should be noted that the positioning of gate 1404 at the output of stage 441 is important. As previously explained, the $T_2$ bit of the alarm mark word for date-month alarm data is set high, as is bit $T_4$ in the alarm mark word of the hours-minutes data immediately following it, thereby indicating that the two sets of alarm data are connected. With the arrangement shown, when date data erasure takes place, the $T_2$ mark bit of the date data, and the $T_4$ mark bit of the following time data are both erased to zero, together with the days-month data. The hours-minutes data of the date alarm has therefore been converted into the same format as any other hours-minutes alarm time, and can therefore be detected for alarm coincidence. When coincidence occurs, this data also will be erased.

When a data alarm time is set into the timepiece, gates 1405 and 1406 of the shift register ring 1490 are used to insert the appropriate mark bits into the stored data. Referring to Table IV, described previously, the "COUNT" column indicates the number of transitions of the UDII signal input to the counter of the MARK-SET circuit shown in FIG. 39. Inhibit signals ALI ① and ALI ② function to clear the bit locations of the data into which date alarm mark bits have to be inserted. On the fourth transition of the UDII signal (i.e. the fourth time the wearer depresses a corresponding switch), the bit codings for word times $D_{15}$ and $D_2$ shown in Table IV are generated. Thus, high levels are set in for bit times $T_2$ and $T_4$ of the mark words for alarm time day-month data and the connected hour-minute data, respectively, by ALD ① and ALD ② applied to gates 1406 and 1405, respectively. (The corresponding bit locations having been set to zero immediately beforehand by signals ALI ① and ALI ②). Any alarm time data set in under this condition is thereby stored as a date alarm.

The shift register ring 1490 also has a gate 1410 which is adapted to detect the zero digit of the alarm data in the option system. This gate 1410 thus generates an output signal OHAT indicating that the hours digit of the alarm data is zero, i.e., a vacant address. If the output OHAT of the gate 1410 is read out at the timing of $\phi_4 D_1 T_8 \Phi_1$, it is possible to detect that the shift register for the second alarm data is vacant. The gate circuit 1401 has a gate for the mark display, which gates mark signal at the timing of $D_1 T_4 Q_A$. When the following alarm time is set and stored in the shift register, an alarm mark setting signal is delivered to the display device to display the alarm setting mark. The gate circuit 1401 also has a gate to which the timing signal $D_1 T_{24} Q_A$ is applied to detect the date setting mark. An output is generated at the timing of $D_1 T_{24} Q_A$ and delivered to the display device of the electronic time piece thereby to display the date mark indicating that the date setting alarm is set.

The data applied to input terminal $D_{IN}$ of the standard system at timings $D_1 T_2$ and $D_1 T_4$ is normally erased by gate 66 of the timekeeping register 32 (see FIGS. 11A and 11B). However, it is possible to control the functions and display mode of the electronic time piece by preventing this erasure, and continuously supplying timing signals $D_1 T_4$ or $D_1 T_2$, thereby inhibiting the detection of coincidence between the current time and the alarm time, or the timing signal $D_1 T_2$ for the display of date indicating marks etc. to the $D_{IN}$ input.

Gate 1411 serves to detect the state all ones i.e., (1,1,1,1) of the minutes of an alarm time to eliminate the malfunction of the display generating by an output signal QOHER to erase the all ones state before the data is stored in the option system. In the event that alarm time is being displayed on the timepiece and the alarm data whose contents are displayed is "vacant", then the hours digit of the display shows "0", and the minutes data is shown "blank". This is caused by setting the minutes data to the binary code "1,1,1,1". The data is delivered back to the shift register of the option system in this form. Subsequently, when this particular data is delivered back to the timekeeping register, if not erased, a carry condition will be detected, causing the ten minutes data to be carried to the hours data by gate 68 of time keeping register 32, so that the hours digit of the alarm time changes from "0" hours to "1" hour. The output signal QOHER from the gate 1411 is utilized to erase the "all ones" state of the minutes portion of "vacant" alarm data locations in the option system. This is performed by gate 1404, in response to an inverted signal supplied from the mark setting circuit 1452 generated by signal QOHER.

FIG. 30 illustrates an example of circuitry for data demodulating circuit 1409. An even number of inverters in this circuit serve to reshape the waveform of the input data, providing output signal $D_{IN}$ ① which is applied to various parts of the option system such as gate 1407, timing pulse generator 1454 and frequency adjusting circuit 1484. The demodulating circuit 1409 is arranged to detect the condition in which the days of week data is being modulated to cause display flashing, and generate an output signal $Q_{FL}$. This signal is applied to an AND gate, which generates an output $D_{IN}$ ② when current time is being displayed and the days of week display is flashing. This output signal $D_{IN}$ ② is applied to the date gate 1482 so that the automatic adjustment of gain/loss is not adversely affected during setting of the days of the week. The data demodulating circuit 1409 also generates an output signal $D_{IN}$ ③ by erasing the $D_{10}T_2$ to $D_{10}T_8$ bits of the output $D_{IN}$ ①. Since these bits are only set high in the alarm mark words of the alarm time data, and are always zero in the current time data, they must be reset before a comparison can be made between alarm time and current time for alarm coincidence. Output $D_{IN}$ ③ is therefore applied to comparison circuits 1425 and 1426.

Figure 32:
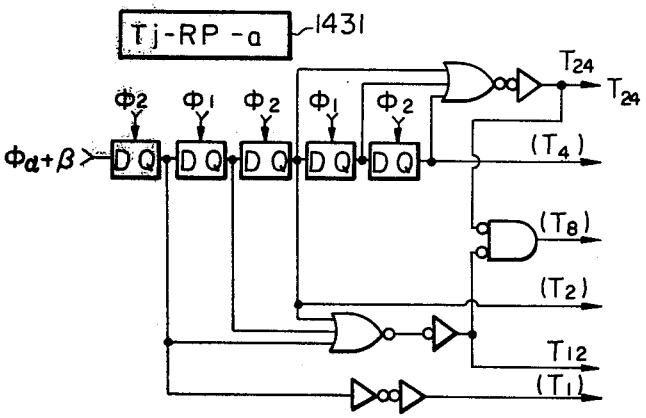
FIG. 32 is an example of a timing pulse regenerating circuit shown in FIGS. 27A, 27B and 27C.

FIG. 32 shows an example of a detail circuitry for the timing pulse regenerating circuit 1431. If the clock pulses $\Phi_1$ and $\Phi_2$ are in burst form, the output signals of the latches are affected so that the timing pulses $T_1$, $T_2$, $T_4$, $T_8$, $T_{12}$ and $T_{24}$ are output as burst signals, which rise and fall in synchronism with the $\Phi_2$ clock pulses. The timing pulse $T_{12}$ is the logical sum of the timing pulses $T_1+T_2$, and the timing pulse $T_{24}$ is the logical sum of the timing pulses $T_2+T_4$. Since there is a gap between the fall of the timing pulse $T_1$ and the rise of the timing pulse $T_2$, the simple logical sum $(T_1+T_2)$ would be a discontinuous pulse, with adverse effects on the option system. To overcome this problem, the OR gate generating the sum is also supplied with a pulse which rises in response to the clock pulse $\Phi_1$ when the timing pulse $T_1$ is at "H" level and which falls when the timing pulse $T_2$ is at "H" level, so that $T_{12}$ is generated as a single pulse. The timing pulse $T_{24}$ is regenerated in the similar manner. The composite timing pulses $T_{12}$ and $T_{24}$ are advantageous in that they enable the number of circuit connections to be reduced.

Figure 33:
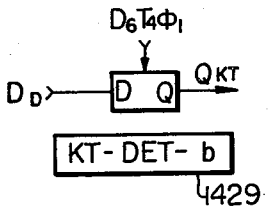
FIG. 33 shows a current time display state detecting circuit.

FIG. 33 shows an example of circuitry for the current time display detecting circuit 1429, designated KT-DET-b. Signal $D_D$, which indicates the data being displayed, indicates current time display when $D_D=D_6$, the date display when $D_D=D_{11}$, and the alarm time display when $D_D=D_{14}$. Thus, the current time display detecting circuit 1429 is supplied with the signal $D_D$ as a latch input, which is latched at the timing of $D_6$ to detect the condition of current time being displayed.

Figure 35:
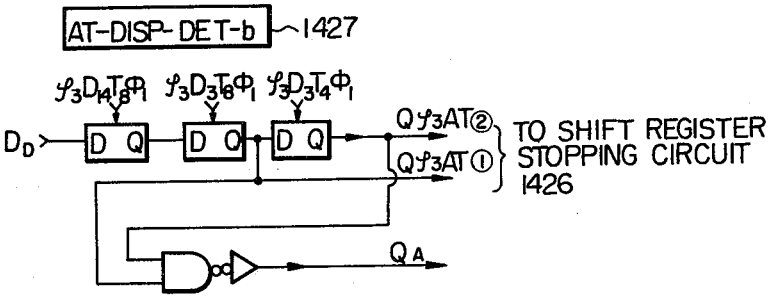
FIG. 35 shows an alarm time display state detecting circuit.

FIG. 35 shows an example of a detail electric circuitry for the alarm time detecting circuit 1427, designated AT-DISP-DET-b. Similarly to the current time detection, the condition of alarm time being displayed is detected at the timing of $D_{14}$ by a latch circuit with the input $D_D$. The condition of alarm time being displayed means that a new alarm time can be set in. In this condition, it is necessary to maintain the synchronized relationship between the electronic time piece and the option system, to ensure that signals are exchanged with complete reliability. To this end, the display condition is detected at the timing $\phi_3D_{14}T_8\Phi_1$ causing an output signal to be generated by a first latch circuit. This output signal is applied to a second latch circuit and read out at the timing of $\phi_3D_3T_8\Phi_1$, designated as $Q_{\phi 3AT1}$. This output is applied to a third latch circuit and read out at the timing $\phi_3D_3T_4Q_1$, designated as $Q_{\phi 3AT②}$. The output signals $Q_{\phi 3AT①}$ and $Q_{\phi 3AT②}$ are applied to an AND gate, whose output signal $Q_A$ indicates that alarm data is being displayed. The output signals $Q_{\phi 3AT①}$ and $Q_{\phi 3AT②}$ are applied to the shift register stopping circuit 1426, to detect a vacant shift register, alarm location during the setting of the alarm time, in a manner which will be subsequently described in detail. The logical product of the output signal $Q_{\phi 3AT①}$ and the inverted output signal $\overline{Q_{\phi 3AT②}}$, synchronized with the pulse $\phi_3$, is maintained in "H" level for a half second indicating that an alarm time is set.

FIG. 36 shows an example of detail circuitry for the pulse generating circuit 1451, designated WIDTH-a, used to generate signals $W_{KT}$, $W_{DT}$, $W_{ATO}$ and $W_{ATI}$. The signals $W_{KT}$ and $W_{DT}$ correspond to the timing of the current time data and date data in the output from the standard system, $W_{KT}$ and $W_{DT}$ are produced by a logic summing gate in accordance with the following equations:

$$Q_7+Q_9=D_7+D_8+D_9+D_{10}=W_{KT}$$

$$Q_{12}+Q_{13}=D_{12}+D_{13}+D_{14}=W_{DT}$$

The pulse generating circuit 1451 also generates timing signals $W_{AT0}$ and $W_{AT1}$. The timing signal $W_{AT0}$ is utilized for opening a gate which transmits signals from the option unit to the standard system, and the timing signal $W_{AT1}$ is utilized for opening a gate which transmits data from the standard system to the option unit. These timing signals are required to be generated in bursts modulated when the clock pulses $\Phi_1$ and $\Phi_2$ and the timing pulses $T_1$ to $T_8$ occur in bursts. Likewise, the timing signals $W_{AT0}$ and $W_{AT1}$ are required to be continuous when the clock pulses $\Phi_1$ and $\Phi_2$ are continuous. To this end, the pulse generating circuit 1451 includes a bistable which generates a burst control signal which rises in synchronism with $Q_{14}T_{12}$ and falls in synchronism with $Q_3$. This signal is applied to gates by which two burst signals $W_{AT0}$ and $W_{AT1}$ are produced in response to the signals $Q_2$ and $Q_{13}$, respectively. $W_{AT0}$ rises in synchronism with the rise of the word timing pulse $D_{14}$ and falls in synchronism with the falling edge of the word timing pulse $D_1$. The timing signal $W_{AT1}$ rises in synchronism with the rising edge of $D_{15}$ and falls in synchronism with the falling edge of $D_2$.

Figure 41:
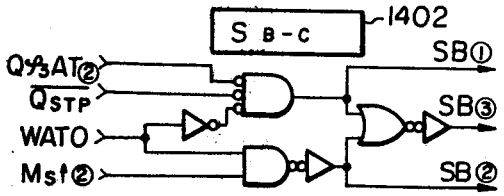
FIG. 41 shows an output control circuit.

FIG. 41 shows a preferred example of circuitry for the data output control circuit 1402 which generates signals $SB_{①}$, $SB_{②}$ and $SB_{③}$, which control the transmission of data from the option unit to the $D_{IN}$ input terminal of the standard system in synchronism with the pulse $\Phi_3$. The data output control circuit 1402 contains a gate which detects the normal current time display state i.e., $Q_{\phi 3AT②}$ = "L" and the state in which the shift register is not stopped, i.e., $\overline{Q_{STP}}=0$, to generate SB1. SB1 causes data from output SRG-121 of the shift register ring 1490, (which is delayed by one word time with respect to output SRG-111) to be delivered to terminal $D_{in}$ of the standard system at timing $D_{14}$ to $D_1$. Note that this timing is one word time in advance of the timing of alarm data output from the standard system. The data output control circuit 1402 also contains a gate which generates a signal SB2, in response to input signal MS2. This controls the transmission of data from the output SRG-111 of shift register 1490 to the standard system during timing $D_{14}$ to $D_1$ each time the manual shift switch is actuated to deliver a new set of alarm time data stored in the option unit to the standard timekeeping system. The data output control circuit also has a gate which generates a signal SB3 when SB1 = "H" or SB2 = "H". SB3 is delivered to the DCL terminal of the standard timekeeping system to reset the alarm time data stored therein to zero.

Figure 40:
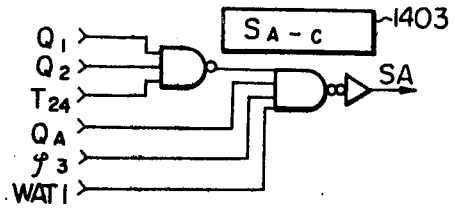
FIG. 40 shows an example of an input control circuit.

FIG. 40 shows a preferred example of circuitry for the data input control circuit 1403, designated $S_A$-C, used to generate a signal SA. Data from the standard timekeeping system is delivered to the option unit through gate 1407 when SA = "H". SA is generated by a gate in response to signal $W_{AT1}$, i.e., during timing $D_{15}$ to $D_2$, when alarm time data is delivered from the standard timekeeping system after a half second has passed following the alarm time being set, i.e., $QA = Q_{3AT①} \cdot Q_{3AT②}$ = "H" and in response to pulse $\phi_3$. SA is applied to gate circuit 1407, which gates through all the data except bits $T_2$ and $T_4$ of word $D_2$ i.e., data including the daily/temporary mark bit for the alarm, AM/PM mark bit and digits of hours, 10 minutes and one minute. When SA = "L", however, the shift register ring 1490 is closed to form a ring circuit in which the stored data is shifted.

FIG. 34 shows a preferred example of circuitry for the pulse generator 1428, designated $\phi$-GEN-a. The standard timekeeping system and the option system are synchronized with each other by signal $\phi_3$ generated by this circuit. $\phi_3$ has a pulse width equal to one memory cycle and being in synchronism with the falling edge of the 2 Hz signal, as shown in FIG. 53. The $D_{IN①}$ signal is applied to a first latch circuit, and is latched at timing $D_4T_4\Phi_1$ to generate a 2 Hz signal from the seconds data of the current time. This 2 Hz signal is applied to a second latch circuit and latched at timing $D_4T_2\Phi_1$. The inverted output signal Q from the second latch circuit, together with its input signal, are applied to a gate which generates a signal $\phi_3$ synchronized with the falling edge of the 2 Hz signal. In thIs illustrated example, the word timing pulse $D_4$ is applied to the gate as an inhibit signal, so that $\phi_3$ rises in synchronism with the rising edge of word pulse $D_5$ and falls in synchronism with the falling edge of the word pulse $D_3$. The $D_{IN①}$ signal is also applied to a third latch circuit and latched at the timing $D_4T_8\Phi_1$ so that a 1 Hz signal is generated. This 1 Hz signal is applied to a second gate which generates a signal $\phi_2$ following the transition of the 1 Hz signal to the "L" level, i.e. during the counts 0 to 0.5 seconds of the current time. The 1 Hz signal is also applied to a fourth gate which generates a signal $\phi_1$ following the transition of the 1 Hz signal to the "H" level, i.e., during time counts 0.5 to 1 seconds. $\phi_3$ is applied to a fourth latch circuit and latched at the timing $D_3T_8\Phi_1$ so that a signal $\phi_4$ is generated, delayed by one memory cycle from the signal $\phi_3$. $\phi_4$ is utilized for detecting vacant locations in the shift register 1490. As shown in FIG. 53, signal $\phi_3$ has a 2 Hz repetition frequency, and is timed such that it is not affected by modulation of data output to the display unit from the standard timekeeping system, and occurs just after each change in the seconds data of current time. Output data from the standard timekeeping system is therefore read into the option unit circuits in synchronism with $\phi_3$, in order to utilize data which is not affected by the display modulation. It is to be noted that since the period of $\phi_3$, 0.5 seconds, is a common multiple of the time required for one cycle of the data in the shift register ring of the standard timekeeping system and also of the time required for one cycle of the data in the shift register ring of the option system, the relative phase of data in the shift registers of the standard timekeeping system and the option system are constant with respect to pulse $\phi_3$.

Figure 44:
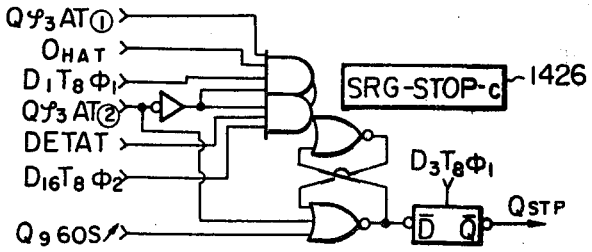
FIG. 44 shows an example of a shift register stop control circuit.
Figure 45:
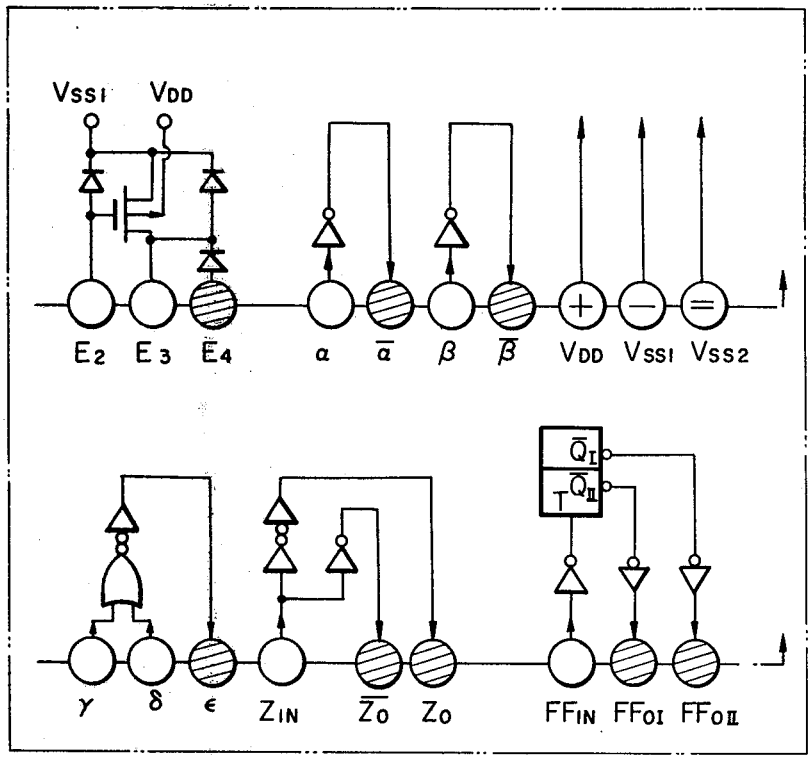
FIG. 45 shows a "flexible" circuit.

In FIG. 44, there is shown a preferred example of detail circuitry for the shift register stopping circuit 1426, used to generate a signal $\overline{Q_{STP}}$ for stopping the shifting operation of the shift register ring 1490 under the following conditions:

a. when the hours data of the alarm time is zero, i.e., when $OHAT.D_1T_8\Phi_1$ = "H" during time period of 0.5 seconds when $Q_{\phi 3AT①}\overline{Q\phi 3AT②}$ = "H", i.e., during the time period in which the search for a vacant shift register location is automatically performed just after the alarm time has been displayed; and b. when the alarm time data coincides with the current time, (i.e., when $D_{10}T_8\Phi_2$. DETAT = "H"), in the normal current time display condition ($Q\phi_{3AT②}$ = "L").

The shifting operation of the shift register ring 1490 is started by the signal $Q\phi_{3AT②}$ when 0.5 seconds have passed after the initiation of alarm time display, i.e., when $Q\phi_{3AT②}$ = "H". If the alarm time data coincides with the current time, the shifting operation of shift register ring 1490 is stopped in the following manner. Alarm time coincidence which occurs with the timepiece in the normal current time display mode is detected at timing $D_{10}T_8\Phi_2$. The alarm time data for which coincidence has occurred is delivered from the option system to the standard timekeeping system at timing $D_{14}$ to $D_1$. As this alarm time data is output from the fourth stage of the shift register after the input, it is erased during timing $D_{15}$ to $D_2$. Thereafter, the clock pulses $\Phi^*_1$ and $\Phi^*_2$ are inhibited from being supplied to shift register ring circuit 1490 so that the shifting operation thereof is stopped. Shifting is started again after 60 seconds have passed following alarm coincidence, by the signal $Q_{9}60S\uparrow$. The supply of the clock pulses $\Phi^*_1$ and $\Phi^*_2$ is stopped during timing of $D_3$ to $D_6$ for the normal time display condition, and during timing $D_3$ to $D_{14}$ for the alarm time display condition. The signal controlling $\Phi^*$ is generated by a latch circuit in response to the signal $D_3T_8\Phi_1$.

FIG. 43 illustrates a preferred example of detailed circuitry for the date alarm data coincidence detecting circuit 1424, used to generate a signal $\overline{ERDT}$. The data output SRG-441 and the signal $D_{IN3}$ *are compared during three word times,* $D_{12}$ to $D_{14}$. If date coincidence occurs, the month and date data of the alarm time and the connecting bit of the preceding alarm time are erased during the four word times $D_{15}$ to $D_2$. Lack of coincidence between the month and date data of the alarm time and the month and date data of current time is detected during the timing $D_{12}$ to $D_{14}$, i.e., when $W_{DT}$="H". In addition, the "H" level of the date mark bit i.e., bit $T_2$ of the mark word of the month and date data of a date alarm time is detected by gating the data from output SRG-111 at time $D_{14}T_2\Phi_1$. If at least one of the signals goes to "H" level, the bistable, which had been set at timing $D_4$ if the timepiece is in the current time display mode, is reset. The signal ERDT is the logical product of the output of the flip-flop and the signal $W_{ATI}$, thus if coincidence occurs it goes high for timing $D_{15}$ to $D_2$ and is used to erase the month and date data of the alarm time, as well as the connecting mark of the hours-minutes portion of the alarm time, by gate 1404 of shift register ring 1490.

FIG. 42 shows a preferred example of detailed circuitry for the alarm time coincidence detecting circuit, used to generate a signal to erase hours-minutes alarm time data when this data coincides with current time. The current time data is applied as input $D_{IN}$③ to an exclusive-OR gate together with data from output SRG-311 of shift register ring 1490, to perform alarm coincidence comparison. The output of the exclusive-OR gate is detected during the timing $D_6$ to $D_9$, i.e. when $W_{KT}$="H". If coincidence does not occur during this time, a bistable is reset by the output of the exclusive OR gate. If, on the other hand, the alarm time data coincides with the current time data, the output of the bistable will be "H" during time period $D_{10}T_1$ to $D_4$. The output of the bistable is applied to an AND gate, to which an input $W_{ATI}$ is also applied, so that an output signal $Q_{ERAT}$ is generated. This output signal is applied to the mark setting circuit 1452 which consequently generates an output signal ALI①. This is applied to the gate 1406 of the shift register ring circuit 1490 thereby erasing the alarm time data. The output DETAT of the bistable is applied to the shift register stopping circuit 1426.

Figure 38:
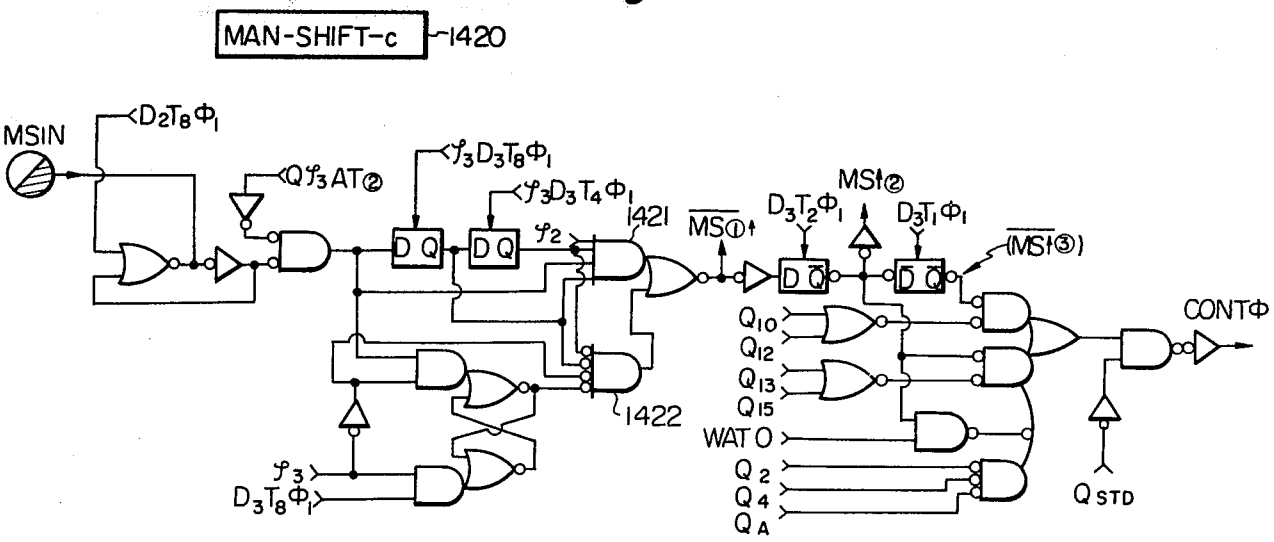
FIG. 38 shows a manual shift control circuit.

FIG. 38 shows a preferred example of detailed circuitry for the manual shift circuit 1420. The control is such that when normal current time is displayed, a new set of alarm time data is delivered to the standard timekeeping system in each memory cycle is updated, whereas when alarm time is displayed, the alarm time data being displayed can be replaced by new alarm data, in response to a command signal generated by actuation of the manual shift switch. In the normal current time display mode, signal $Q_A$ is in the "L" logic state. Since it is applied to an inverting input of an AND gate together with timing signals $Q_4$ and $Q_2$, an output is generated in this condition which rises with the rising edge of word pulse $D_6$ and falls with the falling edge of $D_1$. This output, designated CONT Φ, causes clock pulses $\Phi_1$* and $\Phi_2$* to be generated for the timing of word pulses $D_7$ to $D_2$ through $D_{16}$, as shown in timing chart FIG. 51.

Terminal MSIN of manual shift circuit 1420 is connected to an external control member such as manual shift switch 266 in FIG. 18. With this switch released, terminal MSIN is held at the "L" level by reset pulses $D_2T_8\Phi_1$, but when the switch is depressed, MSIN is set to "H" level. If this "H" level is maintained for a time interval of more than one second, then when $Q\phi_{3AT}$② goes to "H" level in the alarm time display mode the "H" level of input terminal MSIN is latched into a first latch circuit at timing $\phi_3D_3T_8\Phi_1$. Gate 1422 thereby generates an MSIN signal. The output of the first latch circuit is latched into a second latch circuit at timing $\phi_3D_3T_4\Phi_1$ so that an output signal delayed by about one second with respect to the start of the MSIN "H" state is generated. The output signals from the first and second latch circuits are applied to AND gate 1421, to which the input signal to the first latch circuit and the signal $\phi_2$ are also applied, so that output signal MS↑① is generated. When the input terminal MSIN is returned to the "L" level, a new alarm time is displayed. This will be referred to herein as manual sweep operation. The bistable which stores the manually set MSIN input is normally reset by a signal which is the logical product of the signal $\phi_3$ and the signal $D_3T_8\Phi_1$. If input terminal MSIN is set to high level when $\phi_3$ is at "L" level the bistable is set and reset again by the signal $\phi_3D_3T_8\Phi_1$. The logical product of the output of the bistable in its set condition and signal $\phi_3$ is a signal which in effect detects the high level state of input terminal MSIN in synchronism with signal $\phi_3$. When the outputs of the first and second latch circuits are at low level, the high level MSIN input is applied to the gate 1422 as a manual sweeping input. The output signal MS↑① is delayed bt a third latch circuit at the timing of $D_3T_2\Phi_1$ by one memory cycle and a signal MS↑② is generated. The signal MS↑② is utilized for delivering a new set of alarm time data from the option system to the standard time keeping system in the memory cycle just after the manual shift operation. Since, in this instance, it is necessary to supply clock pulses $\Phi^*_1$ and $\Phi^*_2$ into the shift register ring circuit 1490 for the 4 word times between $D_{14}$ to $D_1$, the signal CONT Φ causes Φ* pulses to be generated for these times when MS②↑ is at the "H" level. MS②↑ is supplied to a fourth latch circuit by which it is delayed by one memory cycle, at the timing $D_3T_1\Phi_1$, generating signal MS③↑. When MS③↑="H", the signal $W_{AT0}$ (which rises in synchronism with the rising edge of word timing pulse $D_{14}$ and falls in synchronism with the falling edge of word timing pulse $D_1$) and a signal which rises in synchronism with the rising edge of word timing pulse $D_{10}$ and falls in synchronism with the falling edge of the word timing pulse $D_{13}$ are summed to generate signal CONTΦ. In this case, Φ* clock pulses are generated for the word times $D_{11}$ to $D_2$, as shown in FIG. 51, i.e. for eight words times. As stated previously, when bursts of Φ* clock pulses are sent for four word time periods per memory cycle in the alarm setting mode, the shift register rings of the standard and option systems are effectively held in synchronism. The extra set of Φ* pulses, of duration four word times, generated when the MS③↑ signal occurs, cause the data in the option and standard system shift registers to be shifted with respect to each other by four word times, i.e. by one set of alarm time data. Thus, the next time the manual shift operation is performed, a new set of data is sent from the option to the standard system. The signal MS①↑ is supplied to the mark setting circuit 1452, causing a mark setting counter to be reset to zero so that the mark data newly stored in the option unit shift register ring circuit by the manual shifting operation is not altered.

The manual shift circuit 1420 is supplied with signal $Q_{STOP}$, which is synchronized with signal $D_3T_8\Phi_1$, from the shift register stop circuit 1426. This controls the supply of $\Phi^*$ clock pulses from the manual shift circuit. With the manual shifting circuit 1420 thus arranged, the shift register ring circuit 1490 is not supplied with clock pulses during word times $D_3$ to $D_6$ in the normal current time display mode. Thus, in this operating condition, the data stored in the option system is, in effect, delayed by 16 bits, i.e. four word times, in each memory cycle, relative to the data stored in the standard system. The result is that, during timing $D_{14}$ to $D_1$ of each memory cycle a new set of alarm data is transferred from the option unit to the standard system.

When alarm time is displayed, however, the data stored in the option system is, in effect, advanced by two word times each memory cycle relative to the data in the standard system. Since the alarm data in the option system is delivered back to the standard system twice per second when signal $\phi_3$ is high, and since the period of $\phi_3$, ½ second, is an even factor of the time for once cycle of data stored in the standard system, then insofar as data transfer from the option to the standard system is concerned the two shift register rings of the option and standard systems are circulating in synchronism.

Figure 39:
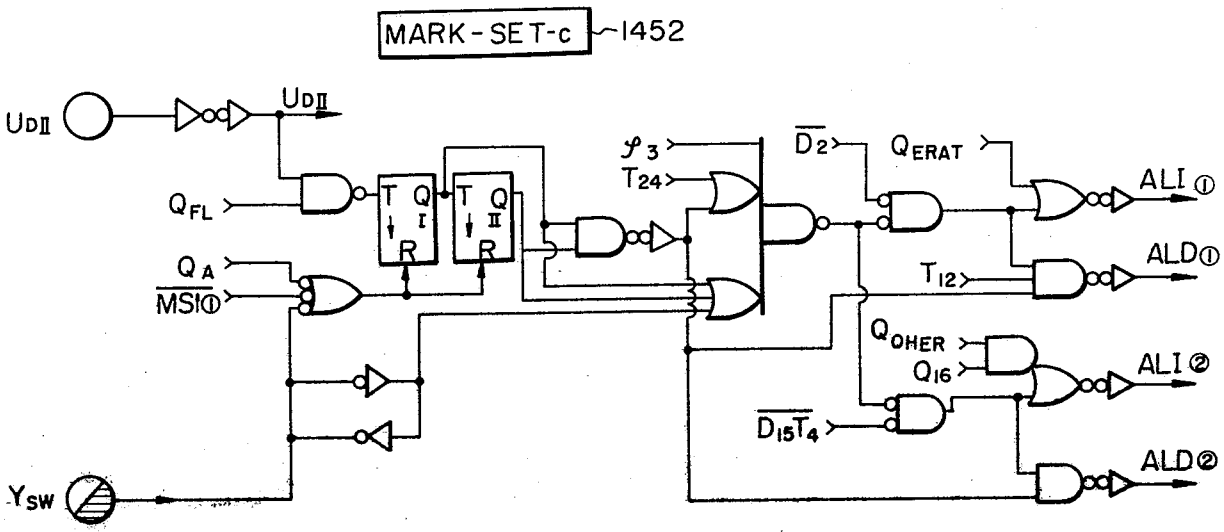
FIG. 39 shows a symbol setting circuit.

FIG. 39 shows a preferred example of detailed circuitry for the mark setting circuit 1452. As shown, the mark setting circuit 1452 includes two bistables, constituting a mark setting counter. As already mentioned hereinabove, the alarm time data is shifted and displayed by the manual shifting operation. If, in the alarm display mode, the switch connected to the UDII input terminal is depressed three times, mark setting circuit 1452 generates signals $ALI_{①}$, $ALD_{①}$, $ALI_{②}$ and $ALD_{②}$ as shown in Table IV. These insert the month-date alarm mark and the hours-minutes connecting mark by which the detection of coincidence between the alarm time data and the current time data is inhibited. The mark setting counter is reset by any of the following: MS ① ↑ signal occurring, the condition of the alarm time not being set or terminal Y being set low. When Y is set to "L" level the mark setting counter is fixed in the reset condition so that it is impossible to set in date alarm times. If the counts 0 , 1, 2 and 3 of the mark setting counter are designated $N_0$, $N_1$, $N_2$ and $N_3$, following equations hold:

$$ALD_{②}=N_3.\phi_3D_{15}T_4$$

$$ALI_{②}=(N_1+N_2+N_3).\phi_3D_{15}T_4+Q_{16}.QOHER$$

$$ALD_{①}=N_3.\phi_3D_2T_2$$

$$ALD_{②}=(N_1+N_2+N_3).\phi_3D_2T_{24}+QERAT.$$

Referring now to FIG. 46, a preferred example of detailed circuitry of the date gate 1482 is shown. The date gate 1482 contains a counter 1467 which is used to count the days of the week to 8 (0–7). When the count 7 is detected from the counter 1467, a trigger input pulse is applied to a second counter, which is a single bistable stage. When the count 8 is output by the first counter 1467, it is reset to "0", and the second counter is set to "1". In this condition, the count input to the first counter 1467 is inhibited. When $\overline{DGO}$="H" (i.e., DGO="L"), the first counter 1467 counts to 8 and, in this condition, the date gate is opened. The first counter 1467 is reset by an input signal DG-reset, which will later be described in detail and a computing start signal from a gate 1462, which the second counter is reset by the input signal DGR. As shown, the date gate circuit 1467 also has a gate 1463 which detects the falling edge of the signal indicating a change of the AM/PM data. The output of this gate is applied to the first counter as an input.

FIG. 48 shows a preferred example of detailed circuitry for the computing circuit 1481. Computing circuit 1481 contains a first counter 1465 and a second counter 1466, both of which count to 60 (0–59). Computing circuit 1481 also includes first and second bistable 1471 and 1472 which are connected to the first and second counters 1465 and 1466, respectively. The condition of a count of more than 60 is memorized in bistables 1471 and 1472, and the outputs of these bistables are applied to the reset inputs of counters 1465 and 1466, respectively, to reset them to "0". The computing circuit 1481 has an input terminal X which is normally set to a "L" level. When X is at "H" level (to set the gain/-loss circuit in the factory) the outputs of the flip-flops 1471 and 1472 are applied to the first and second counters 1465 and 1466, which are consequently reset to "0". The computing circuit 148 also includes a third bistable 1473 which is set by the logic product of the inverted signal $\overline{DGO}$ from the date gate circuit 1482 and the calculating command signal $P_1$ delivered from the input analyzing circuit 1483.

The computing circuit also has a gate 1461 to which signals $\phi_3D_3T_8\Phi_1$ and $\phi_1$ are applied so that a 1 Hz signal synchronized with the timing $T_8\Phi_1$ is generated. Signals $T_8\Phi_1$ and $Q_C$ are applied to gate 1462, which generates a 64 Hz signal. This is applied to the first and second counters 1465 and 1466 when bistable 1473 is set. This signal is also applied to a gate which generates a DG-reset signal to be applied to the reset input of the counter 1467 of the date gate circuit 1482.

If the switch is depressed to set terminal UDII high and activate the computing circuit 1481 when $\overline{DGO}$="H", then a $P_1$ input signal is generated after one minute has passed following depression of the switch. Since actuation of the switch automatically zeros the seconds of current time data in the standard timekeeping system and simultaneously resets first counter 1465 of computing circuit 1481, the seconds counter of the standard timekeeping system coincides and counter 1465 of the computing circuit 1481 will then begin counting seconds simultaneously. In this condition, with the count in each of the counter "0", the date gate counter 1467 is reset by $P_1$, through DG-reset. If the next input signal $P_1$ is generated one week later, when $\overline{DGO}$="H", bistable 1473 of computing circuit 1481 is set and generates a signal $Q_C$, i.e., $Q_C$ goes to "H" level and, consequently, the counts in the first and second counters 1465 and 1466 are shifted at a high speed by signal $T_8\Phi_1$ applied via gate 1462. Thus, the count in counter 1465 quickly goes to "0". This resets bistable 1473 to "0" and since $Q_C$ is now low, gate 1462 is closed, and the new count of counter 1466 is left stored therein. The reset signal DG-reset is also applied to the date gate counter 1467 of the date gate circuit 1482 so that output $\overline{DGO}$ foes to the high level. We may designate the count in the second counter 1466, the first time input signal $P_1$ is applied, as $K_1$. Count $C_1$ of the first counter 1465 is zero after input signal $P_1$ has been applied for the first time. We may also designate the count in the first counter 1465 after $P_1$ is generated for the second time, as $C_2$, this means that the electronic timepiece in the illustrated embodiment has gained $C_2$ seconds in one week. The second time input signal $P_1$ is applied to bistable 1473, the output signal $Q_C$ goes to the high level and, therefore, $(60-C_2)$ number of pulses are applied to counter 1466 which consequently counts to the value $(K_1+60-C_2)$. Since counter 1466 is of the type in which overflow occurs when the calculated result exceeds the count of 60, the resultant count in the counter 1466 is $(K_1-C_2)$. The circuit arrangement is such that a correcting signal is generated to cause a gain in time of one second in a week for each unit increment of the count in counter 1466. So, since $C_2$ has been subtracted from the count stored in counter 1466, the gain of $C_2$ second which has occurred in one week will be exactly compensated for.

Figure 47:
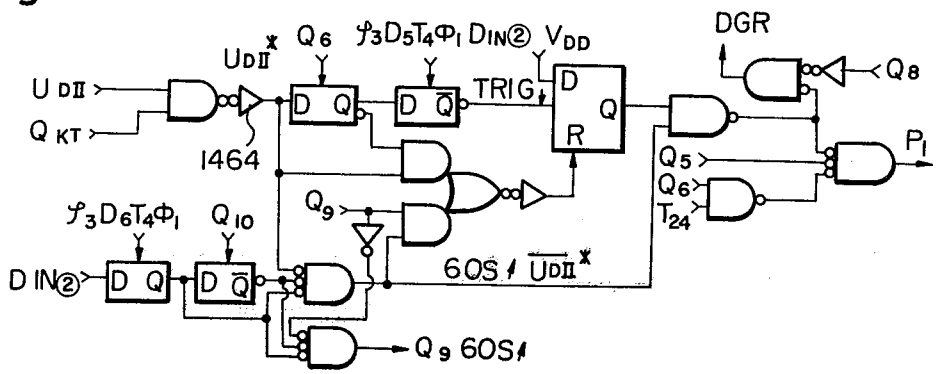
FIG. 47 shows an example of an input analyzing circuit.

Referring to FIG. 47, a preferred example of circuitry for the input analyzing circuit 1483 is shown. The input analyzing circuit 1483 includes a gate which generates an output signal in response to the logic product of signals UDII and QKT. This output signal is applied to an inverter 1464 which generates an output signal UDII*. This output signal is applied as an input signal to a first latch circuit and latched by composite digit signal $Q_6$. The inverted output of the first latch circuit and the output UDII* are applied to a gate, by which a short pulse is generated, which rises in synchronism with the leading edge of output UDII*. This pulse is applied to the reset input of an edge-triggered bistable. The non-inverted output of the first latch circuit is applied to a second latch circuit. Here, it is latched in synchronism with the "four seconds" bit of the current time data, by the signal $\phi_3D_5T_80_1$. $D_{IN2}$. Let us assume that the state UDII="H" continues for a time interval beyond four seconds. In this instance, the second latch circuit detects that the four seconds bit has gone to the high level while input UDII* applied to the first latch circuit is held at high level. The result is that the inverted output $\overline{Q}$ of the second latch goes from high level to low level so that the edge-triggered bistable is set and consequently generates an output of high level. In other words, if the state UDII*="H" is continued for a time interval beyond four seconds, the gain/loss adjusting signal is stored in this bistable. If the signal UDII* becomes low level after, a time interval of more than four seconds has elapsed, signal DIN2 is latched into a third latch circuit by the signal $\phi_3D_6T_40_1$, in synchronism with the bit representing 40 seconds in the current time. Thereafter, the changes in minutes data of the current time kept in the register 58 in FIG. 3 represents the falling edge of the 40 seconds signal being detected by a fourth latch circuit. The signal indicating changes in minutes will be referred to as 60S ↑ .$\overline{\text{UDII*}}$ is a signal representing that one minute has just passed after the signal UDII has been maintained at high level for a time interval of more than 4 seconds, with the timepiece in the seconds zeroing mode. The command signal $P_1$ is the logical product of the signal 60S ↑ .UDII* and $Q_5D_6T_{24}$, and is utilized as a command signal to start the calculation for adjusting gain/loss. An output signal which is the logical product of signals 60S ↑ .$\overline{\text{UDII*}}$ and $Q_9$ is applied to the reset input of the edge-triggered bistable. The output of the edge-triggered bistable flip-flop and signal 60S ↑ .$\overline{\text{UDII*}}$ are applied to a gate whose output is applied to another gate to which signal $Q_8$ is also applied, as shown in FIG. 47. This gate generates an output signal DGR, which is supplied to the reset input of the divide-by-two bistable of the date gate circuit 1482 so that the gate circuit is reset to its starting state, i.e., the state of being ready to count to eight days.

If the switch for zeroing the seconds display is depressed for less than 4 seconds, the edge-triggered bistable of the input analyzing circuit 1483 is not triggered and, therefore, a signal commanding gain/loss adjustment is not generated. As already noted hereinabove, the output signal $P_1$ is not generated until one minute has passed following the switch being first depressed and, accordingly, it is possible to cancel the application of the gain/loss adjusting signal by setting signal UDII* to the low level within one minute.

FIG. 49 shows a preferred example of the frequency adjusting pulse generating circuit. This circuit has already been discussed hereinabove and, therefore, a detailed description is omitted here.

What is claimed is:

1. An electronic timepiece comprising:

a frequency supply for providing a relatively high frequency timebase signal;

a frequecy converter responsive to said timebase signal for providing a relatively low frequency time unit signal, timing signals, and a plurality of word pulses indicative of a plurality of data words representing time data concerning the current time, and a set of additional data other than said time data;

primary register means arranged to store said time data and said additional data;

display means for displaying time data and said additional data;

externally actuated correction means for generating correction signals to modify the contents of said additional data in said primary register means;

an external control member for producing an input control signal;

means for generating an indexing signal in response to said input control signal; and secondary register means arranged to store a plurality of sets of alarm time data each corresponding to a single alarm time, and operable to be placed in an alarm time indexing mode of operation whereby each of said sets of alarm time data is transferred to said primary register means to be stored therein as said additional data, and to be thereby enabled to be updated by said correction signals from said correction means, and wherein alarm time data thus updated is transferred to a corresponding register location of said secondary register means.

2. An electronic timepiece according to claim 1, in which said indexing signal generating means comprises means for generating a single indexing signal each time said input signal is produced by said external control member.

3. An electronic timepiece according to claim 1, in which said indexing signal generating means comprises means for automatically generating a plurality of indexing signals to cause a plurality of sequential indexing operations, when said external control member is actuated in a predetermined actuation mode.

4. An electronic timepiece according to claim 1, in which said automatic indexing signal generating means comprises means for discriminating the time duration of actuation of said external control member for producing said plurality of indexing signals.

5. An electronic timepiece according to claim 1, further comprising means for generating an output command signal in response to said indexing signal, and in which said secondary register means comprises a ring including a register, and an output control gate responsive to said output command signal for transferring each set of additional data to said primary register means.

6. An electronic timepiece according to claim 1, further comprising means for generating an output control signal in response to said indexing signal, said secondary register means being responsive to said output control signal for transferring one of said sets of alarm time data to said primary register means to permit updating thereof.

7. An electronic timepiece according to claim 1, further comprising means for generating a vacant register location signal, when said secondary register means is in said alarm time indexing mode, said secondary register means being responsive to said vacant register location signal to transfer vacant data in said vacant register location to said primary register means.

8. An electronic timepiece according to claim 7, further comprising means for enabling said secondary register means whereby, in the absence of said vacant register location in said secondary register means, said secondary register means is enabled to transfer the most recently entered set of alarm time data to said primary register means, to be there by displayed by said display means.

9. An electronic timepiece according to claim 1, wherein said timepiece is operable in a normal mode of operation in which said sets of alarm time data stored in said secondary register means are successively and automatically transferred to said primary register, and further comprising means for comparing rach of the alarm times represented by each of said sets of alarm time data with said current time and for producing an alarm signal when coincidence occurs therebetween.

10. An electronic timepiece comprising:

a primary timepiece circuit unit including a source of a relatively high frequency signal, a frequency converter responsive to said reltively high frequency signal for producing a relatively low frequency time unit signal, timing signals, and a plurality of word timing pulses, primary register means including a plurality of shift register stages responsive to said timing signals for storing data, said data comprising current data and additional data other than said current time data, adder circuit means coupled in said primary register means and responsive to said time unit signal for periodically updating said current time data, and display means including a plurality of display elements for displaying said time data and additional data;

externally actuated means for producing an input signal;

means for producing an indexing signal in response to said input signal; and secondary register means arranged to store a plurality of sets of data, and operable to transfer each of said sets of data to said primary register means in a sequential manner to form said additional data in response to said indexing signal, whereby each of said sets of data is sequentially displayed by said display means.

11. An electronic timepiece according to claim 10, in which said indexing signal generating means comprises means for producing a single initiation of said indexing signal each time said input signal is produced by said externally actuated means.

12. An electronic timepiece according to claim 10, in which said indexing signal generating means comprises means for automatically generating a plurality of initiations of said indexing signal in succession, when said externally actuated means are actuated in a predetermined actuation mode.

13. An electronic timepiece according to claim 12, in which said automatic indexing signal generating means comprises means for discriminating the duration of actuation of said externally actuated means for producing said input signal.

14. An electronic timepiece according to claim 10, in which said secondary register means comprises a shift register ring and an output control gate, and further comprising means for generating an output command signal in response to said indexing signal, said output control gate being responsive to said output command signal for transferring each of said sets of data in said secondary register means to said primary register means.

15. An electronic timepiece according to claim 1, in which each of said sets of data in said secondary register means represents an alarm time.

16. An electronic timepiece according to claim 1, and further comprising means for visibly modulating data displayed by said display means in accordance with the contents of said additional data.

* * * * *